US011083248B2

(12) United States Patent
Schneider et al.

(10) Patent No.: US 11,083,248 B2
(45) Date of Patent: Aug. 10, 2021

(54) AUTOMATED FOOTWEAR PLATFORM HAVING UPPER ELASTIC TENSIONER

(71) Applicant: NIKE, Inc., Beaverton, OR (US)

(72) Inventors: Summer L. Schneider, Beaverton, OR (US); Narissa Chang, Portland, OR (US); Eric P. Avar, Lake Oswego, OR (US); Thomas G. Bell, Portland, OR (US); Christopher Andon, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 15/921,218

(22) Filed: Mar. 14, 2018

(65) Prior Publication Data

US 2018/0199673 A1 Jul. 19, 2018

Related U.S. Application Data

(63) Continuation-in-part of application No. 15/458,824, filed on Mar. 14, 2017, now abandoned.
(Continued)

(51) Int. Cl.
*A43C 11/16* (2006.01)
*A43C 7/06* (2006.01)
(Continued)

(52) U.S. Cl.
CPC ..... *A43C 11/165* (2013.01); *A43B 3/0005* (2013.01); *A43B 11/00* (2013.01);
(Continued)

(58) Field of Classification Search
None
See application file for complete search history.

(56) References Cited

U.S. PATENT DOCUMENTS 4,142,307 A 3/1979 Martin
4,756,098 A 7/1988 Boggia
(Continued)

FOREIGN PATENT DOCUMENTS

CN 1047797 12/1990
CN 1172621 2/1998
(Continued)

OTHER PUBLICATIONS

"U.S. Appl. No. 15/458,824, Non Final Office Action dated Oct. 29, 2018", 11 pgs.
(Continued)

*Primary Examiner* — Jila M Mohandesi
(74) *Attorney, Agent, or Firm* — Schwegman Lundberg & Woessner, P.A.

(57) ABSTRACT

A footwear assembly can comprise, an upper, a lace cable, a plurality of lace guides and a tensioner. The tensioner can comprise an elastic member extending between two lace guides of the plurality of lace guides, an elastic member extending between first and second portions of the upper, an elastic member extending between a portion of the upper and a lace guide of the plurality of lace guides, a heel channel connected to a heel portion of the upper and configured to facilitate access to an interior space, an elastic member coupled to the footwear assembly that functions to smooth out a torque versus lace displacement curve during tightening of the lace cable.

28 Claims, 32 Drawing Sheets

Related U.S. Application Data

(60) Provisional application No. 62/471,850, filed on Mar. 15, 2017, provisional application No. 62/475,105, filed on Mar. 22, 2017, provisional application No. 62/424,301, filed on Nov. 18, 2016, provisional application No. 62/413,142, filed on Oct. 26, 2016.

(51) Int. Cl.

| | |
|---|---|
| ***A43C 1/00*** | (2006.01) |
| ***A43B 3/00*** | (2006.01) |
| ***A43B 13/14*** | (2006.01) |
| ***A43B 23/04*** | (2006.01) |
| ***A43B 23/02*** | (2006.01) |
| ***A43C 11/00*** | (2006.01) |
| ***A43B 11/00*** | (2006.01) |
| ***A43C 3/00*** | (2006.01) |

(52) U.S. Cl.

CPC ..... *A43B 13/14* (2013.01); *A43B 23/0245* (2013.01); *A43C 1/00* (2013.01); *A43C 3/00* (2013.01); *A43C 7/06* (2013.01); *A43C 11/008* (2013.01)

(56) References Cited

U.S. PATENT DOCUMENTS

| | | | | |
|---|---|---|---|---|
| 4,924,605 | A * | 5/1990 | Spademan | A43B 5/00 36/114 |
| 4,972,613 | A * | 11/1990 | Loveder | A43B 5/00 36/105 |
| 5,293,675 | A | 3/1994 | Shai | |
| 5,371,957 | A | 12/1994 | Gaudio | |
| 5,425,185 | A * | 6/1995 | Gansler | A43C 11/00 36/50.1 |
| 5,467,537 | A | 11/1995 | Aveni et al. | |
| 5,555,650 | A | 9/1996 | Longbottom et al. | |
| 5,566,474 | A | 10/1996 | Leick et al. | |
| 5,692,319 | A | 12/1997 | Parker et al. | |
| 5,755,044 | A * | 5/1998 | Veylupek | A43C 1/003 36/50.1 |
| 5,909,947 | A | 6/1999 | Demarchi | |
| 6,289,558 | B1 | 9/2001 | Hammerslag | |
| 6,324,774 | B1 * | 12/2001 | Zebe, Jr. | A43C 3/00 24/712.7 |
| 6,444,908 | B1 | 9/2002 | Krall | |
| 6,502,329 | B1 | 1/2003 | Silagy | |
| 6,691,433 | B2 | 2/2004 | Liu | |
| 6,735,829 | B2 | 5/2004 | Hsu | |
| 6,896,128 | B1 | 5/2005 | Johnson | |
| 6,922,917 | B2 | 8/2005 | Kerns et al. | |
| 7,082,701 | B2 | 8/2006 | Dalgaard et al. | |
| 7,591,050 | B2 | 9/2009 | Hammerslag | |
| 7,752,774 | B2 | 7/2010 | Ussher | |
| 7,841,106 | B2 | 11/2010 | Farys | |
| 8,752,200 | B2 | 6/2014 | Varshavsky et al. | |
| 8,800,173 | B2 | 8/2014 | Smith et al. | |
| 9,149,089 | B2 | 10/2015 | Cotterman et al. | |
| 9,763,495 | B2 | 9/2017 | Takada et al. | |
| 2003/0204938 | A1 | 11/2003 | Hammerslag | |
| 2005/0198867 | A1 | 9/2005 | Labbe | |
| 2006/0075614 | A1 | 4/2006 | Chmelar | |
| 2007/0068040 | A1 * | 3/2007 | Farys | A43C 1/04 36/50.1 |
| 2007/0169378 | A1 | 7/2007 | Sodeberg et al. | |
| 2008/0172848 | A1 | 7/2008 | Chen | |
| 2008/0307673 | A1 | 12/2008 | Johnson | |
| 2010/0175278 | A1 | 7/2010 | Seliger | |
| 2011/0225843 | A1 | 9/2011 | Kerns et al. | |
| 2012/0000091 | A1 | 1/2012 | Cotterman et al. | |
| 2012/0011744 | A1 | 1/2012 | Bell et al. | |
| 2012/0117821 | A1 * | 5/2012 | Adams | A43B 3/0052 36/58.5 |
| 2012/0124866 | A1 | 5/2012 | Moriyasu et al. | |
| 2012/0240428 | A1 | 9/2012 | Knoll | |
| 2013/0086816 | A1 | 4/2013 | Johnson et al. | |
| 2014/0079900 | A1 | 3/2014 | Ramirez | |
| 2014/0082963 | A1 * | 3/2014 | Beers | A43C 11/00 36/83 |
| 2014/0094728 | A1 | 4/2014 | Soderberg et al. | |
| 2014/0157627 | A1 * | 6/2014 | Smaldone | A43C 11/165 36/83 |
| 2015/0026937 | A1 * | 1/2015 | Nonogawa | A43C 1/00 24/713.4 |
| 2015/0040429 | A1 | 2/2015 | Beers | |
| 2015/0059206 | A1 | 3/2015 | Lovett et al. | |
| 2015/0096202 | A1 | 4/2015 | Hahnenberger et al. | |
| 2015/0289595 | A1 * | 10/2015 | Rushbrook | A43B 5/02 36/50.1 |
| 2016/0143396 | A1 | 5/2016 | Beers | |
| 2016/0198799 | A1 | 7/2016 | Partin et al. | |
| 2016/0198803 | A1 | 7/2016 | Soderberg et al. | |
| 2016/0213099 | A1 | 7/2016 | Ha | |
| 2017/0099909 | A1 | 4/2017 | Lee et al. | |
| 2017/0265581 | A1 | 9/2017 | Chang | |
| 2017/0265585 | A1 | 9/2017 | Orand | |
| 2018/0035759 | A1 | 2/2018 | Pollack et al. | |
| 2018/0199671 | A1 | 7/2018 | Schneider et al. | |
| 2018/0289110 | A1 | 10/2018 | Bock et al. | |
| 2018/0368526 | A1 | 12/2018 | Bock et al. | |
| 2020/0214395 | A1 | 7/2020 | Schneider et al. | |

FOREIGN PATENT DOCUMENTS

| | | | |
|---|---|---|---|
| CN | 1196209 | | 10/1998 |
| CN | 102132983 | | 7/2011 |
| CN | 102821635 | | 12/2012 |
| CN | 103462737 | | 12/2013 |
| CN | 104023579 | | 9/2014 |
| CN | 105517459 | | 4/2016 |
| CN | 106231941 | | 12/2016 |
| CN | 110113962 | A | 8/2019 |
| CN | 110636772 | | 12/2019 |
| CN | 111616466 | | 9/2020 |
| EP | 3254578 | | 12/2017 |
| EP | 3531858 | A1 | 9/2019 |
| FR | 2827486 | | 1/2003 |
| FR | 3038815 | | 1/2017 |
| JP | S4841446 | | 5/1973 |
| JP | S5188441 | | 7/1976 |
| JP | H054902 | | 1/1993 |
| JP | H07208 | | 1/1995 |
| JP | H0751103 | | 2/1995 |
| JP | H08503148 | | 4/1996 |
| JP | 2000014410 | | 1/2002 |
| JP | 2005205162 | | 8/2005 |
| JP | 2007000208 | | 1/2007 |
| JP | 2011519611 | | 7/2011 |
| JP | 2012045376 | | 3/2012 |
| JP | 2016507296 | | 3/2016 |
| JP | 2019536526 | | 12/2019 |
| JP | 2020039896 | | 3/2020 |
| JP | 2019550635 | | 4/2020 |
| KR | 20190131516 | A | 11/2019 |
| KR | 20190133054 | A | 11/2019 |
| KR | 102125361 | | 6/2020 |
| KR | 102125378 | | 6/2020 |
| KR | 1020200078661 | | 7/2020 |
| KR | 1020200078662 | | 7/2020 |
| WO | 9410869 | | 5/1994 |
| WO | 2011004422 | | 1/2011 |
| WO | 2011091325 | | 7/2011 |
| WO | 2016184899 | | 11/2016 |
| WO | 2018026957 | | 2/2018 |

OTHER PUBLICATIONS

"U.S. Appl. No. 15/921,222, Response filed Dec. 27, 2019 to Restriction Requirement dated Aug. 14, 2019", 10 pgs.

"U.S. Appl. No. 15/458,824, Final Office Action dated Feb. 18, 2020", 26 pgs.

(56) References Cited

OTHER PUBLICATIONS

"Japanese Application Serial No. 2019-550635, Voluntary Amendment filed Nov. 12, 2019", w English claims, 5 pgs.
"European Application Serial No. 17865224.4, Response to Communication Pursuant to Rules 161 and 162 filed Dec. 10, 2019", 10 pgs.
"U.S. Appl. No. 15/458,824, Restriction Requirement dated Aug. 13, 2018", 9 pgs.
"International Application Serial No. PCT/US2017/022343, International Search Report dated Jul. 24, 2017", 3 pgs.
"International Application Serial No. PCT/US2017/022343, Written Opinion dated Jul. 24, 2017", 6 pgs.
"U.S. Appl. No. 15/458,824, Examiner Interview Summary dated Sep. 20, 2019", 3 pgs.
"U.S. Appl. No. 15/458,824, Final Office Action dated Mar. 22, 2019", 20 pgs.
"U.S. Appl. No. 15/458,824, Non Final Office Action dated Jun. 10, 2019", 20 pgs.
"U.S. Appl. No. 15/458,824, Response filed May 22, 2019 to Final Office Action dated Mar. 22, 2019", 13 pgs.
"U.S. Appl. No. 15/458,824, Response filed Oct. 9, 2019 to Non-Final Office Action dated Jun. 10, 2019", 13 pgs.
"U.S. Appl. No. 15/921,222, Restriction Requirement dated Aug. 14, 2019", 8 pgs.
"European Application Serial No. 18767547.5, Response filed Oct. 31, 2019 to Communication Pursuant to Rules 161(1) and 162 EPC mailed", 25 pgs.
"International Application Serial No. PCT/US2017/022343, International Preliminary Report on Patentability dated May 9, 2019", 8 pgs.
"International Application Serial No. PCT/US2018/022416, International Preliminary Report on Patentability dated Sep. 26, 2019", 12 pgs.
"International Application Serial No. PCT US2018 022416, International Search Report dated Jul. 24, 2018", 6 pgs.
"International Application Serial No. PCT US2018 022416, Written Opinion dated Jul. 24, 2018", 10 pgs.
"Japanese Application Serial No. 2019-209870, Voluntary Amendment filed Jan. 14, 2020", w English claims, Voluntary Amendment and PPH Request, 12 pgs.
"European Application Serial No. 19206673.6, Extended European Search Report dated Mar. 3, 2020", 7 pgs.
"U.S. Appl. No. 15/921,222, Non Final Office Action dated Mar. 16, 2020", 13 pgs.
"Korean Application Serial No. 10-2019-7030164, Voluntary Amendment filed Nov. 15, 2019", w English claims, PPH Request and Voluntary Amendment filed, 12 pgs.
"Japanese Application Serial No. 2019-550635, Notification of Reasons for Refusal dated Apr. 14, 2020", w English translation, 6 pgs.
"Japanese Application Serial No. 2019-209870, Notification of Reasons for Refusal dated Apr. 14, 2020", w English translation, 7 pgs.
"European Application Serial No. 17865224.4, Extended European Search Report dated Apr. 24, 2020", 8 pgs.
"U.S. Appl. No. 15/921,222, Response filed Jun. 11, 2020 to Non Final Office Action dated Mar. 16, 2020", 17 pgs.
"Japanese Application Serial No. 2019-550635, Response filed Jun. 26, 2020 to Notification of Reasons for Refusal dated Apr. 14, 2020", w English claims, 11 pgs.
"Japanese Application Serial No. 2019-209870, Response filed Jun. 26, 2020 to Notification of Reasons for Refusal dated Apr. 14, 2020", w English claims, 11 pgs.
"U.S. Appl. No. 15/921,222, Final Office Action dated Jul. 10, 2020", 14 pgs.
"U.S. Appl. No. 16/819,893, Non Final Office Action dated Jul. 13, 2020", 11 pgs.
"Chinese Application Serial No. 201880030117.0, Office Action dated Jul. 6, 2020", w English translation, 15 pgs.
"U.S. Appl. No. 15/921,222, Response filed Sep. 8, 2020 to Final Office Action dated Jul. 10, 2020", 21 pgs.
"Korean Application Serial No. 10-2020-7017149, Notice of Preliminary Rejection dated Sep. 2, 2020", w English translation, 6 pgs.
"U.S. Appl. No. 15/921,222, Advisory Action dated Sep. 14, 2020", 2 pgs.
"Japanese Application Serial No. 2019-550635, Notification of Reasons for Refusal dated Sep. 15, 2020", 8 pgs.
"Japanese Application Serial No. 2019-209870, Notification of Reasons for Refusal dated Sep. 15, 2020", w English translation, 8 pgs.
"U.S. Appl. No. 16/819,893, Response filed Oct. 13, 2020 to Non Final Office Action dated Jul. 13, 2020", 9 pgs.
"European Application Serial No. 19206673.6, Response filed Sep. 29, 2020 to Extended European Search Report dated Mar. 3, 2020",104 pgs.
"European Application Serial No. 17865224.4, Response filed Nov. 4, 2020 to Extended European Search Report dated Apr. 24, 2020",15 pgs.
"Chinese Application Serial No. 201780079469.0, Office Action dated Nov. 11, 2020", w English Translation, 18 pgs.
"European Application Serial No. 18767547.5, Extended European Search Report dated Dec. 10, 2020", 7 pgs.
"Chinese Application Serial No. 201880030117.0, Office Action dated Mar. 1, 2021", w Concise Statement of Relevance, 8 pgs.
"European Application Serial No. 17865224.4, Communication Pursuant to Article 94(3) EPC dated Mar. 25, 2021", 5 pgs.
"Chinese Application Serial No. 202010411118.9, Office Action dated Mar. 11, 2021", 7 pgs.
"U.S. Appl. No. 16/819,893, Final Office Action dated Jan. 15, 2021", 10 pgs.
"Chinese Application Serial No. 201880030117.0, Response filed Jan. 21, 2021 to Office Action dated Jul. 6, 2020", w English Claims, 14 pgs.
"Korean Application Serial No. 10-2020-7017149, Response filed Feb. 15, 2021 to Notice of Preliminary Rejection dated Sep. 2, 2020", w English Claims, 9 pgs.
"Japanese Application Serial No. 2019-550635, Response filed Feb. 18, 2021 to Notification of Reasons for Refusal dated Sep. 15, 2020", w English Claims, 11 pgs.
"Japanese Application Serial No. 2019-209870, Response filed Feb. 18, 2021 to Notification of Reasons for Refusal dated Sep. 15, 2020", w English Claims, 10 pgs.
"U.S. Appl. No. 16/819,893, Pre-Appeal Brief Request for Review dated Apr. 8, 2021", 5 pgs.
"U.S. Appl. No. 15/921,222, Notice of Allowance dated Mar. 24, 2021", 10 pgs.
"U.S. Appl. No. 15/921,222, Corrected Notice of Allowability dated Apr. 1, 2021", 3 pgs.
"Japanese Application Serial No. 2019-522651, Notification of Reasons for Rejection dated Apr. 27, 2021", w English Translation, 10 pgs.

* cited by examiner

AUTOMATED FOOTWEAR PLATFORM HAVING UPPER ELASTIC TENSIONER

CLAIM OF PRIORITY

This application claims the benefit of priority to U.S. Provisional Patent Application Ser. No. 62/471,850, filed on Mar. 15, 2017; and U.S. Provisional Patent Application Ser. No. 62/475,105, filed on Mar. 22, 2017, which are hereby incorporated by reference herein in their entirety.

This patent application is also a continuation-in-part of and claims priority to U.S. patent application Ser. No. 15/458,824, filed on Mar. 14, 2017, which claims the benefit of priority to U.S. Provisional Patent Application Ser. No. 62/424,301, filed on Nov. 18, 2016, and U.S. Provisional Patent Application Ser. No. 62/413,142, filed on Oct. 26, 2016, which are incorporated by reference in their entirety.

BACKGROUND

The present application relates generally to tensioning systems for footwear. More particularly, the present application relates to uppers and lacing systems for controlling footwear fit.

Current footwear uppers generally have fixed dimensions and therefore do not readily permit either to conform to the shape of the foot. Thus, a wearer typically controls the fit and tension of the upper with a lacing system. However, in footwear including motorized lacing engines, the ability of the wearer of the footwear to tighten the upper around the foot by adjusting the lacing system with the feel and tactile feedback that can be obtained from manual lacing systems can become diminished. As such, there is a need for improving the capabilities of the upper and lacing system to conform to the shape of the foot with a desired amount of tension, particularly with automated lacing engines.

BRIEF SUMMARY

The following specification describes various aspects of a footwear assembly involving a lacing system including a motorized or non-motorized lacing engine, footwear components related to the lacing engines, automated lacing footwear platforms, and related manufacturing processes. More specifically, much of the following specification describes various aspects of lacing architectures (configurations) for use in footwear including motorized or non-motorized lacing engines for centralized lace tightening. The following specification additionally describes various tensioners that can be incorporated into the footwear assembly, such as in the upper of lacing architecture.

A footwear assembly comprises: a footwear upper including a toe box portion, a medial side, a lateral side, and a heel portion, the medial side and the lateral side each extending proximally from the toe box portion to the heel portion; a lace cable with a first end anchored along a distal outside portion of the medial side and a second end anchored along a distal outside portion of the lateral side; a plurality of lace guides distributed along the medial side and the lateral side, each lace guide of the plurality of lace guides adapted to receive a length of the lace cable, wherein the lace cable extends through each of the plurality of lace guides to form a pattern along each of the medial side and lateral side of the footwear upper; a medial proximal lace guide routing the lace cable from the pattern formed by a medial portion of the plurality of lace guides into a position allowing the lace cable to engage a lacing engine disposed within a mid-sole portion; a lateral proximal lace guide to route the lace cable out of the position allowing the lace cable to engage the lacing engine into the pattern formed by a lateral portion of the plurality of lace guides; and a first elastic member extending between first and second lace guides of the plurality of lace guides.

A footwear assembly comprises: a footwear upper including a toe box portion, a medial side, a lateral side, and a heel portion, the medial side and the lateral side each extending proximally from the toe box portion to the heel portion; a lace cable with a first end anchored along a distal outside portion of the medial side and a second end anchored along a distal outside portion of the lateral side; a plurality of lace guides distributed along the medial side and the lateral side, each lace guide of the plurality of lace guides adapted to receive a length of the lace cable, wherein the lace cable extends through each of the plurality of lace guides to form a pattern along each of the medial side and lateral side of the footwear upper; a medial proximal lace guide routing the lace cable from the pattern formed by a medial portion of the plurality of lace guides into a position allowing the lace cable to engage a lacing engine disposed within a mid-sole portion; a lateral proximal lace guide to route the lace cable out of the position allowing the lace cable to engage the lacing engine into the pattern formed by a lateral portion of the plurality of lace guides; and a first elastic member extending between first and second portions of the footwear upper.

A footwear assembly comprises: a footwear upper including a toe box portion, a medial side, a lateral side, and a heel portion, the medial side and the lateral side each extending proximally from the toe box portion to the heel portion; a lace cable with a first end anchored along a distal outside portion of the medial side and a second end anchored along a distal outside portion of the lateral side; a plurality of lace guides distributed along the medial side and the lateral side, each lace guide of the plurality of lace guides adapted to receive a length of the lace cable, wherein the lace cable extends through each of the plurality of lace guides to form a pattern along each of the medial side and lateral side of the footwear upper; a medial proximal lace guide routing the lace cable from the pattern formed by a medial portion of the plurality of lace guides into a position allowing the lace cable to engage a lacing engine disposed within a mid-sole portion; a lateral proximal lace guide to route the lace cable out of the position allowing the lace cable to engage the lacing engine into the pattern formed by a lateral portion of the plurality of lace guides; and a first elastic member extending between a first portion of the footwear upper and a first lace guide of the plurality of lace guides.

A footwear assembly comprises: a sole structure; a footwear upper defining a toe box portion, a medial side, a lateral side, and a heel portion, the footwear upper connected to the sole structure to form an interior space for receiving a foot, the footwear upper forming a collar to permit access to the interior space; a lacing engine disposed in the sole structure; a lacing system comprising: a lace cable having medial and lateral ends anchored to the footwear upper and a middle portion passing through the lacing engine; and a plurality of lace guides for routing the lace cable along the footwear upper between the medial and lateral ends and the lacing engine; and a heel channel connected to the heel portion and configured to facilitate access to the interior space.

A footwear assembly comprises: a sole structure; a footwear upper defining a toe box portion, a medial side, a lateral side, and a heel portion, the footwear upper connected to the sole structure to form an interior space for receiving a foot, the footwear upper forming a collar to permit access to the interior space; a lacing engine disposed in the sole structure; a lacing system comprising: a lace cable having medial and lateral ends anchored to the footwear upper and a middle portion passing through the lacing engine; and a plurality of lace guides for routing the lace cable along the footwear upper between the medial and lateral ends and the lacing engine; and an elastic member coupled to the footwear assembly that functions to smooth out a torque versus lace displacement curve during tightening of the lace cable.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

Figure 1:
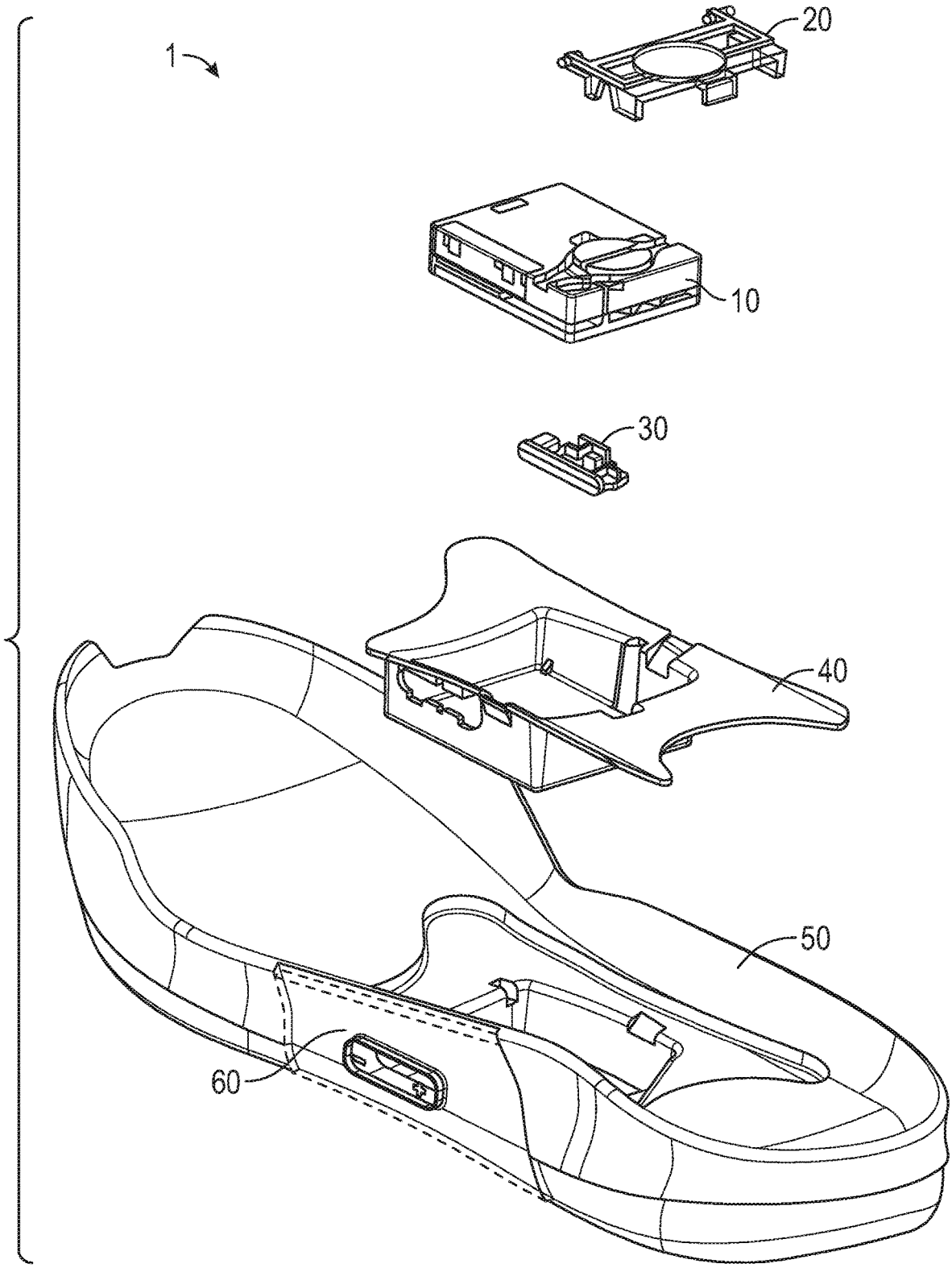
FIG. 1 is an exploded view illustration of components of a portion of a footwear assembly with a motorized lacing system, according to some example embodiments.

Any headings provided herein are merely for convenience and do not necessarily affect the scope or meaning of the terms used or discussion under the heading.

DETAILED DESCRIPTION

The concept of self-tightening shoe laces was first widely popularized by the fictitious power-laced Nike® sneakers worn by Marty McFly in the movie Back to the Future II, which was released back in 1989. While Nike® has since released at least one version of power-laced sneakers similar in appearance to the movie prop version from Back to the Future II, the internal mechanical systems and surrounding footwear platform employed do not necessarily lend themselves to mass production or daily use. Additionally, other previous designs for motorized lacing systems comparatively suffered from problems such as high cost of manufacture, complexity, assembly challenges, and poor serviceability. The present inventors have developed a modular footwear platform to accommodate motorized and non-motorized lacing engines that solves some or all of the problems discussed above, among others. In order to fully leverage the modular lacing engine discussed briefly below and in greater detail in Application Ser. No. 62/308,686, titled "LACING APPARATUS FOR AUTOMATED FOOTWEAR PLATFORM," the present inventors developed a lacing architectures discussed herein. The lacing architectures discussed herein can solve various problems experienced with centralized lace tightening mechanisms, such as uneven tightening, fit, comfort, and performance. The lacing architectures provide various benefits, including smoothing out lace tension across a greater lace travel distance and enhanced comfort while maintaining fit performance. One aspect of enhanced comfort involves a lacing architecture that reduces pressure across the top of the foot. Example lacing architectures can also enhance fit and performance by manipulating lace tension both a medial-lateral direction as well as in an anterior-posterior (front to back) direction. Various other benefits of the components described below will be evident to persons of skill in the relevant arts.

The lacing architectures discussed were developed specifically to interface with a modular lacing engine positioned within a mid-sole portion of a footwear assembly. However, the concepts could also be applied to motorized and manual lacing mechanisms disposed in various locations around the footwear, such as in the heel or even the toe portion of the footwear platform. The lacing architectures discussed include use of lace guides that can be formed from tubular plastic, metal clip, fabric loops or channels, plastic clips, and open u-shaped channels, among other shapes and materials. In some examples, various different types of lacing guides can be mixed to perform specific lace routing functions within the lacing architecture.

The motorized lacing engine discussed below was developed from the ground up to provide a robust, serviceable, and inter-changeable component of an automated lacing footwear platform. The lacing engine includes unique design elements that enable retail-level final assembly into a modular footwear platform. The lacing engine design allows for the majority of the footwear assembly process to leverage known assembly technologies, with unique adaptions to standard assembly processes still being able to leverage current assembly resources.

In an example, the modular automated lacing footwear platform includes a mid-sole plate secured to the mid-sole for receiving a lacing engine. The design of the mid-sole plate allows a lacing engine to be dropped into the footwear platform as late as at a point of purchase. The mid-sole plate, and other aspects of the modular automated footwear platform, allow for different types of lacing engines to be used interchangeably. For example, the motorized lacing engine discussed below could be changed out for a human-powered lacing engine. Alternatively, a fully automatic motorized lacing engine with foot presence sensing or other optional features could be accommodated within the standard mid-sole plate.

Utilizing motorized or non-motorized centralized lacing engines to tighten athletic footwear presents some challenges in providing sufficient performance without sacrificing some amount of comfort. Lacing architectures discussed herein have been designed specifically for use with centralized lacing engines, and are designed to enable various footwear designs from casual to high-performance.

This initial overview is intended to introduce the subject matter of the present patent application. It is not intended to provide an exclusive or exhaustive explanation of the various inventions disclosed in the following more detailed description.

Automated Footwear Platform

The following discusses various components of the automated footwear platform including a motorized lacing engine, a mid-sole plate, and various other components of the platform. While much of this disclosure focuses on lacing architectures for use with a motorized lacing engine, the discussed designs are applicable to a human-powered lacing engine or other motorized lacing engines with additional or fewer capabilities. Accordingly, the term "automated" as used in "automated footwear platform" is not intended to only cover a system that operates without user input. Rather, the term "automated footwear platform" includes various electrically powered and human-power, automatically activated and human activated mechanisms for tightening a lacing or retention system of the footwear.

FIG. 1 is an exploded view illustration of components of a motorized lacing system for footwear, according to some example embodiments. The motorized lacing system 1 illustrated in FIG. 1 includes a lacing engine 10, a lid 20, an actuator 30, a mid-sole plate 40, a mid-sole 50, and an outsole 60. FIG. 1 illustrates the basic assembly sequence of components of an automated lacing footwear platform. The motorized lacing system 1 starts with the mid-sole plate 40 being secured within the mid-sole. Next, the actuator 30 is inserted into an opening in the lateral side of the mid-sole plate opposite to interface buttons that can be embedded in the outsole 60. Next, the lacing engine 10 is dropped into the mid-sole plate 40. In an example, the lacing system 1 is inserted under a continuous loop of lacing cable and the lacing cable is aligned with a spool in the lacing engine 10 (discussed below). Finally, the lid 20 is inserted into grooves in the mid-sole plate 40, secured into a closed position, and latched into a recess in the mid-sole plate 40. The lid 20 can capture the lacing engine 10 and can assist in maintaining alignment of a lacing cable during operation.

In an example, the footwear article or the motorized lacing system 1 includes or is configured to interface with one or more sensors that can monitor or determine a foot presence characteristic. Based on information from one or more foot presence sensors, the footwear including the motorized lacing system 1 can be configured to perform various functions. For example, a foot presence sensor can be configured to provide binary information about whether a foot is present or not present in the footwear. If a binary signal from the foot presence sensor indicates that a foot is present, then the motorized lacing system 1 can be activated, such as to automatically tighten or relax (i.e., loosen) a footwear lacing cable. In an example, the footwear article includes a processor circuit that can receive or interpret signals from a foot presence sensor. The processor circuit can optionally be embedded in or with the lacing engine 10, such as in a sole of the footwear article.

Lacing Architectures

Figure 2:
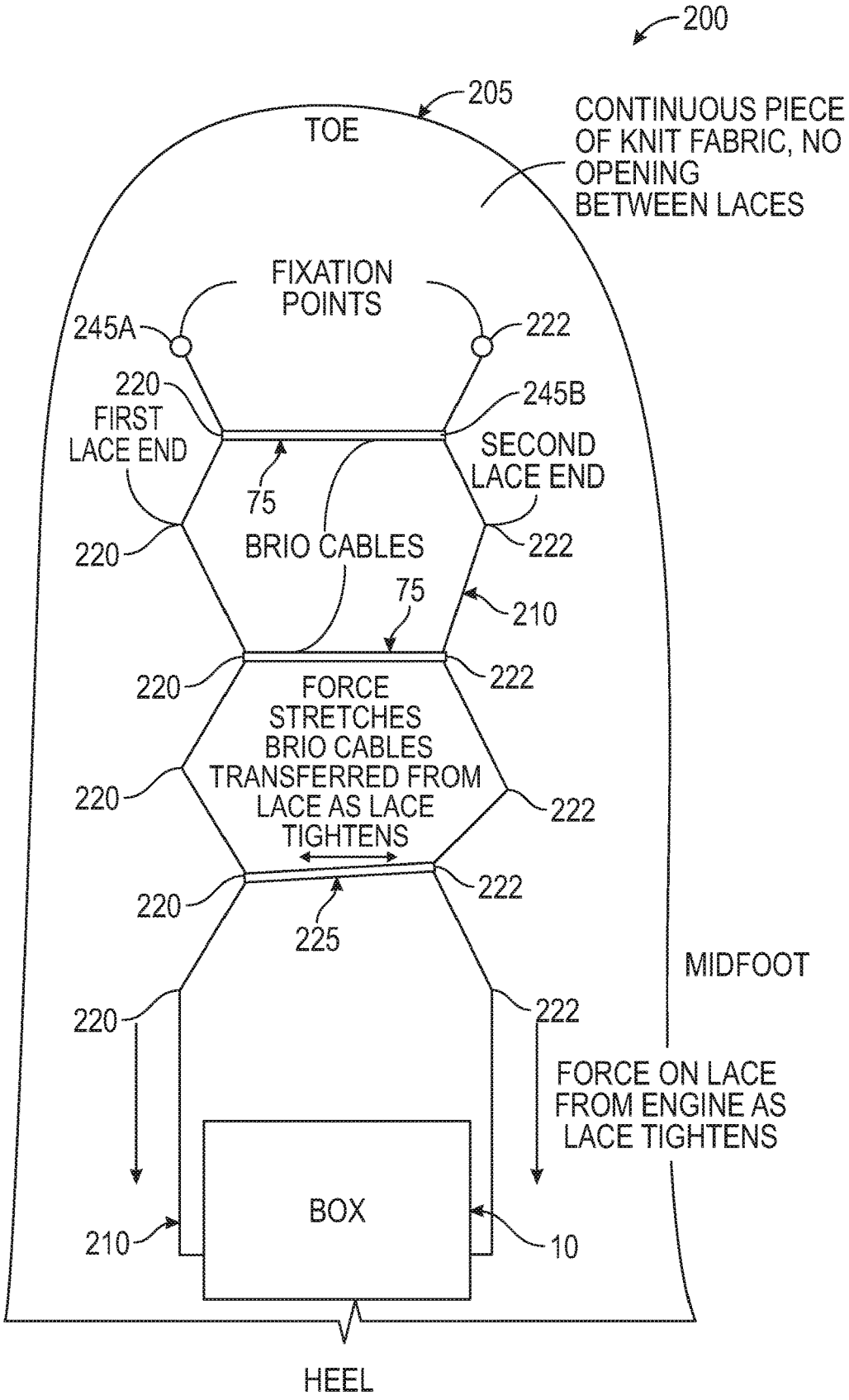
FIG. 2 is a top-view diagram illustrating a lacing architecture for use with footwear assemblies including a motorized lacing engine, according to some example embodiments.

FIG. 2 is a top view diagram of upper 200 illustrating an example lacing configuration, according to some example embodiments. In this example, the upper 205 includes lateral lace fixation 215, medial lace fixation 216, lateral lace guides 222, medial lace guides 220, and brio cables 225, in additional to lace 210 and lacing engine 10. The example illustrated in FIG. 2 includes a continuous knit fabric upper 205 with diagonal lacing pattern involving non-overlapping medial and lateral lacing paths. The lacing paths are created starting at the lateral lace fixation 215 running through the lateral lace guides 222 through the lacing engine 10 up through the medial lace guides 220 back to the medial lace fixation 216. In this example, lace 210 forms a continuous loop from lateral lace fixation 215 to medial lace fixation 216. Medial to lateral tightening is transmitted through brio cables 225 in this example. In other examples, the lacing path may crisscross or incorporate additional features to transmit tightening forces in a medial-lateral direction across the upper 205. Additionally, the continuous lace loop concept can be incorporated into a more traditional upper with a central (medial) gap and lace 210 crisscrossing back and forth across the central gap.

Figure 3A:
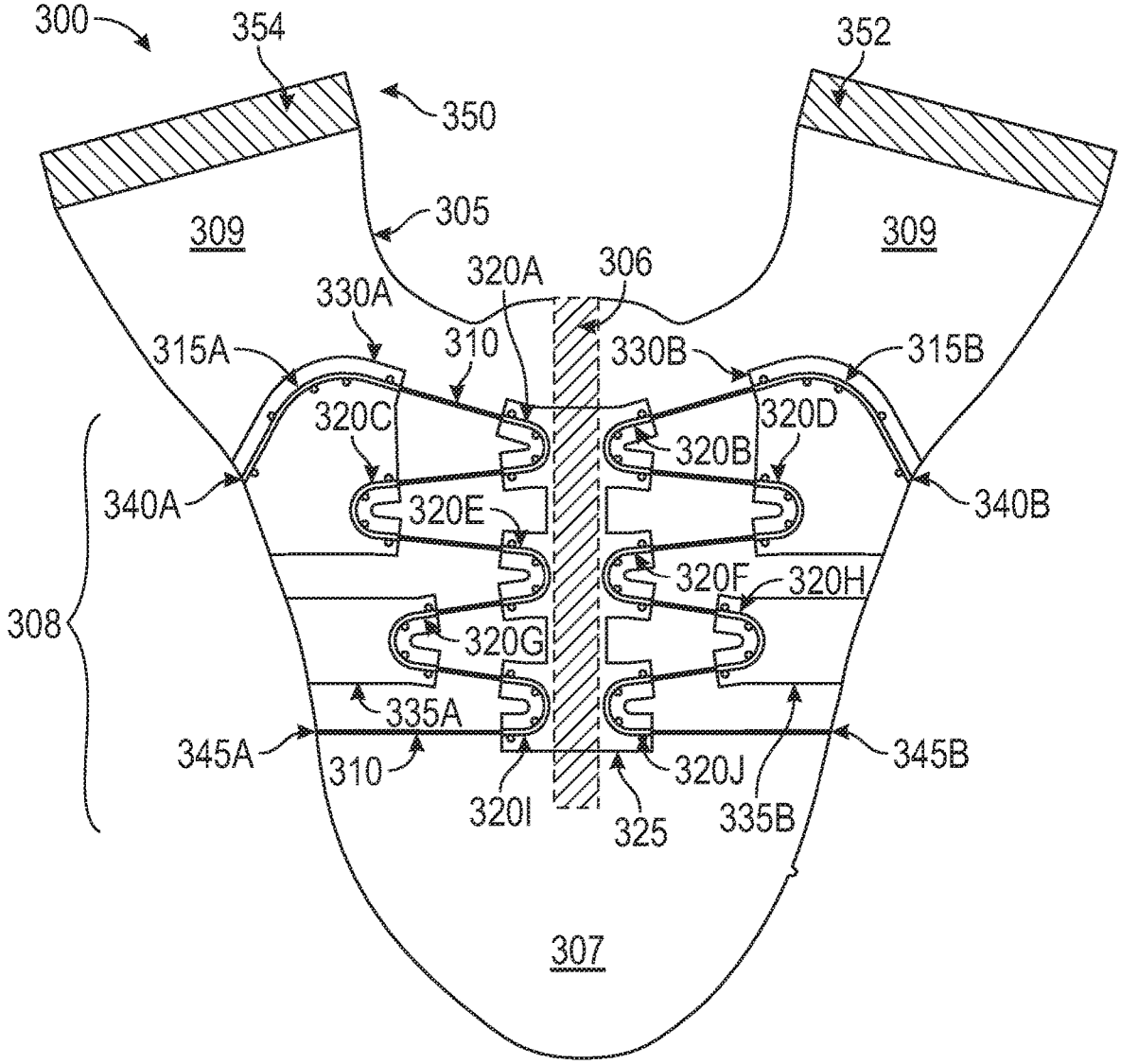
FIGS. 3A-3C are top-view diagrams illustrating a flattened footwear upper with a lacing architecture for use in footwear assemblies including a motorized lacing engine, according to some example embodiments.
Figure 3B:
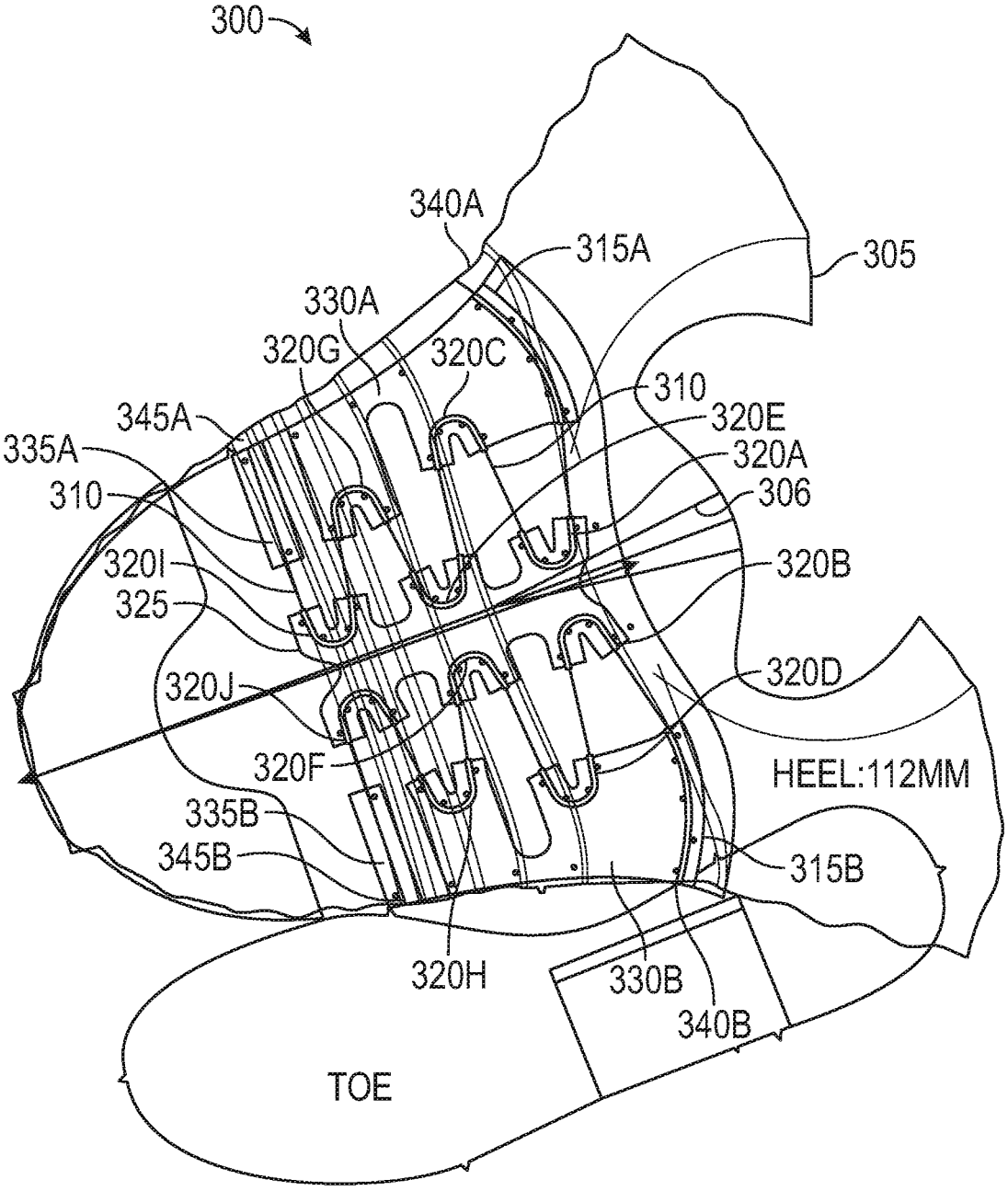
Figure 3C:
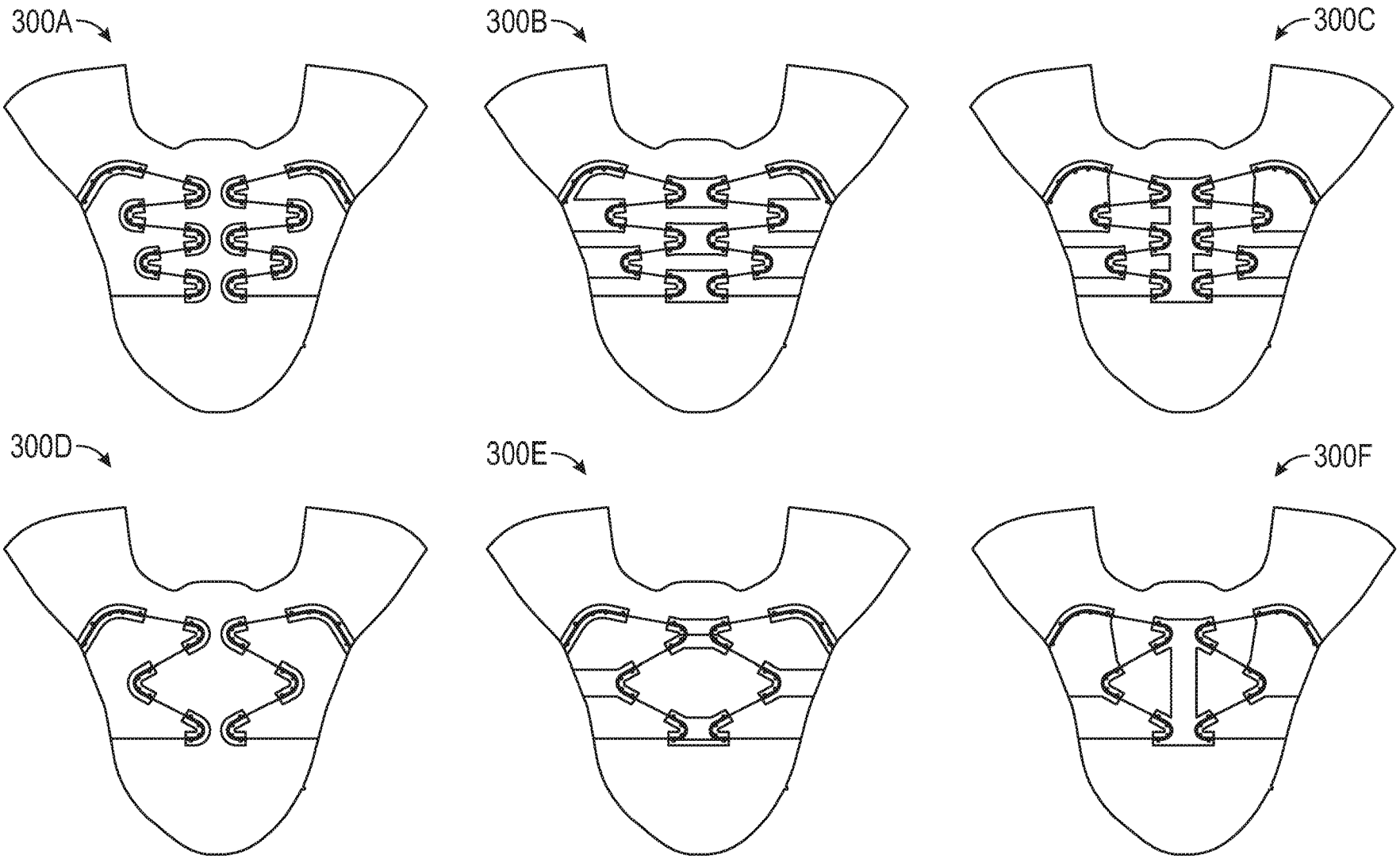

FIGS. 3A-3C are top-view diagrams illustrating a flattened footwear upper 305 with a lacing architecture 300 for use in footwear assemblies including a motorized lacing engine, according to some example embodiments. For the purposes of discussing example footwear uppers, the upper 305 is assumed to be designed for incorporation into a right foot version of a footwear assembly. FIG. 3A is a top-view diagram of a flattened footwear upper 305 with a lacing architecture 300 as illustrated. In this example, footwear upper 305 includes a series of lace guides 320A-320J (collectively referred to as lace guide(s) 320) with a lace cable 310 running through the lace guides 320. The lace cable 310, in this example, forms a loop that is terminated on each side of the upper 305 at a lateral lace fixation 345A and a medial lace fixation 345B (collectively referred to as lace fixation points 345) with the middle portion of the loop routed through a lacing engine within a mid-sole of the footwear assembly. The upper 305 also includes reinforcements associated with each of the series of lace guides 320. The reinforcements can cover individual lace guides or span multiple lace guides. In this example, the reinforcements include a central reinforcement 325, a first lateral reinforcement 335A, a first medial reinforcement 335B, a second lateral reinforcement 330A, a second medial reinforcement 330B. The middle portion of the lace cable 310 is routed to and/or from the lacing engine via a lateral rear lace guide 315A and a medial rear lace guide 315B, and exits and/or enters the upper 300 through a lateral lace exit 340A and a medial lace exit 340B.

The upper 305 can include different portions, such as a forefoot (toe) portion 307, a mid-foot portion 308, and a heel portion 309. The forefoot portion 307 corresponding with joints connecting metatarsal bones with phalanx bones of a foot. The mid-foot point 308 may correspond with an arch area of the foot. The heel portion 309 may correspond with the rear or heel portions of the foot. Medial and lateral heel portions 309 can be connected via heel member 350, which may comprise medial strip 352 and lateral strip 354. The medial and lateral sides of the mid-foot portion of the upper 305 can include a central portion 306. In some common footwear designs the central portion 306 can include an opening spanned by crisscrossing (or similar) pattern of laces that allows for the fit of the footwear upper around the foot to be adjusted. A central portion 306 including an opening also facilitates entry and removal of the foot from the footwear assembly.

The lace guides 320 are tubular or channel structures to retain the lace cable 310, while routing the lace cable 310 through a pattern along each of a lateral side and a medial side of the upper 305. In this example, the lace guides 320 are u-shaped plastic tubes laid out in an essentially sinusoidal wave pattern, which cycles up and down along the medial and lateral sides of the upper 305. The number of cycles completed by the lace cable 310 may vary depending on shoe size. Smaller sized footwear assemblies may only be able to accommodate one and one half cycles, with the example upper 305 accommodating two and one half cycles before entering the medial rear lace guide 315B or the lateral rear lace guide 315A. The pattern is described as essentially sinusoidal, as in this example at least, the u-shape guides have a wider profile than a true sine wave crest or trough. In other examples, a pattern more closely approximating a true sine wave pattern could be utilized (without extensive use of carefully curved lace guides, a true sine wave is not easily attained with a lace stretched between lace guides). The shape of the lace guides 320 can be varied to generate different torque versus lace displacement curves, where torque is measured at the lacing engine in the mid-sole of the shoe. Using lace guides with tighter radius curves, or including a higher frequency of wave pattern (e.g., greater number of cycles with more lace guides), can result in a change to the torque versus lace displacement curve. For example, with tighter radius lace guides the lace cable experiences higher friction, which can result in a higher initial torque, which may appear to smooth out the torque out over the torque versus lace displacement curve. However, in certain implementations it may be more desirable to maintain a low initial torque level (e.g., by keep friction within the lace guides low) while utilizing lace guide placement pattern or lace guide design to assist in smoothing the torque versus lace displacement curve. One such lace guide design is discussed in reference to FIGS. 7A and 7B, with another alternative lace guide design discussed in reference to FIGS. 8A through 8G. In addition to the lace guides discussed in reference to these figures, lace guides can be fabricated from plastics, polymers, metal, or fabric. For example, layers of fabric can be used to create a shaped channel to route a lace cable in a desired pattern. As discussed below, combinations of plastic or metal guides and fabric overlays can be used to generate guide components for use in the discussed lacing architectures.

Returning to FIG. 3A, the reinforcements 325, 335, and 330 are illustrated associated with different lace guides, such as lace guides 320. In an example, the reinforcements 335 can include fabric impregnated with a heat activated adhesive that can be adhered over the top of lace guides 320G, 320H, a process sometimes referred to as hot melt. The reinforcements can cover a number of lace guides, such as reinforcement 325, which in this example covers six upper lace guides positioned adjacent to a central portion of the footwear, such as central portion 306. In another example, the reinforcement 325 could be split down the middle of the central portion 306 to form two pieces covering lace guides along a medial side of the central portion 306 separately from lace guides along a lateral side of the central portion 306. In yet another alternative example, the reinforcement 325 could be split into six separate reinforcements covering individual lace guides. Use of reinforcements can vary to change the dynamics of interaction between the lace guides and the underlying footwear upper, such as upper 305. Reinforcements can also be adhered to the upper 305 in various other manners, including sewing, adhesives, or a combination of mechanisms. The manner of adhering the reinforcement in conjunction with the type of fabric or materials used for the reinforcements can also impact the friction experienced by the lace cable running through the lace guides. For example, a more rigid material hot melted over otherwise flexible lace guides can increase the friction experienced by the lace cable. In contrast, a flexible material adhered over the lace guides may reduce friction by maintaining more of the lace guide flexibility. Reinforcement 325 could also comprise an elastic mesh to cover a throat area of the footwear upper.

As mentioned above, FIG. 3A illustrates a central reinforcement 325 that is a single member spanning the medial and lateral upper lace guides (320A, 320B, 320E, 320F, 320I, and 320J). Assuming reinforcement 325 is more rigid material with less flexibility than the underlying footwear upper, upper 305 in this example, the resulting central portion 306 of the footwear assembly will exhibit less forgiving fit characteristics. In some applications, a more rigid, less forgiving, central portion 306 may be desirable. However, in applications where more flexibility across the central portion 306 is desired, the central reinforcement 325 can be separated into two or more reinforcements. In certain applications, separated central reinforcements can be coupled across the central portion 306 using a variety of flexible or elastic materials to enable a more form fitting central portion 306. In another example, central reinforcement 325 can itself be elastic. In some examples, the upper 305 can have a small gap running the length of the central portion 306 with one or more elastic members spanning the gap and connecting multiple central reinforcements, such as is at least partially illustrated in FIG. 4A with lace guide 410 and elastic member 440.

Heel member 350 can comprise a device or component that can be used to control access to footwear upper 305 and, additionally or alternatively, control the effective spring stiffness of footwear upper 305. In an example, medial strip 352 and lateral strip 354 can comprise elastic strops that are sewn or otherwise attached to medial and lateral heel portions 309, respectively, and are sewn to each other. In other embodiments, only a single elastic strip is connected to medial and lateral heel portions 309. Thus, strips 352 and 354 can provide a degree of stretchability to the heel portion of footwear upper 305. This effect can be used to provide various comfort and performance aspects to upper 305 as described below. For example, the elasticity can help heel portions 309 remain engaged with the heel of a wearer during use of the article of footwear. Strips 352 and 354 can comprise elastic, spandex, rubber or the like.

In another embodiment, medial strip 352 and lateral strip 354 can comprise components that are releasably engaged so that a user of the article of footwear can selectively open and close footwear upper 305. For example, strips 352 and 354 can comprise opposing components of hook and loop fastener material, or opposing components of a zipper structure. In such embodiments, heel member 350 can provide ingress and egress of a foot into footwear upper 305 regardless of the state of lace cable 310. More specifically, heel member 350 can permit a foot to be withdrawn from footwear upper 305 even if the lacing engine has drawn lace cable 310 into the sole structure to cinch lace cable 310 down onto footwear upper 305.

FIG. 3B is another top-view diagram of the flattened footwear upper 305 with a lacing architecture 300 as illustrated. In this example, footwear upper 305 includes a similar lace guide pattern including lace guides 320 with modifications to the configuration of reinforcements 325, 330, and 335. As discussed above, the modifications to the reinforcements configuration will result in at least slightly different fit characteristics and may also change the torque versus lace displacement curve.

FIG. 3C is a series of lacing architecture examples illustrated on flattened footwear uppers according to example embodiments. Lace architecture 300A illustrates a lace guide pattern similar to the sine wave pattern discussed in reference to FIG. 3A with individual reinforcements covering each individual lace guide. Lace architecture 300B once again illustrates a wave lacing pattern, also referred to as parachute lacing, with elongated reinforcements covering upper lace guide pairs spanning across a central portion and individual lower lace guides. Lace architecture 300C is yet another wave lacing pattern with a single central reinforcement. Lace architecture 300D introduces a triangular shaped lace pattern with individual reinforcements cut to form fit over the individual lace guides. Lace architecture 300E illustrates a variation in reinforcement configuration in the triangular lace pattern. Finally, lace architecture 300F illustrates another variation in reinforcement configuration including a central reinforcement and consolidated lower reinforcements.

Figure 4A:
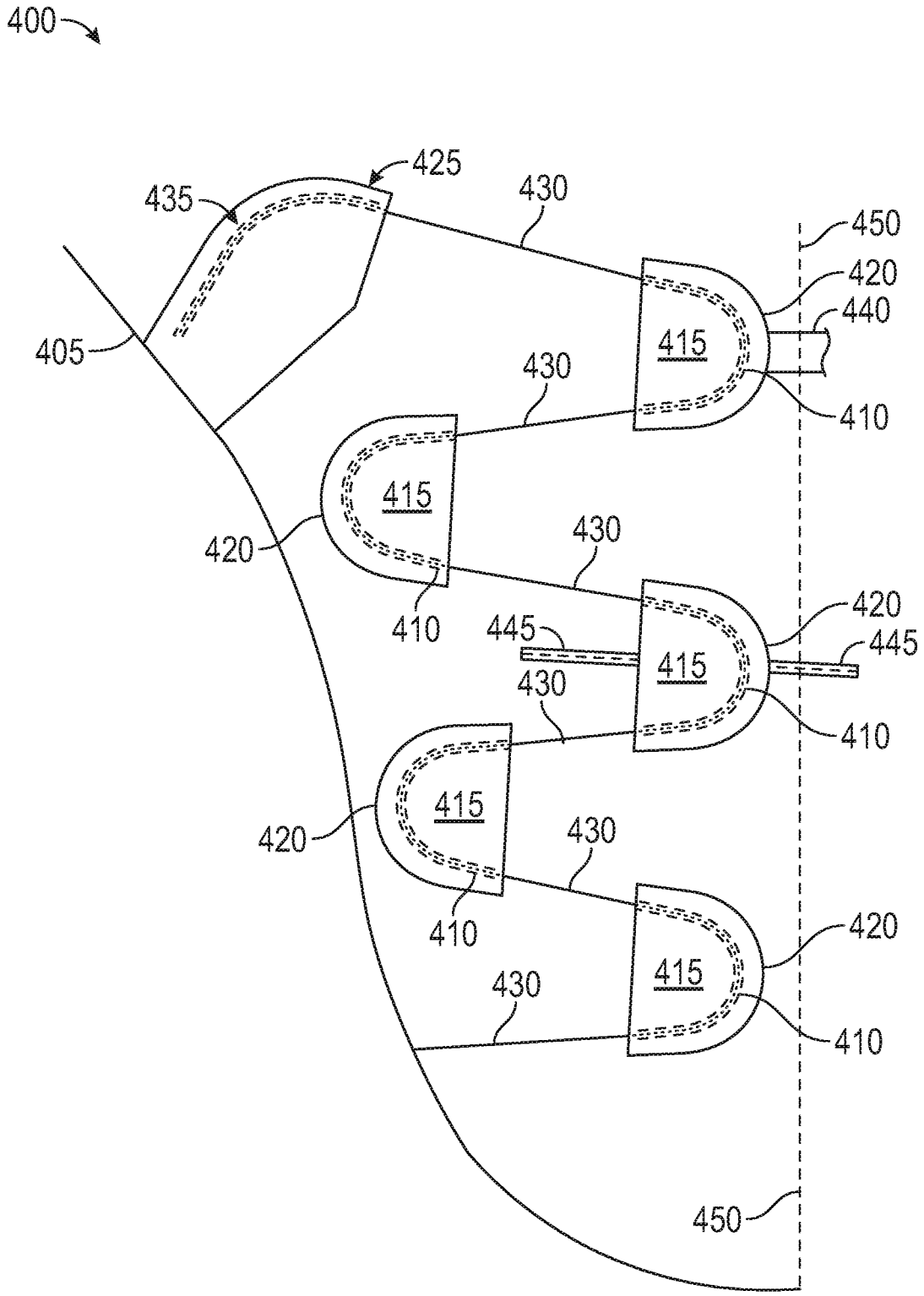
FIG. 4A is a diagram illustrating a portion of a footwear upper with a lacing architecture for use in footwear assemblies including a motorized lacing engine and heel and tongue access control components in the footwear upper, according to some example embodiments.

FIG. 4A is a diagram illustrating a portion of a footwear upper 405 with a lacing architecture 400 for use in footwear assemblies including a motorized lacing engine, according to some example embodiments. In this example, a medial portion of upper 405 is illustrated with lace guides 410 routing lace cable 430 through to medial exit guide 415. Lace guides 410 are encapsulated in reinforcements 420 to form lace guide components 415, with at least a portion of the lace guide components being repositionable on upper 405. In one example, the lace guide components 415 are backed with hook-n-loop material and the upper 405 provides a surface receptive to the hook-n-loop material. In this example, the lace guide components 415 can be backed with the hook portion with the upper 405 providing a knit loop surface to receive the lace guide components 415. In another example, lace guide components 415 can have a track interface integrated to engage with a track, such as track 445. A track-based integration can provide a secure, limited travel, movement option for lace guide components 415. For example, track 445 runs essentially perpendicular to the longitudinal axis of the central portion 450 and allows for positioning a lace guide component 415 along the length of the track. In some examples, the track 445 can span across from a lateral side to a medial side to hold a lace guide component on either side of central portion 450. Similar tracks can be positioned in appropriate places to hold all of the lace guide components 415, enabling adjustment in restrictions directions for all lace guides on footwear upper 405.

The footwear upper 405 illustrates another example lacing architecture including central elastic members, such as elastic member 440. In these examples, at least the upper lace guide components along the medial and lateral sides can be connected across the central portion 450 with elastic members that allow for different footwear designs to attain different levels of fit and performance. For example, a high performance basketball shoe that needs to secure a foot through a wide range of lateral movement may utilize elastic members with a high modulus of elasticity to ensure a snug fit. In another example, a running shoe may utilize elastic members with a low modulus of elasticity, as the running shoe may be designed to focus on comfort for long distance road running versus providing high levels of lateral motion containment. In certain examples, the elastic members 440 can be interchangeable or include a mechanism to allow for adjustment of the level of elasticity. As discussed above, in some examples the footwear upper, such as upper 405, can include a gap along central portion 450 at least partially separating a medial side from a lateral side. Even with a small gap along central portion 450 elastic members, such as elastic member 440, can be used to span the gap.

While FIG. 4A only illustrates a single track 445 or a single elastic member 440, these elements can be replicated for any or all of the lace guides in a particular lacing architecture. For example, each lace guide component 415 could be mounted to its own track 445 that extends generally in a medial-lateral direction across central portion 450. The position of each lace guide component 415 can be correlated to the presence of a foot within footwear upper 405. For example, if a presence sensor, such as a contact switch within a sole structure detects the weight of a foot in footwear upper 405, lace guide components 415 can be drawn closer to central portion 450 to take up slack in lace cable 430 to cinch footwear upper 405 down on the foot. However, if the presence sensors to not detect the weight of a foot within footwear upper 405, lace guide components 415 can be retracted away from central portion 450 to facilitate entry of a foot into footwear upper 405 by causing slack to be introduced in lace cable 430. In such embodiments, the drive mechanism of the lacing cable can be additionally used to move lace guide components 415 on tracks 445. In other embodiments, one or more additional drive mechanisms, e.g., motors, can be incorporated into the article of footwear. Furthermore, in such an embodiment, central reinforcement 325 can be added at central portion to provide an elastic zone or to, additionally or alternatively, provide an opening, such as a zipper (e.g., zipper 465), to footwear upper 405.

Figure 4B:
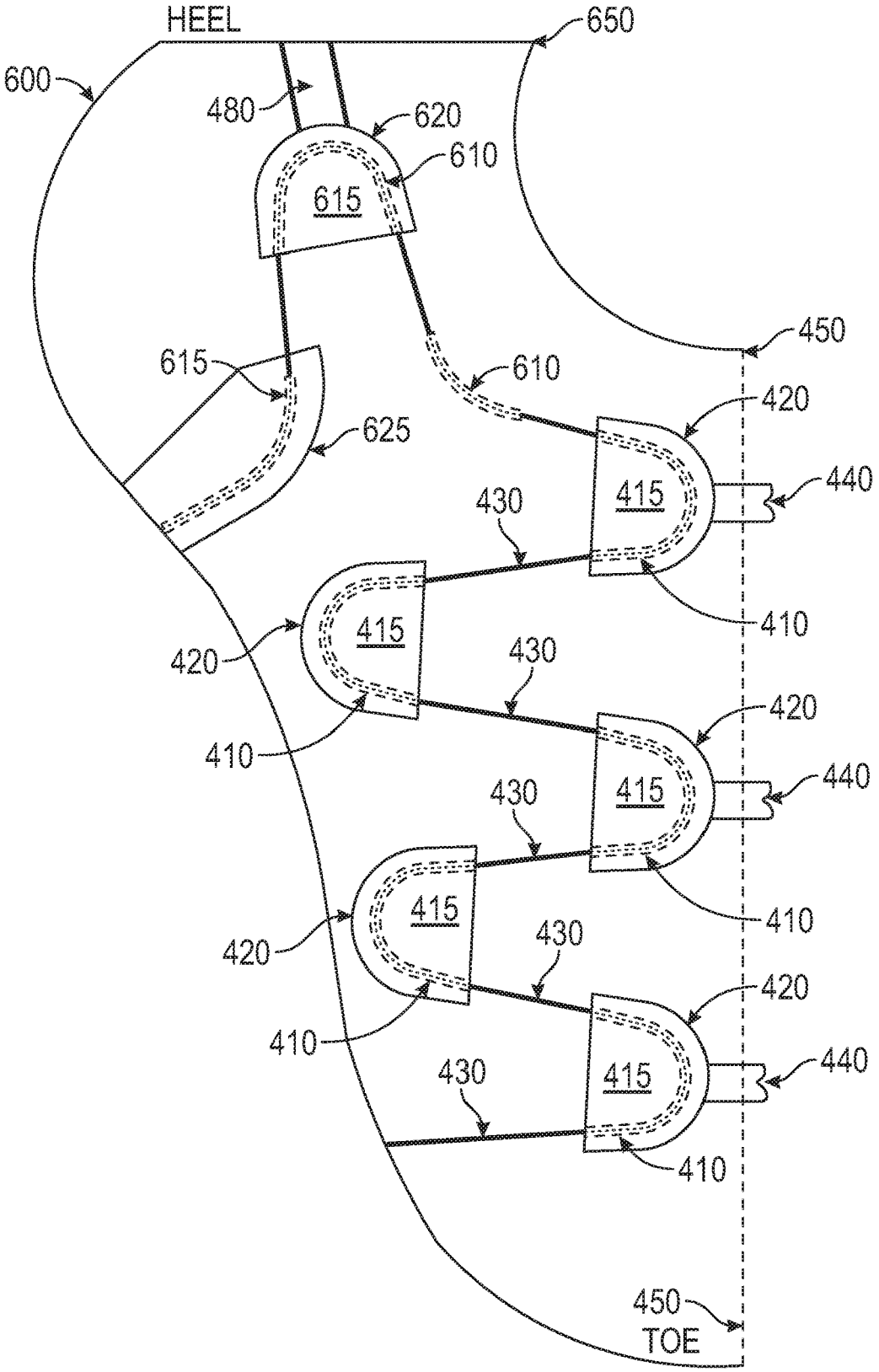
FIG. 4B is a diagram illustrating a portion of a footwear upper with a lacing architecture for use in footwear assemblies including heel and tongue elastic members connected to the lacing architecture.

FIG. 4B additionally shows heel strap 480 that spans heel ridge 650 and multiple elastic members 440 at lace guides 415. Heel strap 480 and elastic members 440 can be used to control the effective spring stiffness of footwear upper 405. As discussed above, elasticity provided by various strips, such as heel strap 480 and elastic members 440, can provide a degree of stretchability to footwear upper 405, thereby allowing various comfort and performance aspects of upper 405 to be controlled. In examples, heel strap 480 can be directly connected to a heel lacing component guide 615 on medial and lateral sides of heel ridge 650. Alternatively, heel strap 480 can be connected to lacing component guide 615 at one end and sewn into footwear upper 605 at heel ridge 650. In such an embodiment, a single heel strap 480 can be used on the medial or lateral side of footwear upper 605, or a heel strap 480 can be used on each of the medial and lateral sides of footwear upper 605. Heel lacing component guides 615 can be disconnected from footwear upper 405 such that they are suspended relative to footwear upper 405 by lace cable 430 and heel strap 480. Elastic member 440 can pre-tension heel lacing component guide 615 to the rear or heel portion of footwear upper 405 to cause lace cable 430 to be pulled out of a lacing engine in a loosened state. However, as the lacing engine winds lace cable 430 into a tightened state, heel strap 480 can stretch to allow lace cable 430 to be cinched down on footwear upper 405, and the heel portion of the footwear upper 405 to be drawn down on a heel of a wearer.

Elastic members 440 can provide an additional degree of stretchability to footwear upper 405. Elastic members 440 can be attached to lace guide components 415 at one end and at the other end be connected to either another opposite lace guide component 415 or footwear upper 405, such as at central portion 450. As with heel strap 480, elastic members 440 can be used to pull lace cable 430 from the lacing engine, but can be stretched to permit lace cable 430 to be cinched down on footwear upper 405.

Figure 17:
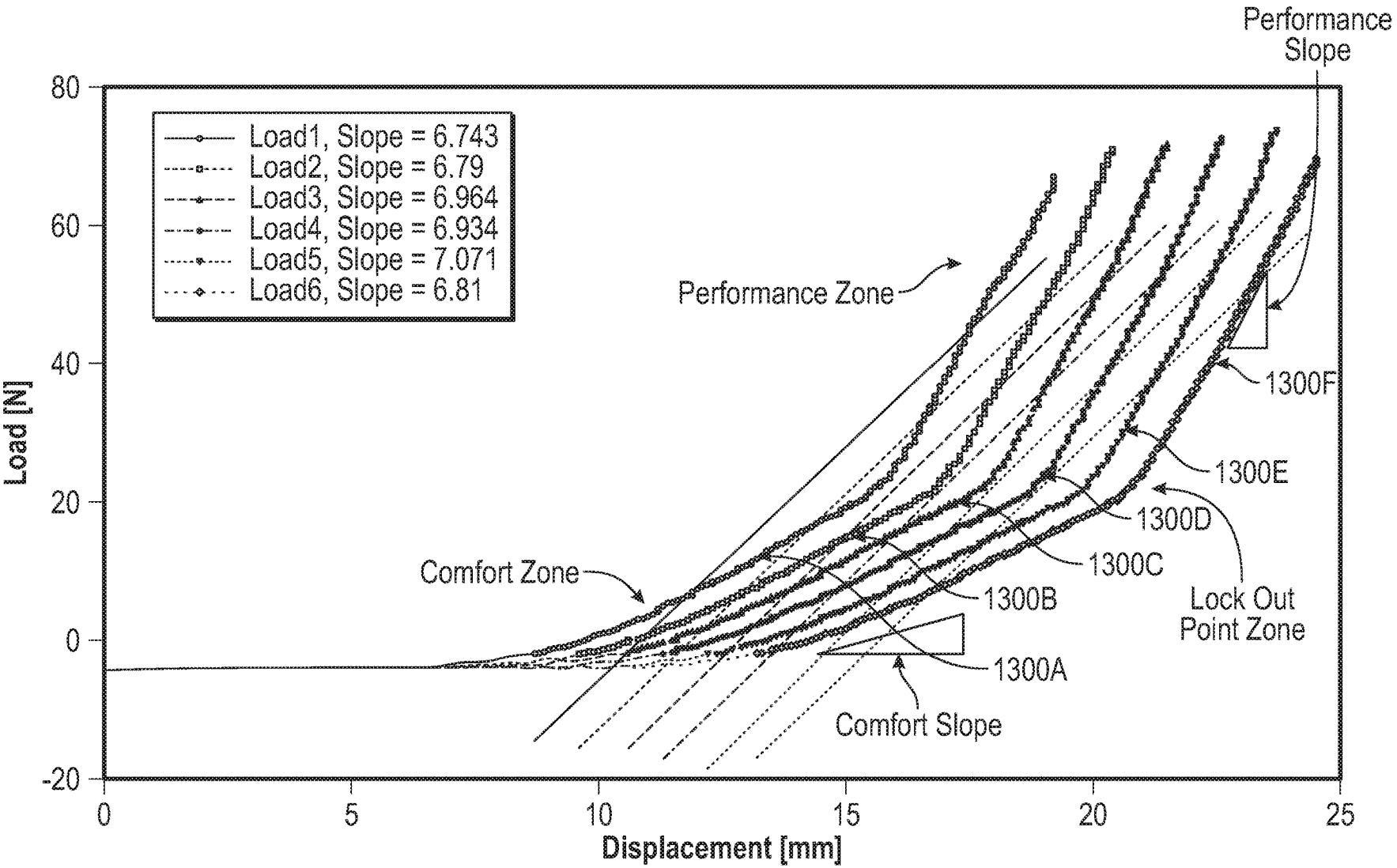
FIG. 17 is a graph illustrating various force versus lace displacement curves for shoe uppers including various elastic members described herein, according to some example embodiments.

Heel strap 480, elastic members 440 and an elastic central reinforcement 325 can each provide a degree of stretchability to a footwear upper that can introduce different comfort and performance zones within the lacing action provided by the lacing mechanism. FIG. 17 illustrates various comfort and performance curves of different example footwear uppers incorporating different combinations of lace cable 480, elastic members 440, an elastic heel member 350, and an elastic central reinforcement 325.

Figure 5:
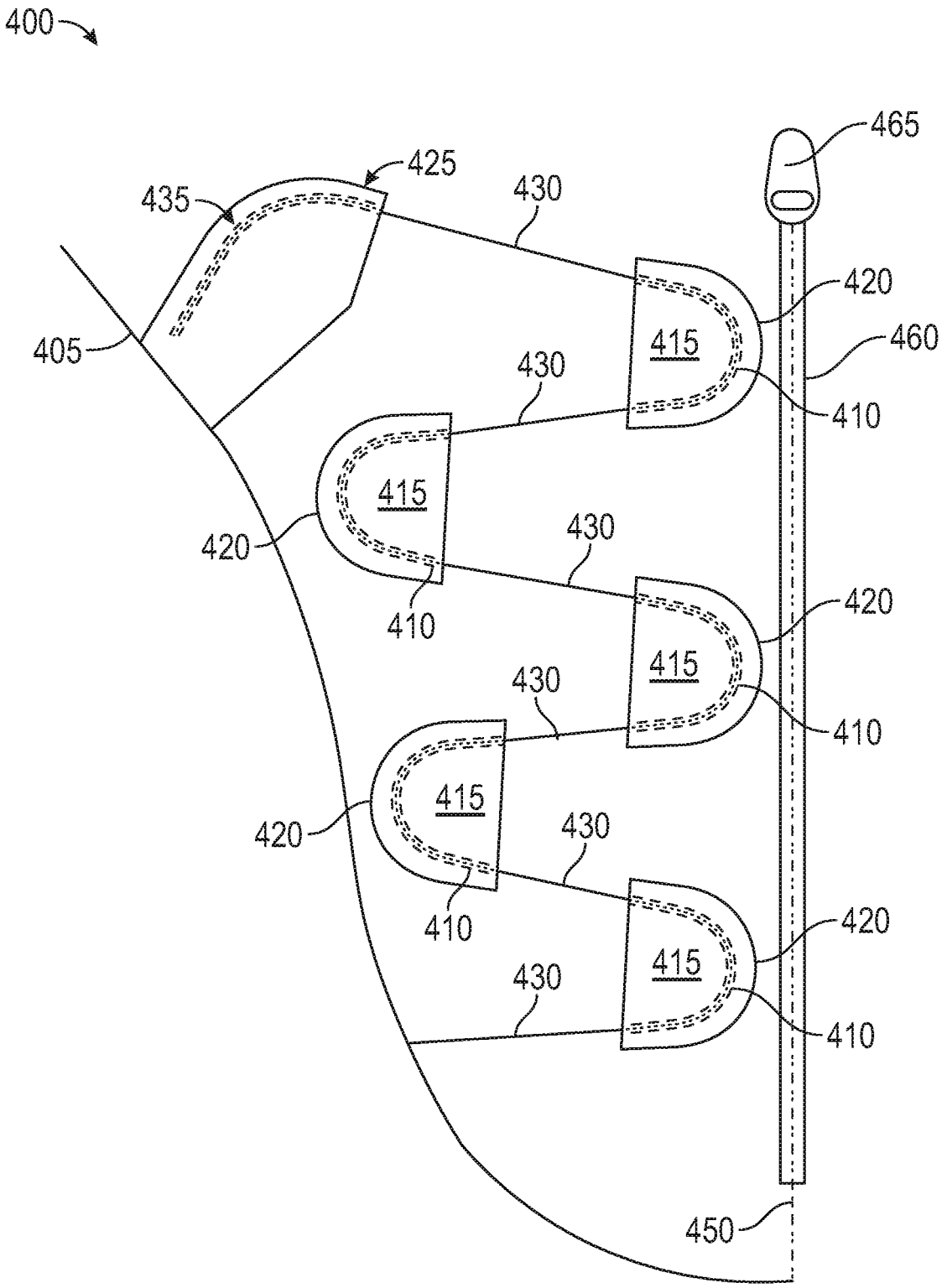
FIG. 5 is a diagram illustrating a portion of a footwear upper with a lacing architecture for use in footwear assemblies including a motorized lacing engine, according to some example embodiments.

FIG. 5 is a diagram illustrating a portion of footwear upper 405 with lacing architecture 400 for use in footwear assemblies including a motorized lacing engine, according to some example embodiments. In this example, the central portion 450 illustrated in FIG. 4A is replaced with a central closure mechanism 460, which is illustrated in this example as a central zipper 465. The central closure mechanism is designed to enable a wider opening in the footwear upper 405 for easy entry and exit. The central zipper 465 can be easily unzipped to enable foot entry or exit. In other examples, the central closure 460 can be hook and loop, snaps, clasps, toggles, secondary laces, or any similar closure mechanism.

Figure 6:
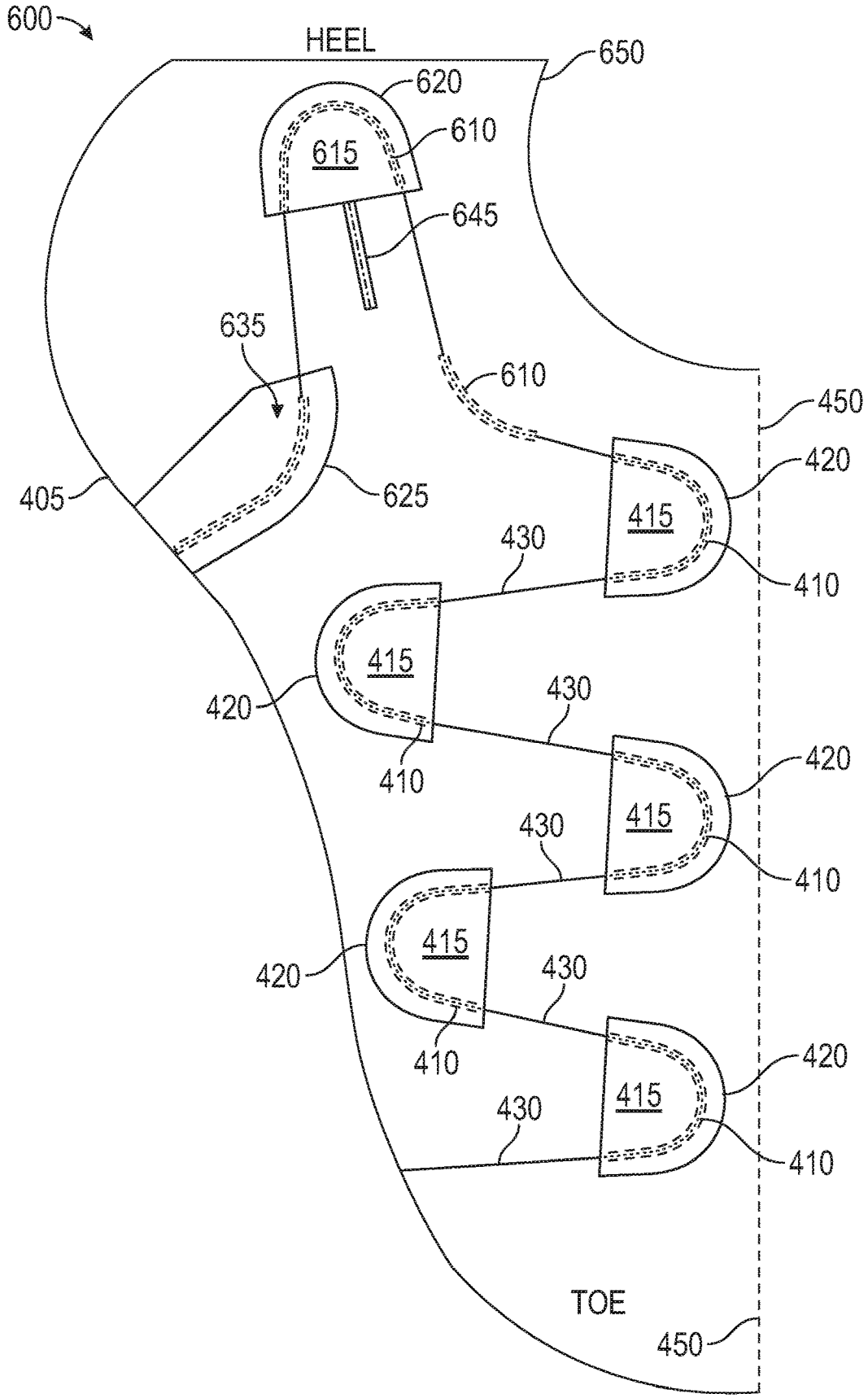
FIG. 6 is a diagram illustrating a portion of a footwear upper with a lacing architecture for use in footwear assemblies including a motorized lacing engine, according to some example embodiments.

FIG. 6 is a diagram illustrating a portion of footwear upper 405 with a lacing architecture 600 for use in footwear assemblies including a motorized lacing engine, according to some example embodiments. In this example, lacing architecture 600 adds a heel lacing component 615 including a heel lacing guide 610 and a heel reinforcement 620 as well as a heel redirect guide 610 and a heel exit guide 615. The heel redirect guide 610 shifts the lace cable 430 from exiting the last lace guide 410 towards a heel lacing component 615. The heel lacing component 615 is formed from a heel lacing guide 610 with a heel reinforcement 620. The heel lacing guide 610 is depicted with a similar shape to lacing guides used in other locations on upper 405. However, in other examples the heel lacing guide 610 can be other shapes or include multiple lace guides. In this example, the heel lace component 615 is shown mounted on a heel track 645 allowing for adjustability of the location of the heel lace component 615. Similar to the adjustable lace guides discussed above, other mechanisms can be utilized to enable adjustment in positioning of the heel lace component 615, such as hook and loop fasteners or comparable fastening mechanisms.

In some examples, the upper 405 includes a heel ridge 650, which like the central portion 450 discussed above can include a closure mechanism. In examples with a heel closure mechanism, the heel closure mechanism is designed to provide easy entry and exit from the footwear by expanding a traditional footwear assembly foot opening. Additionally, in some examples, the heel lacing component 615 can be connected across the heel ridge 650 (with or without a heel closure mechanism) to a matching heel lacing component on the opposite side. The connection can include an elastic member, similar to elastic member 440.

Figure 7A:
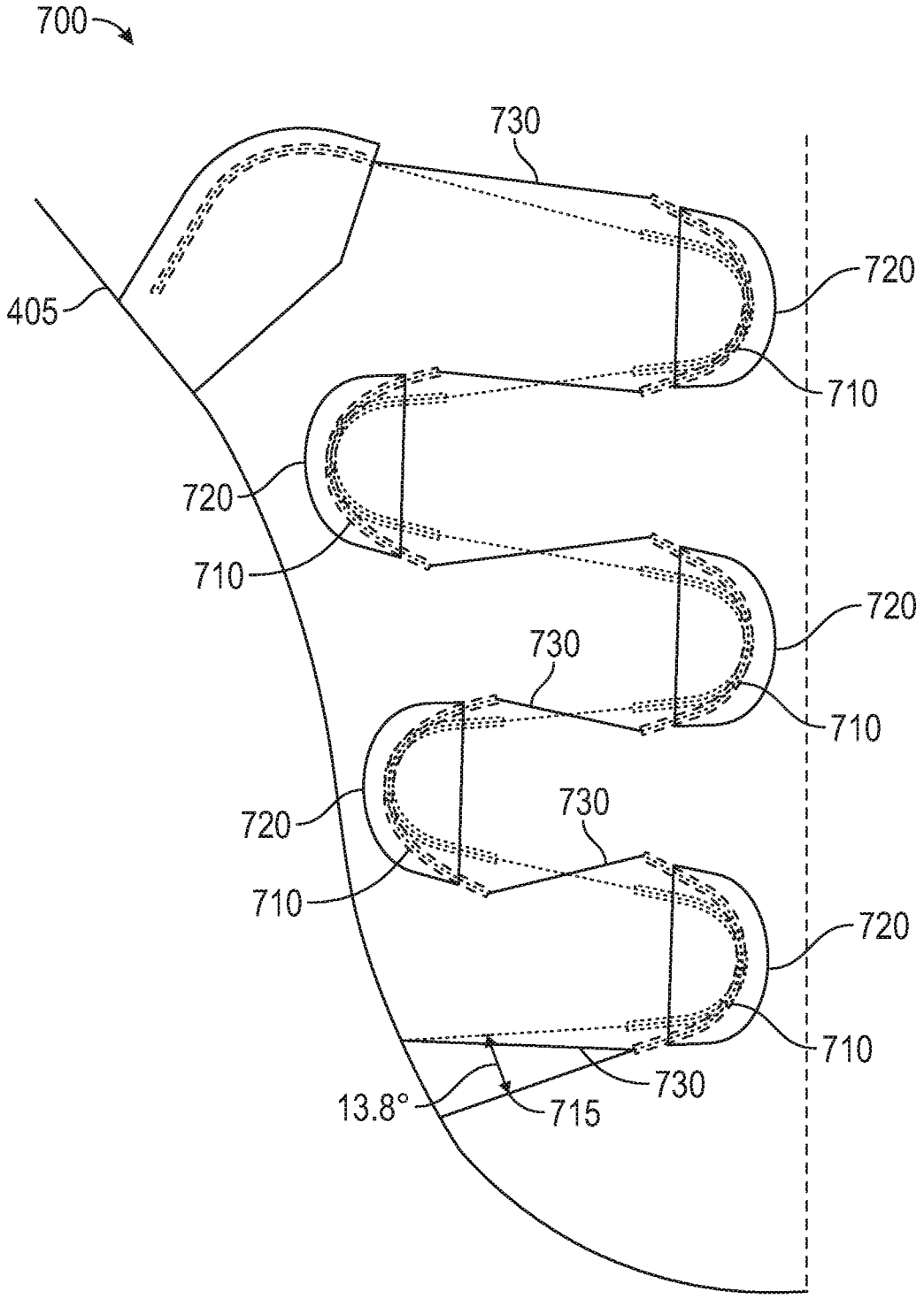
FIGS. 7A-7B are diagrams illustrating a portion of a footwear upper with a lacing architecture for use in footwear assemblies including a motorized lacing engine, according to some example embodiments.
Figure 7B:
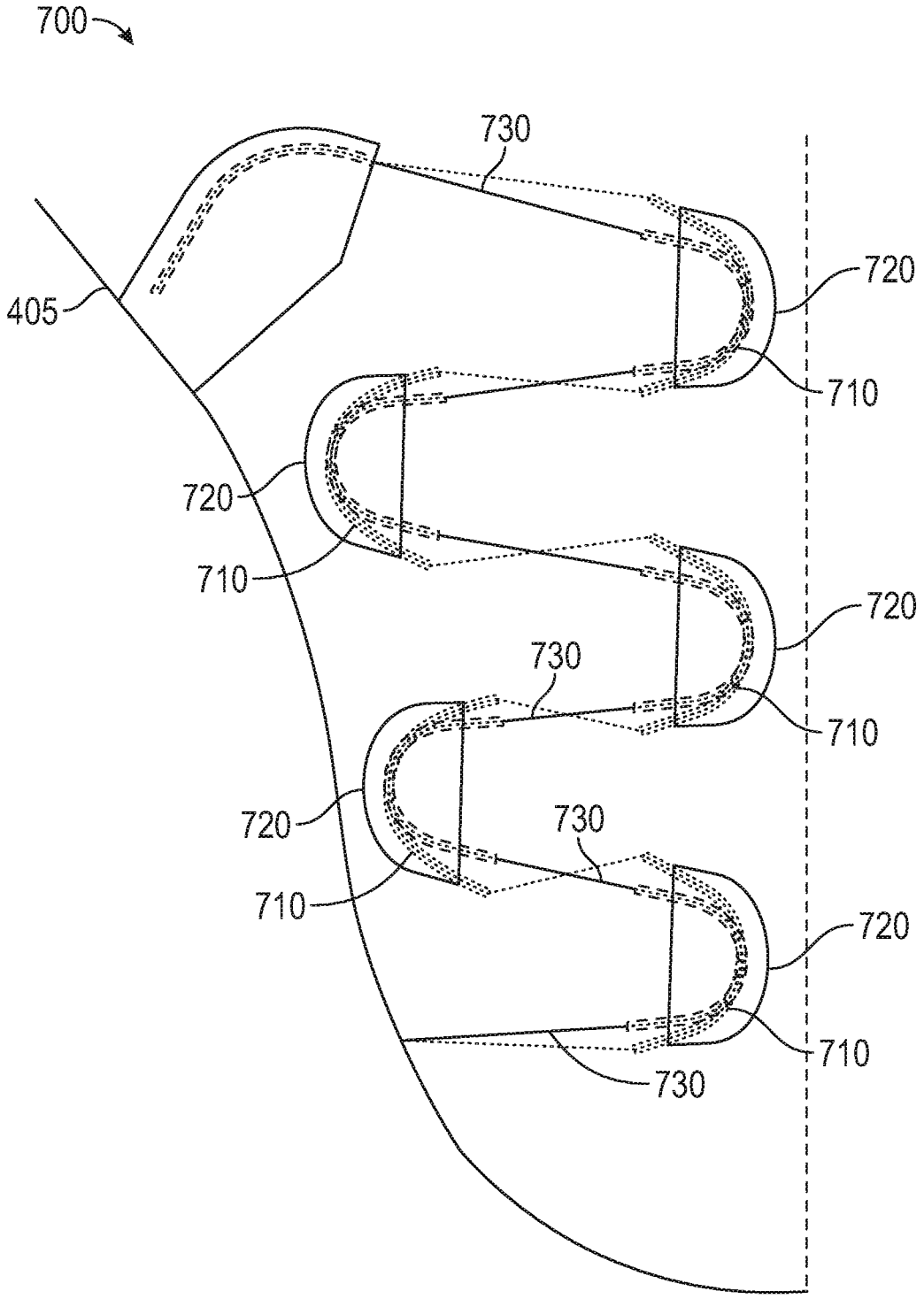

FIG. 7A-7B are diagrams illustrating a portion of footwear upper 405 with a lacing architecture 700 for use in footwear assemblies including a motorized lacing engine, according to some example embodiments. In this example, the lacing architecture 700 includes lace guides 710 for routing lace 730. The lace guides 710 can include associated reinforcements 720. In this example, the lace guides 710 are configured to allow for flexing of portions of the lace guides 710 from an open initial position illustrated in FIG. 7A to a flexed closed position illustrated in FIG. 7B (with phantom lines illustrating the opposition positions in each figure for reference). In this example, the lace guides 710 include extension portions that exhibit flex of approximately 14 degrees between the open initial position and the closed position. Other examples, can exhibit more or less flex between an initial and final position (or shape) of the lace guide 710. The flexing of the lace guides 710 occurs as the lace 730 is tightened. The flexing of the lace guides 710 works to smooth out the torque versus lace displacement curve by applying some initial tension to the lace 730 and providing an additional mechanism to dissipate lace tension during the tightening process. Accordingly, in an initial shape or flex position, lace guide 710 creates some initial tension in the lace cable, which also functions to take up slack in the lace cable. When tightening of the lace cable begins, the lace guide 710 flexes or deforms The lace guides 710, in this example, are plastic or polymer tubes and can have different modulus of elasticity depending upon the particular composition of the tubes. The modulus of elasticity of the lace guides 710 along with the configuration of the reinforcements 720 will control the amount of additional tension induced in the lace 730 by flexing of the lace guides 710. The elastic deformation of the ends (legs or extensions) of the lace guides 710 induces a continued tension on the lace 730 as the lace guides 710 attempt to return to original shape. In some examples, the entire lace guide flexes uniformly over the length of the lace guide. In other examples, the flex occurs primarily within the u-shaped portion of the lace guide with the extensions remaining substantially straight. In yet other examples, the extensions accommodate most of the flex with the u-shaped portion remaining relatively fixed.

The reinforcements 720 are adhered over the lace guides 710 in a manner that allows for movement of the ends of the lace guides 710. In some examples, reinforcements 720 are adhered through the hot melt process discussed above, with the placement of the heat activated adhesive allowing for an opening to enable flex in the lace guides 710. In other embodiments, the reinforcements 720 can be sewed into place or use a combination of adhesives and stitching. How the reinforcements 720 are adhered or structured can affect what portion of the lace guide flexes under load from the lace cable. In some examples, the hot melt is concentrated around the u-shaped portion of the lace guide leaving the extensions (legs) more free to flex.

Figure 7C:
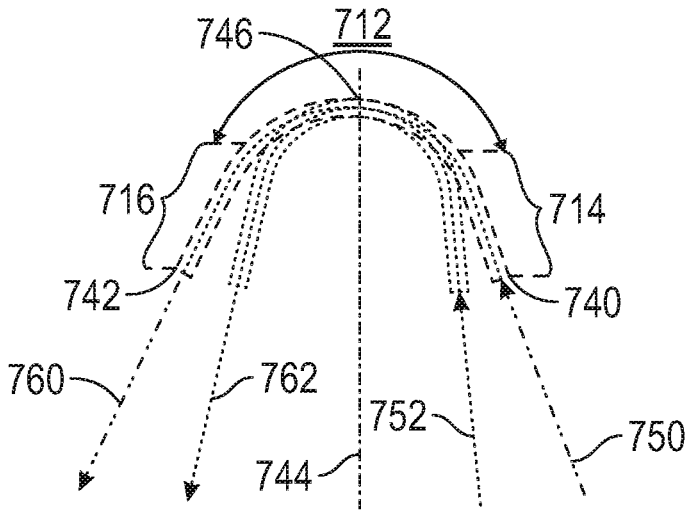
FIGS. 7C-7D are diagrams illustrating deformable lace guides for use in footwear assemblies, according to some example embodiments.
Figure 7D:
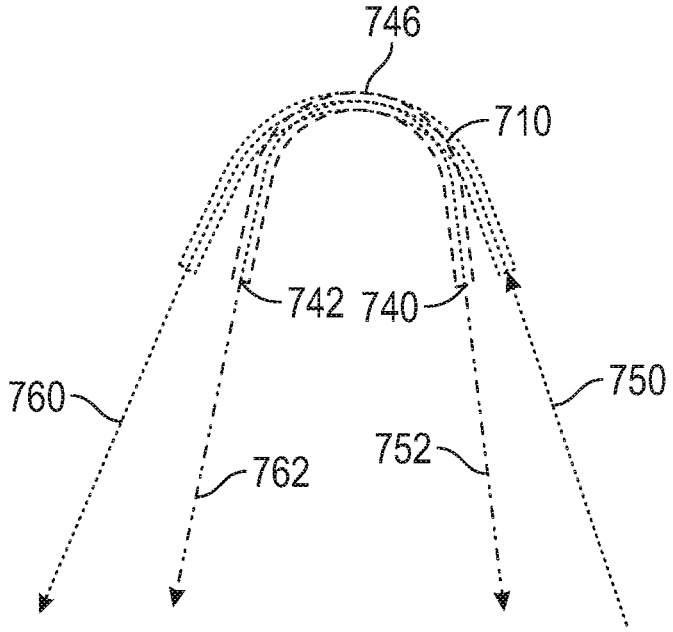

FIGS. 7C-7D are diagrams illustrating deformable lace guides 710 for use in footwear assemblies, according to some example embodiments. In this example, lace guides 710 introduced above in reference to FIGS. 7A and 7B are discussed in additional detail. FIG. 7C illustrates the lace guide 710 in a first (open) state, which can be considered a non-deformed state. FIG. 7D illustrates the lace guide 710 in a second (closed/flexed) state, which can be considered a deformed state. The lace guide 710 can include three different sections, such as a middle section 712, a first extension 714, and a second extension 716. The lace guide 710 can also include a lace reception opening 740 and a lace exit opening 742. As mentioned above, lace guide 710 can have different modulus of elasticity, which controls the level of deformation with a certain applied tension. In some examples, the lace guide 710 can be constructed with different sections having different modulus of elasticity, such as the middle section 712 having a first modulus of elasticity, the first extension having a second modulus of elasticity and the second extension having a third modulus of elasticity. In certain examples, the second and third moduli of elasticity can be substantially similar, resulting in the first extension and the second extension flexing or deforming in a similar manner. In this example, substantially similar can be interpreted as the moduli of elasticity being within a few percentage points of each other. In some examples, the lace guide 710 can have a variable modulus of elasticity shifting from a high modulus at the apex 746 to a low modulus towards the outer ends of the first extension and the second extension. In these examples, the modulus can vary based on wall thickness of the lace guide 710.

The lace guide 710 defines a number of axes useful is describing how the deformable lace guide functions. For example, the first extension 714 can define an first incoming lace axis 750, which aligns with at least an outer portion of an inner channel defined within the first extension 714. The second extension 716 defines an first outgoing lace axis 760, which aligns with at least an outer portion of an inner channel defined within the second extension 716. Upon deformation, the lace guide 710 defines a second incoming lace axis 752 and a second outgoing lace axis 762, which are each aligned with respective portions of the first extension and the second extension. The lace guide 710 also includes a medial axis 744 that intersects the lace guide 710 at the apex 746 and is equidistant from the first extension and the second extension (assuming a symmetrical lace guide in a non-deformed state as illustrated in FIG. 7C).

Figure 7E:
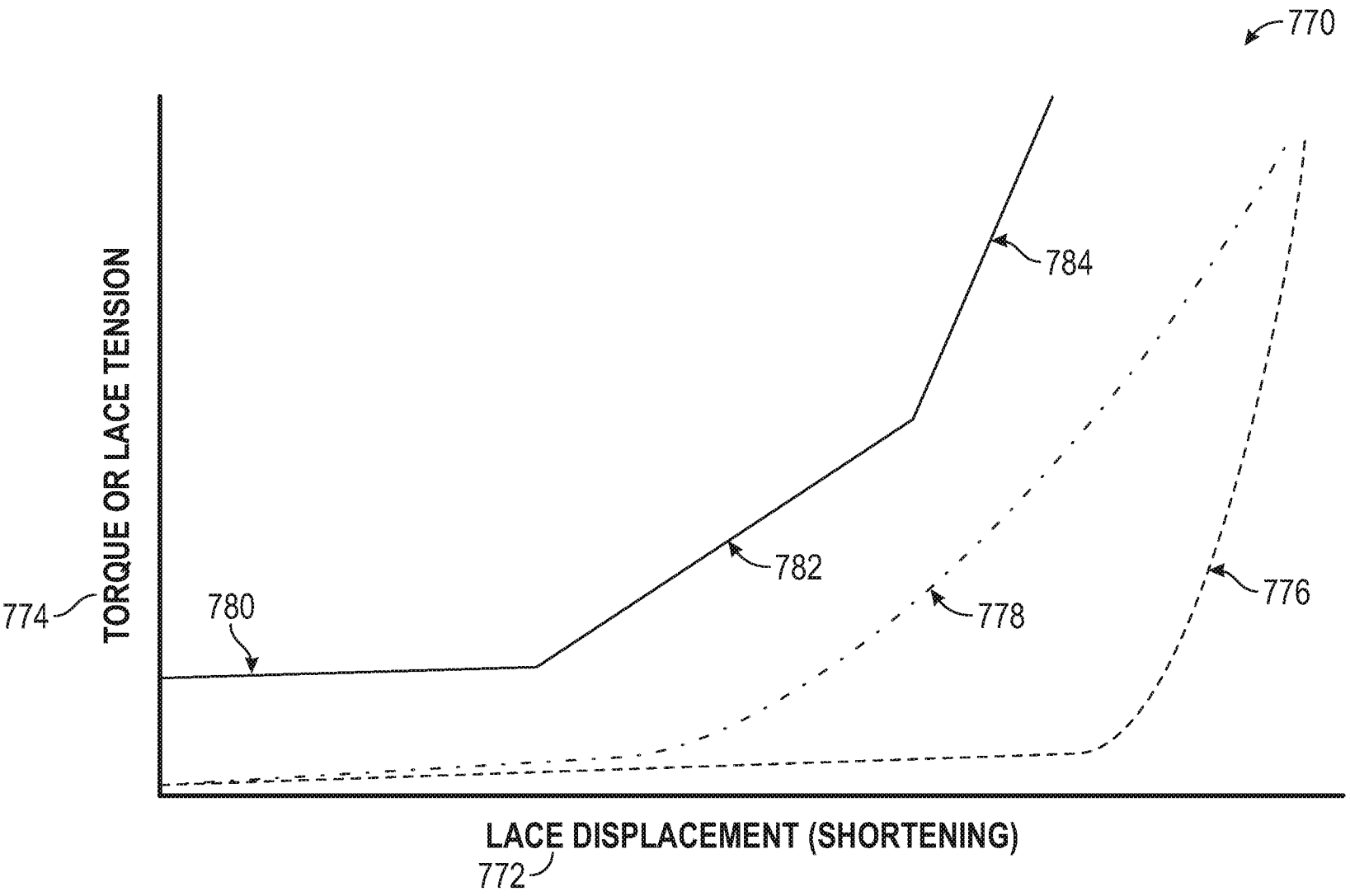
FIG. 7E is a graph illustrating various torque versus lace displacement curves for deformable lace guides, according to some example embodiments.

FIG. 7E is a graph 770 illustrating various torque versus lace displacement curves for deformable lace guides, according to some example embodiments. As discussed above, one of the benefits achieved using lace guides 710 involves modifying torque (or lace tension) versus lace displacement (or shortening) curves. Curve 776 illustrates a torque versus displacement curve for a non-deformable lace guide used in an example lacing architecture. The curve 776 illustrates how laces experience a rapid increase in tension over a short displacement near the end of the tightening process. In contrast, curve 778 illustrates a torque versus displacement curve for a first deformable lace guide used in an example lacing architecture. The cure 778 begins in a fashion similar to curve 776, but as the lace guides deform with additional lace tension the curve is flattened, resulting in tension increasing over a larger lace displacement. Flattening out the curves allows for more control of fit and performance of the footwear for the end users.

The final example is split into three segments, an initial tightening segment 780, an adaptive segment 782, and a reactive segment 784. The segments 780, 782, 784 may be utilized in any circumstance where the torque and resultant displacement is desired. However, the reactive segment 784 may particularly be utilized in circumstances where the motorized lacing engine makes sudden changes or corrections in the displacement of the lace in reaction to unanticipated external factors, e.g., the wearer has abruptly stopped moving, resulting in a relatively high load on the lace. The adaptive segment 782, by contrast, may be utilized when more gradual displacement of the lace may be utilized because a change in the load on the lace may be anticipated, e.g., because the change in load may be less sudden or a change in activity is input into the motorized lacing engine by the wearer or the motorized lacing engine is able to anticipate a change in activity through machine learning. The deformable lace guide design resulting in this final example, is designed to create the adaptive segment 782 and reactive segment 784 through lace guide structural design (such as channel shape, material selection, or a combination parameters). The lacing architecture and lace guides producing the final example, also produce a pre-tension in the lace cable resulting in the illustrated initial tightening segment 780.

FIGS. 8A-8F are diagrams illustrating an example lacing guide 800 for use in certain lacing architectures, according to some example embodiments. In this example, an alternative lace guide with an open lace channel is illustrated. The lacing guide 800 includes a guide tab 805, a stitch opening 810, a guide superior surface 815, a lace retainer 820, a lace channel 825, a channel radius 830, a lace access opening 840, a guide inferior surface 845, and a guide radius 850. Advantages of an open channel lace guide, such as lacing guide 800, include the ability to easily route the lace cable after installation of the lace guides on the footwear upper. With tubular lace guides as illustrated in many of the lace architecture examples discussed above, routing the lace cable through the lace guides is most easily accomplish before adhering the lace guides to the footwear upper (not to say it cannot be accomplished later). Open channel lace guides facilitate simple lace routing by allowing the lace cable to simply be pushed pass the lace retainer 820 after the lace guides 800 are positioned on the footwear upper. The lacing guide 800 can be fabricated from various materials including metal or plastics.

In this example, the lacing guide 800 can be initially attached to a footwear upper through stitching or adhesives. The illustrated design includes a stitch opening 810 that is configured to enable easy manual or automated stitching of lacing guide 800 onto a footwear upper (or similar material). Once lacing guide 800 is attached to the footwear upper, lace cable can be routed by simply pulling a loop of lace cable into the lace channel 825. The lace access opening 840 extends through the inferior surface 845 to provide a relief recess for the lace cable to get around the lace retainer 820. In this example, the channel radius 830 is designed to correspond to, or be slightly larger then, the diameter of the lace cable. The channel radius 830 is one of the parameters of the lacing guide 800 that can control the amount of friction experienced by the lace cable running through the lacing guide 800. Another parameter of lacing guide 800 that impacts friction experienced by the lace cable includes guide radius 850. The guide radius 850 also may impact the frequency or spacing of lace guides positioned on a footwear upper.

Figure 8A:
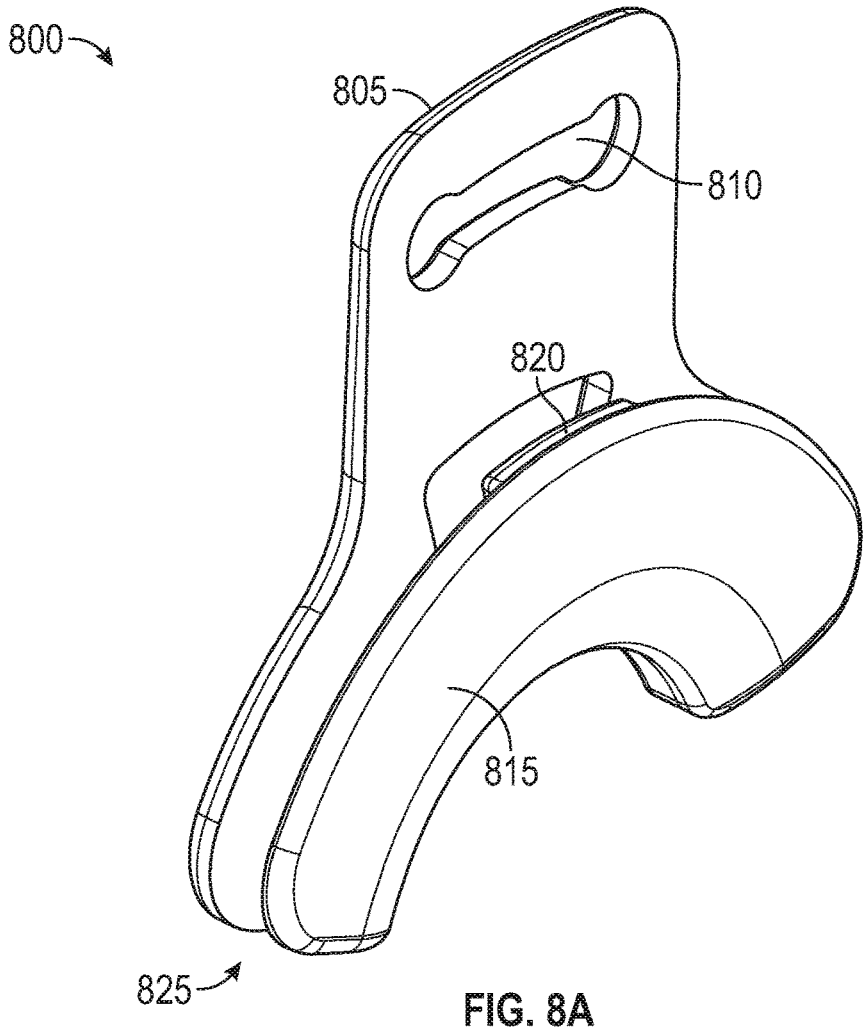
FIGS. 8A-8G are diagrams illustrating a lacing guide for use in certain lacing architectures, according to some example embodiments.
Figure 8B:
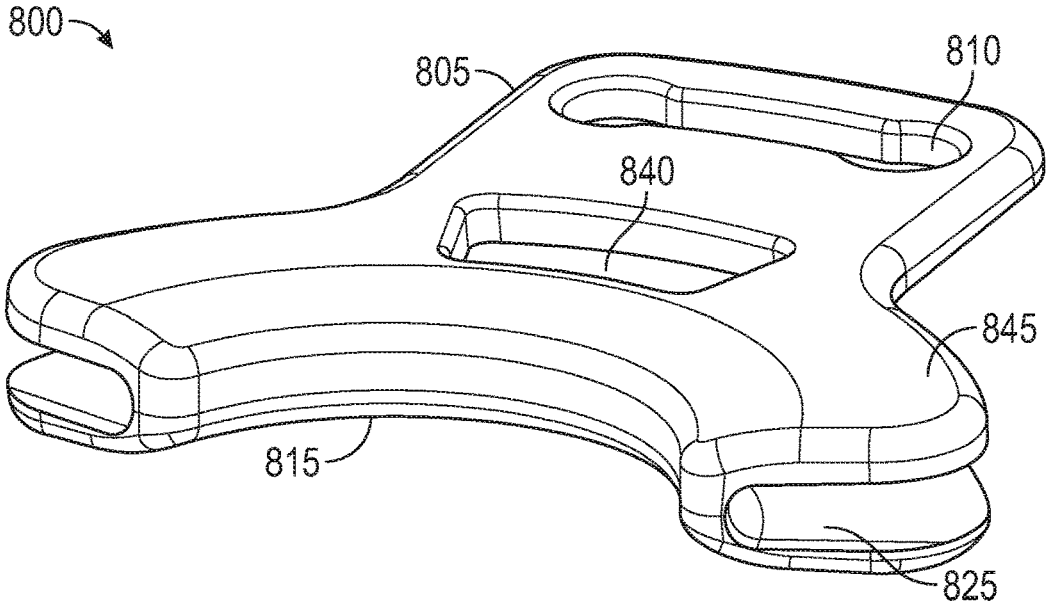
Figure 8C:
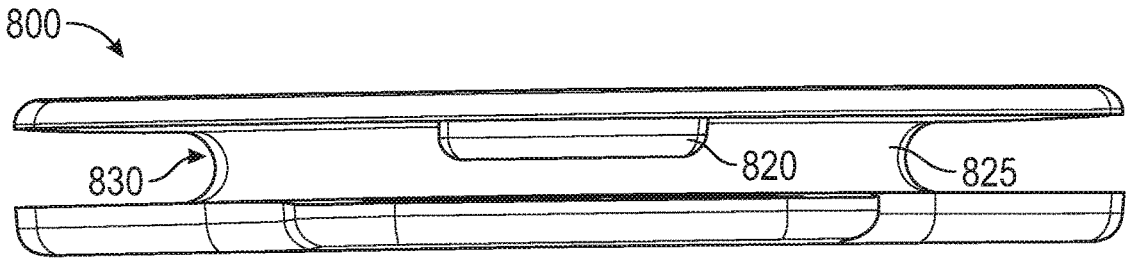
Figure 8D:
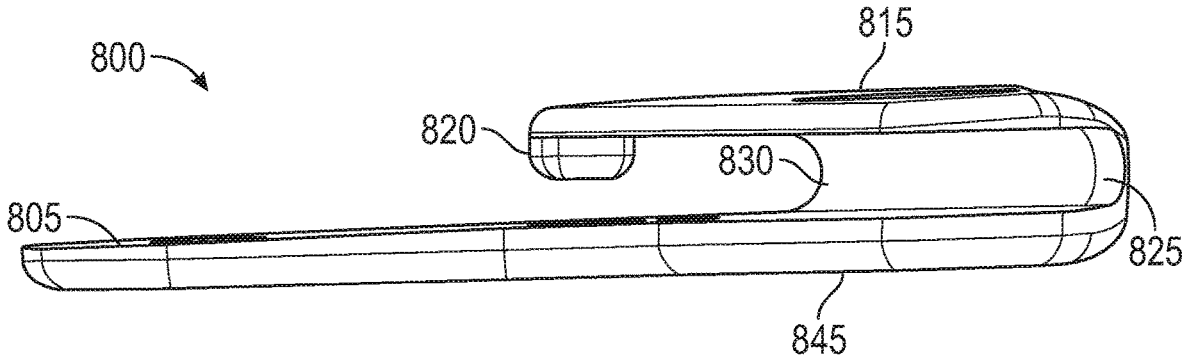
Figure 8E:
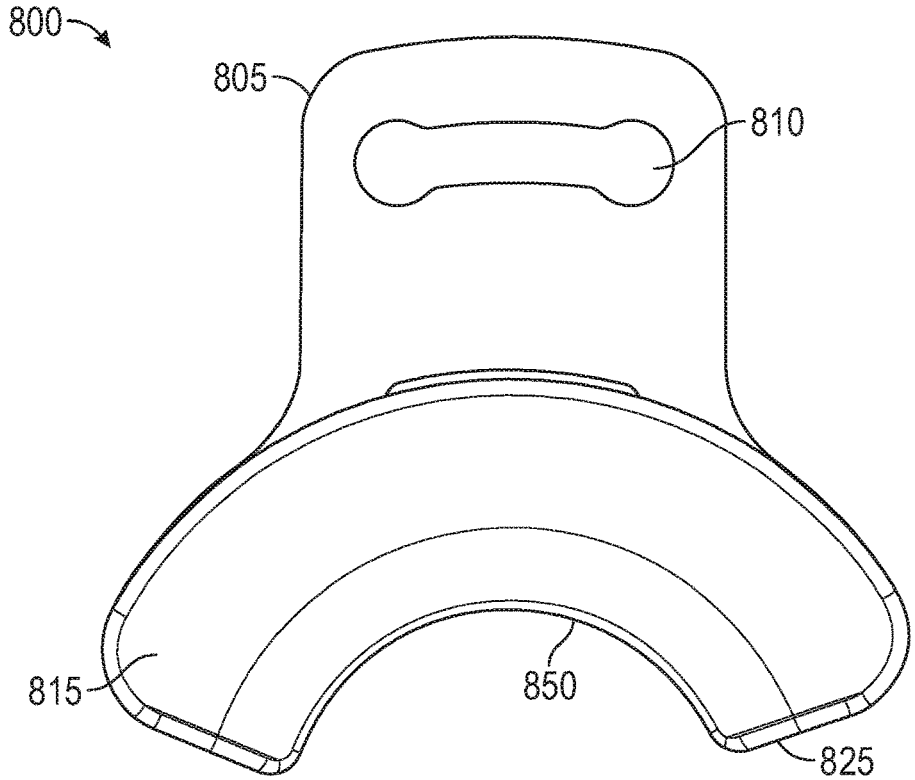
Figure 8F:
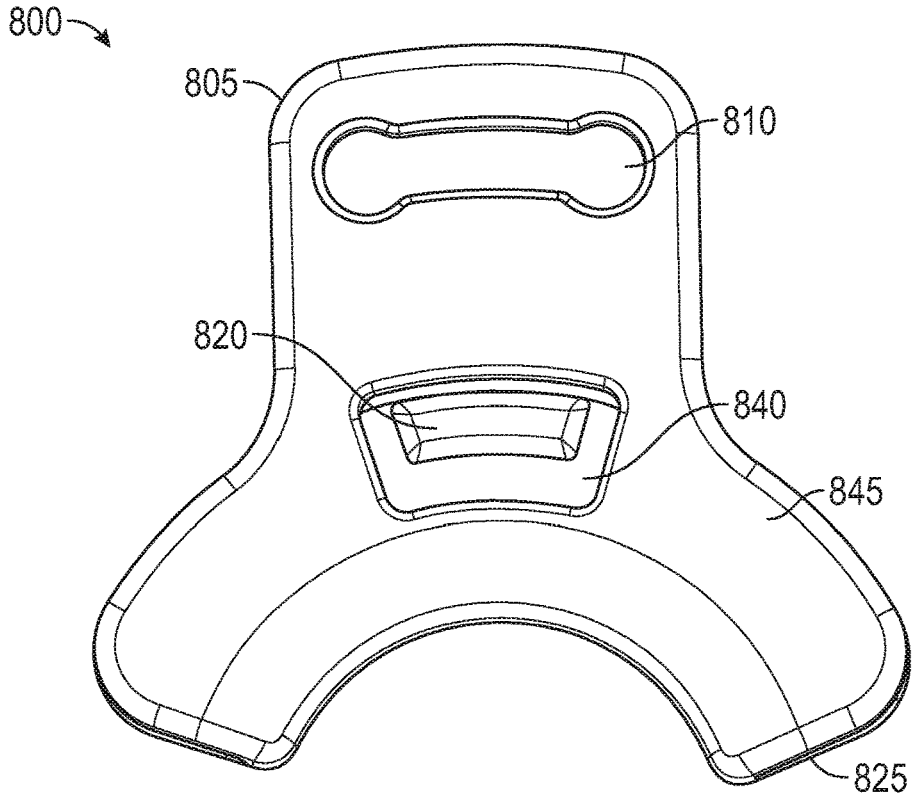
Figure 8G:
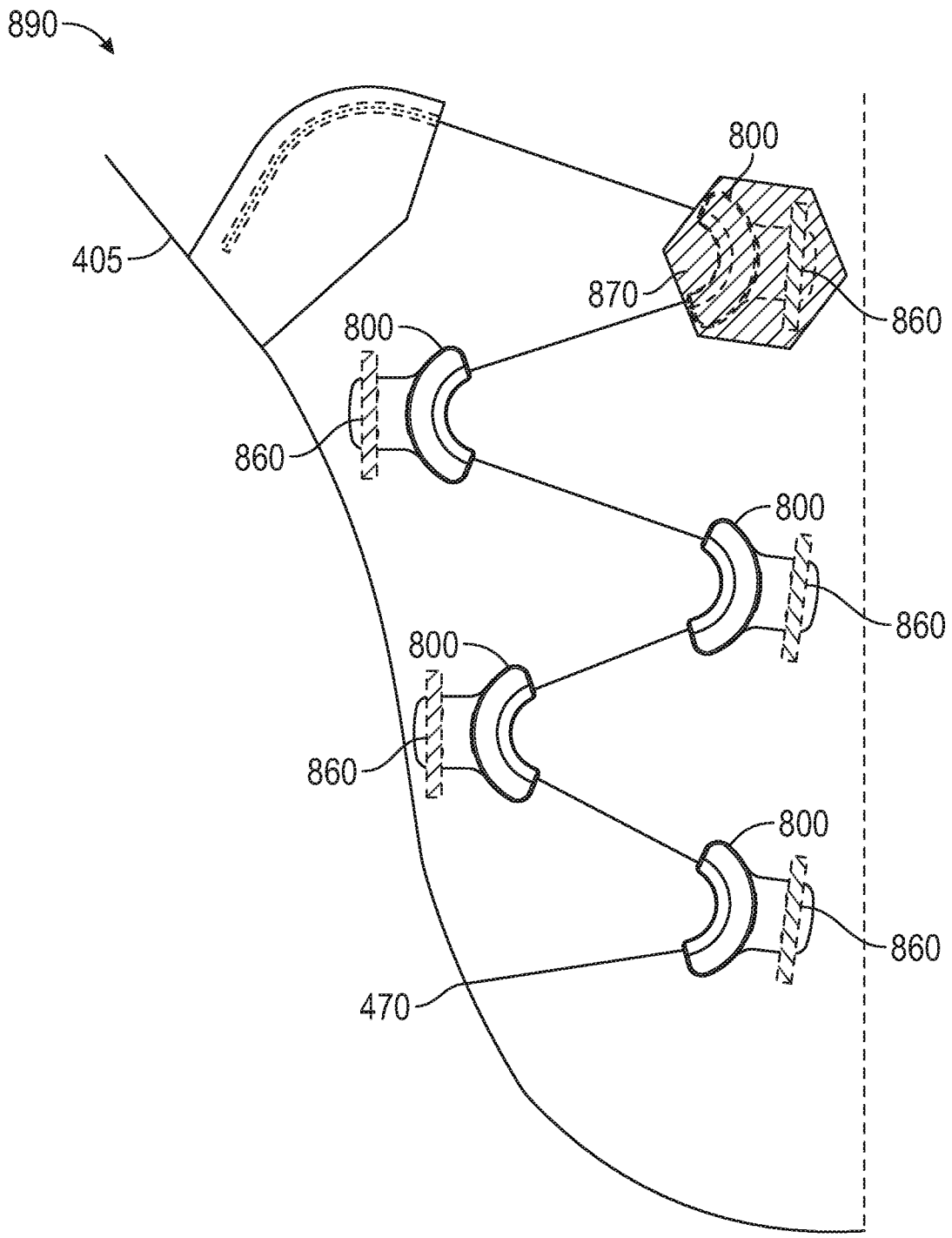

FIG. 8G is a diagram illustrating a portion of footwear upper 405 with a lacing architecture 890 using lacing guides 800, according to some example embodiments. In this example, multiple lacing guides 800 are arranged on a lateral side of footwear upper 405 to form half of the lacing architecture 890. Similar to lacing architectures discussed above, lacing architecture 890 uses lacing guides 800 to form a wave pattern or parachute lacing pattern to route the lace cable. One of the benefits of this type of lacing architecture is that lace tightening can produce both later-medial tightening as well as anterior-posterior tightening of the footwear upper 405.

In this example, lacing guides 800 are at least initially adhered to upper 405 through stitching 860. The stitching 860 is shown over or engaging stitch opening 810. One of the lacing guide 800 is also depicted with a reinforcement 870 covering the lacing guide. Such reinforcements can be positioned individually over each of the lacing guides 800. Alternatively, larger reinforcements could be used to cover multiple lacing guides. Similar to the reinforcements discussed above, reinforcement 870 can be adhered through adhesives, heat-activated adhesives, and/or stitching. In some examples, reinforcement 870 can be adhered using adhesives (heat-activated or not) and a vacuum bagging process that uniformly compresses the reinforcement over the lacing guide. A similar vacuum bagging process can also be used with reinforcements and lacing guides discussed above. In other examples, mechanical presses or similar machines can be used to assist with adhering reinforcements over lacing guides.

Once all of the lacing guides 800 are initially positioned and attached to footwear upper 405, the lace cable can be routed through the lacing guides. Lace cable routing can begin with anchoring a first end of the lace cable at lateral anchor point 470. The lace cable can then be pulled into each lace channel 825 starting with the anterior most lacing guide and working posteriorly towards the heel of upper 405. Once the lace cable is routed through all lacing guides 800, reinforcements 870 can be optionally adhered over each of the lacing guides 800 to secure both the lacing guides and the lace cable.

Assembly Processes

Figure 9:
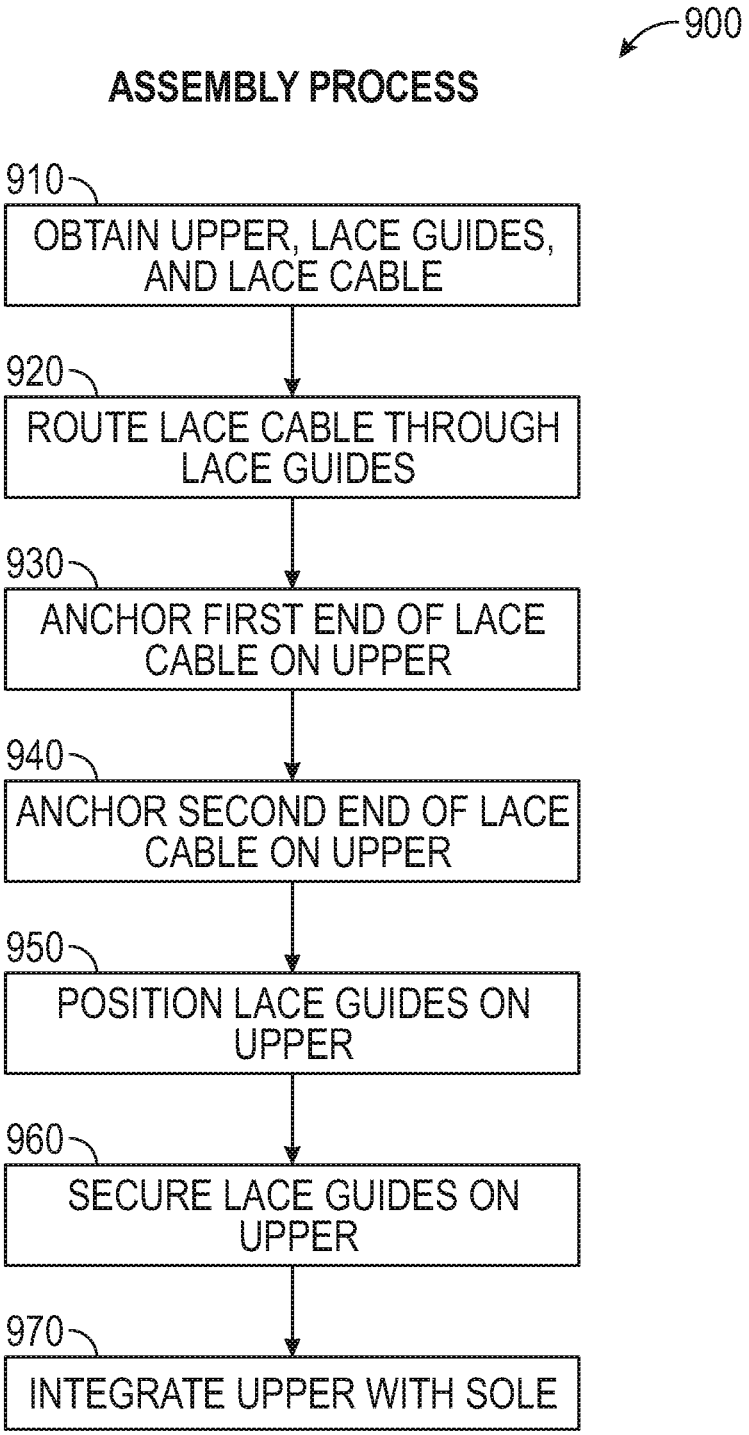
FIG. 9 is a flowchart illustrating a footwear assembly process for assembly of footwear including a lacing engine, according to some example embodiments.

FIG. 9 is a flowchart illustrating a footwear assembly process 900 for assembly of footwear including a lacing engine, according to some example embodiments. In this example, the assembly process 900 includes operations such as: obtaining footwear upper, lace guides, and lace cable at 910; routing lace cable through tubular lace guides at 920; anchoring a first end of the lace cable at 930; anchoring a second end of lace cable at 940; positioning lace guides at 950; securing lace guides at 960; and integrating upper with footwear assembly at 970. The process 900 described in further detail below can include some or all of the process operations described and at least some of the process operations can occur at various locations and/or using different automated tools.

In this example, the process 900 begins at 910 by obtaining a footwear upper, a plurality of lace guides, and a lace cable. The footwear upper, such as upper 405, can be a flattened footwear upper separated from the remainder of a footwear assembly (e.g., sole, mid-sole, outer cover, etc. . . . ). The lace guides in this example include tubular plastic lace guides as discussed above, but could also include other types of lace guides. At 920, the process 900 continues with the lace cable being routed (or threaded) through the plurality of lace guides. While the lace cable can be routed through the lace guides at a different point in the assembly process 900, when using tubular lace guides routing the lace through the lace guides prior to assembly onto the footwear upper may be preferable. In some examples, the lace guides can be pre-threaded onto the lace cable, with process 900 beginning with multiple lace guides already threaded onto the lace obtained during the operation at 910.

At 930, the process 900 continues with a first end of the lace cable being anchored to the footwear upper. For example, lace cable 430 can be anchored along a lateral edge of upper 405. In some examples, the lace cable may be temporary anchored to the upper 405 with a more permanent anchor accomplished during integration of the footwear upper with the remaining footwear assembly. At 940, the process 900 can continue with a second end of the lace cable being anchored to the footwear upper. Like the first end of the lace cable, the second end can be temporarily anchored to the upper. Additionally, the process 900 can optionally delay anchoring of the second end until later in the process or during integration with the footwear assembly.

At 950, the process 900 continues with the plurality of lace guides being positioned on the upper. For example, lace guides 410 can be positioned on upper 405 to generate the desired lacing pattern. Once the lace guides are positioned, the process 900 can continue at 960 by securing the lace guides onto the footwear upper. For example, the reinforcements 420 can be secured over lace guides 410 to hold them in position. Finally, the process 900 can complete at 970 with the footwear upper being integrated into the remainder of the footwear assembly, including the sole. In an example, integration can include positioning the loop of lace cable connecting the lateral and medial sides of the footwear upper in position to engage a lacing engine in a mid-sole of the footwear assembly.

Figure 10:
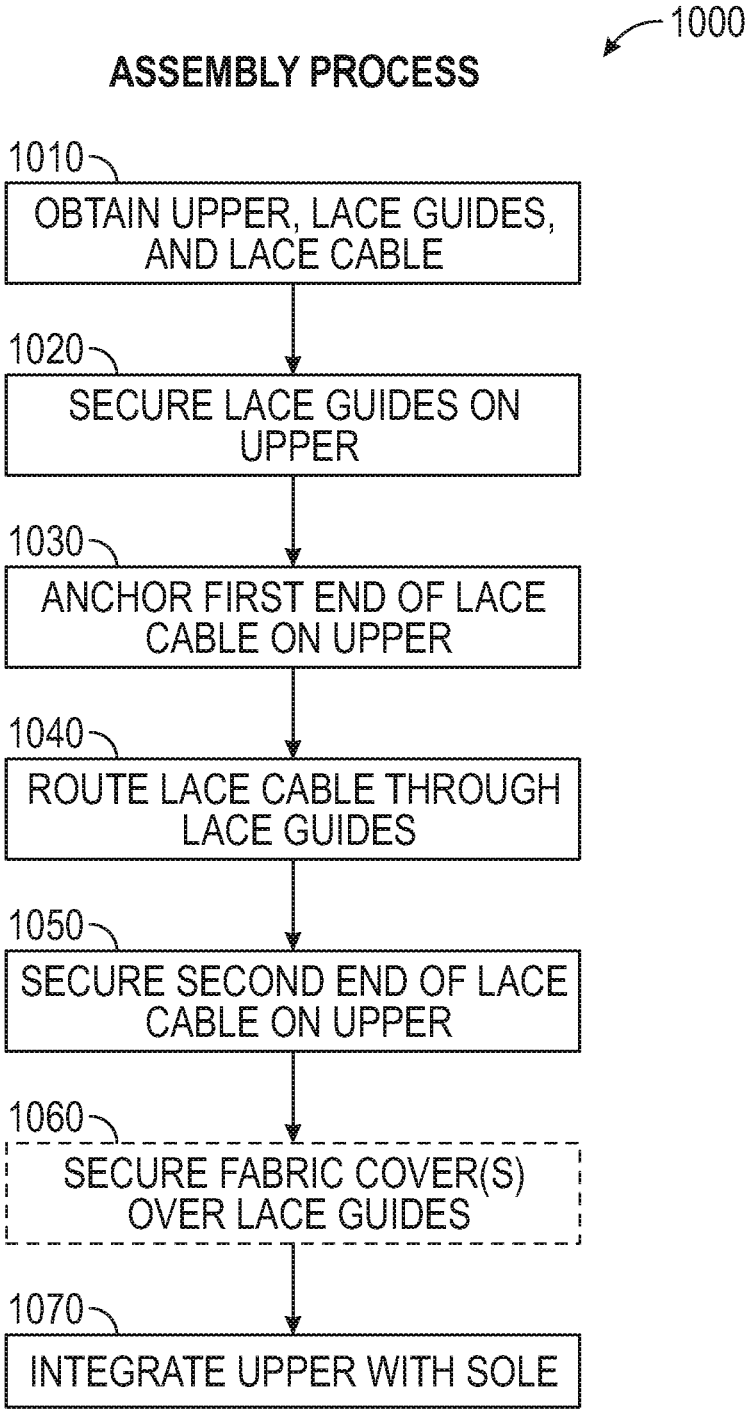
FIG. 10 is a flowchart illustrating a footwear assembly process for assembly of footwear including a lacing engine, according to some example embodiments.

FIG. 10 is a flowchart illustrating a footwear assembly process 1000 for assembly of footwear including a plurality of lacing guides, according to some example embodiments. In this example, the assembly process 1000 includes operations such as: obtaining footwear upper, lace guides, and lace cable at 1010; securing lacing guides on footwear upper at 1020; anchoring a first end of the lace cable at 1030; routing lace cable through the lace guides at 1040; anchoring a second end of lace cable at 1050; optionally securing reinforcements over the lace guides at 1060; and integrating upper with footwear assembly at 1070. The process 1000 described in further detail below can include some or all of the process operations described and at least some of the process operations can occur at various locations and/or using different automated tools.

In this example, the process 1000 begins at 1010 by obtaining a footwear upper, a plurality of lace guides, and a lace cable. The footwear upper, such as upper 405, can be a flattened footwear upper separated from the remainder of a footwear assembly (e.g., sole, mid-sole, outer cover, etc. . . . ). The lace guides in this example include open channel plastic lacing guides as discussed above, but could also include other types of lace guides. At 1020, the process 1000 continues with the lacing guides being secured to the upper. For example, lacing guides 800 can be individually stitched in position on upper 405.

At 1030, the process 1000 continues with a first end of the lace cable being anchored to the footwear upper. For example, lace cable 430 can be anchored along a lateral edge of upper 405. In some examples, the lace cable may be temporary anchored to the upper 405 with a more permanent anchor accomplished during integration of the footwear upper with the remaining footwear assembly. At 1040, the process 1000 continues with the lace cable being routed through the open channel lace guides, which includes leaving a lace loop for engagement with a lacing engine between the lateral and medial sides of the footwear upper. The lace loop can be a predetermined length to ensure the lacing engine is able to properly tighten the assembled footwear.

At 1050, the process 1000 can continue with a second end of the lace cable being anchored to the footwear upper. Like the first end of the lace cable, the second end can be temporarily anchored to the upper. Additionally, the process 1000 can optionally delay anchoring of the second end until later in the process or during integration with the footwear assembly. In certain examples, delaying anchoring of the first and/or second end of the lace cable can allow for adjustment in overall lace length, which may be useful during integration of the lacing engine.

At 1060, the process 1000 can optionally include an operation for securing fabric reinforcements (covers) over the lace guides to further secure them to the footwear upper. For example, lacing guides 800 can have reinforcements 870 hot melted over the lacing guides to further secure the lacing guides and the lace cable. Finally, the process 1000 can complete at 1070 with the footwear upper being integrated into the remainder of the footwear assembly, including the sole. In an example, integration can include positioning the loop of lace cable connecting the lateral and medial sides of the footwear upper in position to engage a lacing engine in a mid-sole of the footwear assembly.

Tensioning Straps

Figure 11:
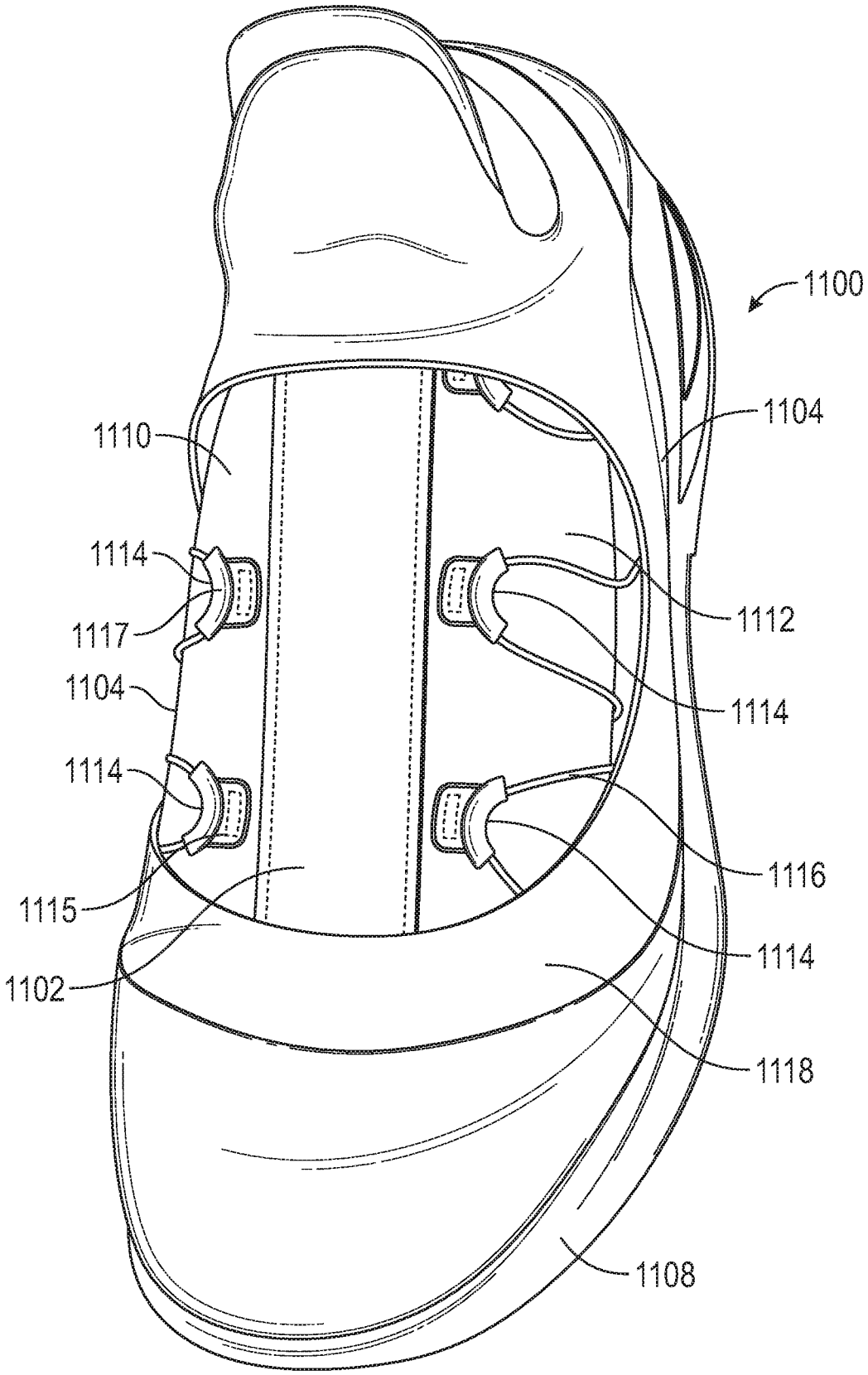
FIG. 11 is a diagram illustrating a front view of a partially cut-away footwear upper showing an elastic strip connecting medial and lateral side panels of the upper.

FIG. 11 is a diagram illustrating a front view of partially cut-away footwear upper 1100 showing elastic strip 1102 connecting medial side 1104 and lateral side 1106 of footwear upper 1100. Footwear upper 1100 can be connected to sole structure 1108 in which a motorized lacing engine can be disposed. Footwear upper 1100 can include internal layers, such as medial panel 1110 and lateral panel 1112, which are configured to surround the foot. Medial panel 1110 and lateral panel 1112 can include additional layers, such as lining or padding layers (not shown). Elastic strip 1102 can be connected to both of medial panel 1110 and lateral panel 1112.

Footwear upper 1110 can also include lace guides 1114, lace 1116 and outer layer 1118. Upper 1100 can include outer layer 1118 that is configured to cover lace 1116, elastic strip 1102 and lace guides 1114. Outer layer 1118 is cut-away in FIG. 11 to show medial panel 1110, lateral panel 1112, elastic strip 1102, lace guides 1114 and lace 1116.

Lace guides 1114 can be connected to medial panel 1110 and lateral panel 1112. Lace guides 1114 can each include guide tab 1115 and lace channel body 1117. Guide tabs 1115 can be mounted directly to panels 1110 and 1112, such as via adhesive, stitching, riveting or the like. Lace guides 1114 can be configured similarly as other lace guides described herein. Lace 1116 can be threaded through a channel disposed in lace channel body 1117 of lace guides 1114. Lace 1116 can have distal portions that are anchored to upper toward the toe region and a proximal portion that connects the distal portions and that is located within the lacing engine.

As discussed herein, operation of the lacing engine can act to cinch lace 1116 to compress medial panel 1110 and lateral panel 1112. In particular, the proximal portion of lace 1116 is drawn into sole structure 1108 as the lacing engine is operated, which can cause lace guides 1114 to be drawn toward sole structure 1108. As lace guides 1114 on medial panel 1110 and lateral panel 1112 are drawn closer to sole structure 1108, elastic strip 1102 can stretch around a foot positioned within footwear upper 1100. Elastic strip 1102 can be made of any type of resilient material besides elastic, such as rubber or spandex and the like. Elastic strip 1102 can be configured to be at rest in an un-stretched state or in a pre-tensioned state when a foot is placed in footwear upper 1100. In other embodiments, elastic strip 1102 can be replaced with an elastic mesh material.

Figure 12:
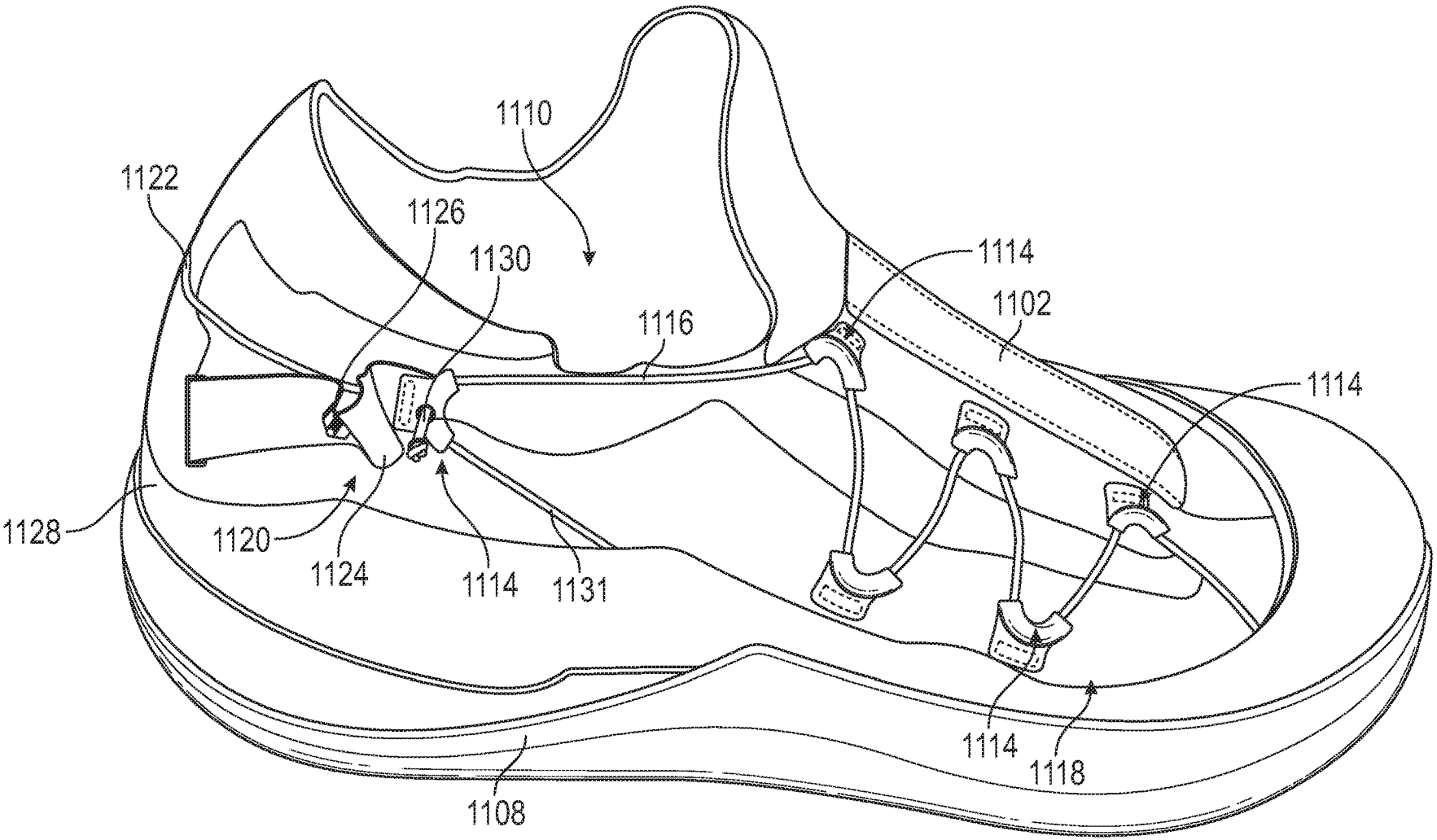
FIG. 12 is a diagram illustrating a rear view of the footwear upper of FIG. 11 showing a heel strap assembly connecting portions of a lacing cable on medial and lateral sides of the upper.

FIG. 12 is a diagram illustrating a rear view of footwear upper 1100 of FIG. 11 showing heel strap assembly 1120 connecting lace 1116 on medial and lateral sides of upper 1110. Heel strap assembly 1120 can include pre-tensioning strap 1122, heel strap 1124 and anchor point 1126. Pre-tensioning strap 1122 can extend from lace 1116 on the lateral side of footwear upper 1100 shown in FIG. 11, extend past heel portion 1128 of footwear upper 1100, and extend to the medial side of footwear upper 1100 (not visible in FIG. 12) to connect to the opposite end of lace 1116. Pre-tensioning strap 1122 can be connected to lace 1116 in any suitable manner at juncture 1130, such as by using a lace guide 1114. In an example, lace 1116 is permitted to slide within juncture 1130 with pre-tensioning strap 1122. In an example pre-tensioning strap 1122 can be connected to guide tab 1115 of a lace guide 1114 and lace 1116 can be connected to lace channel body 1117 of the lace guide 1114. Pre-tensioning strap 1122 can comprise a resilient, elongate member that can be stretched and that can regain its original length after stretching. As will be explained in greater detail below with reference to FIGS. 15A and 15B, pre-tensioning strap 1122 can be configured to pull lace 1116 from the lacing engine when the lacing engine spool is un-wound to release lace 1116.

Heel strap 1124 can extend from juncture 1130 of pre-tensioning strap 1122 with lace 1116 to anchor point 1126. In the state shown in FIG. 12, heel strap 1124 is folded between anchor point 1126 and juncture 1130. As will be explained in greater detail below with reference to FIGS. 15A and 15B, heel strap 1124 will unfold as juncture 1130 is drawn toward the toe portion of footwear upper 1100, eventually causing anchor point 1126 to pull heel portion 1128 toward the toe portion to help retain footwear upper 1100 on the heel of a foot inserted into upper 1100. Anchor point 1116 can comprise any suitable means or device that can provide a stationary point on footwear upper 1100. In the embodiment shown, anchor point 1126 can comprise a threaded fastener extending through footwear upper 1100.

Figure 13:
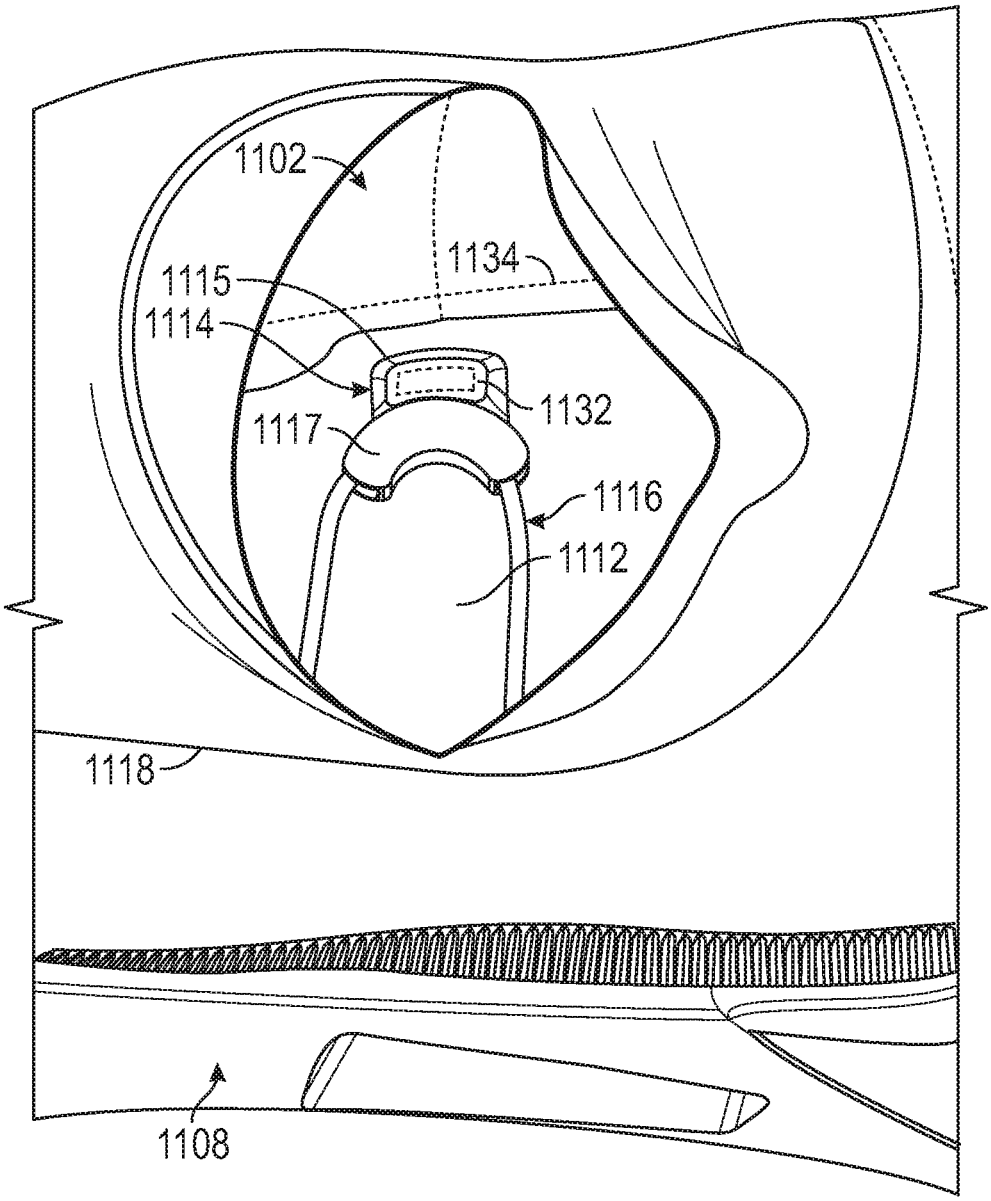
FIG. 13 is a diagram illustrating a lateral view of the footwear upper of FIG. 11 partially cut-away to show a lace guide connected to the footwear upper alongside the elastic strip.
Figure 14:
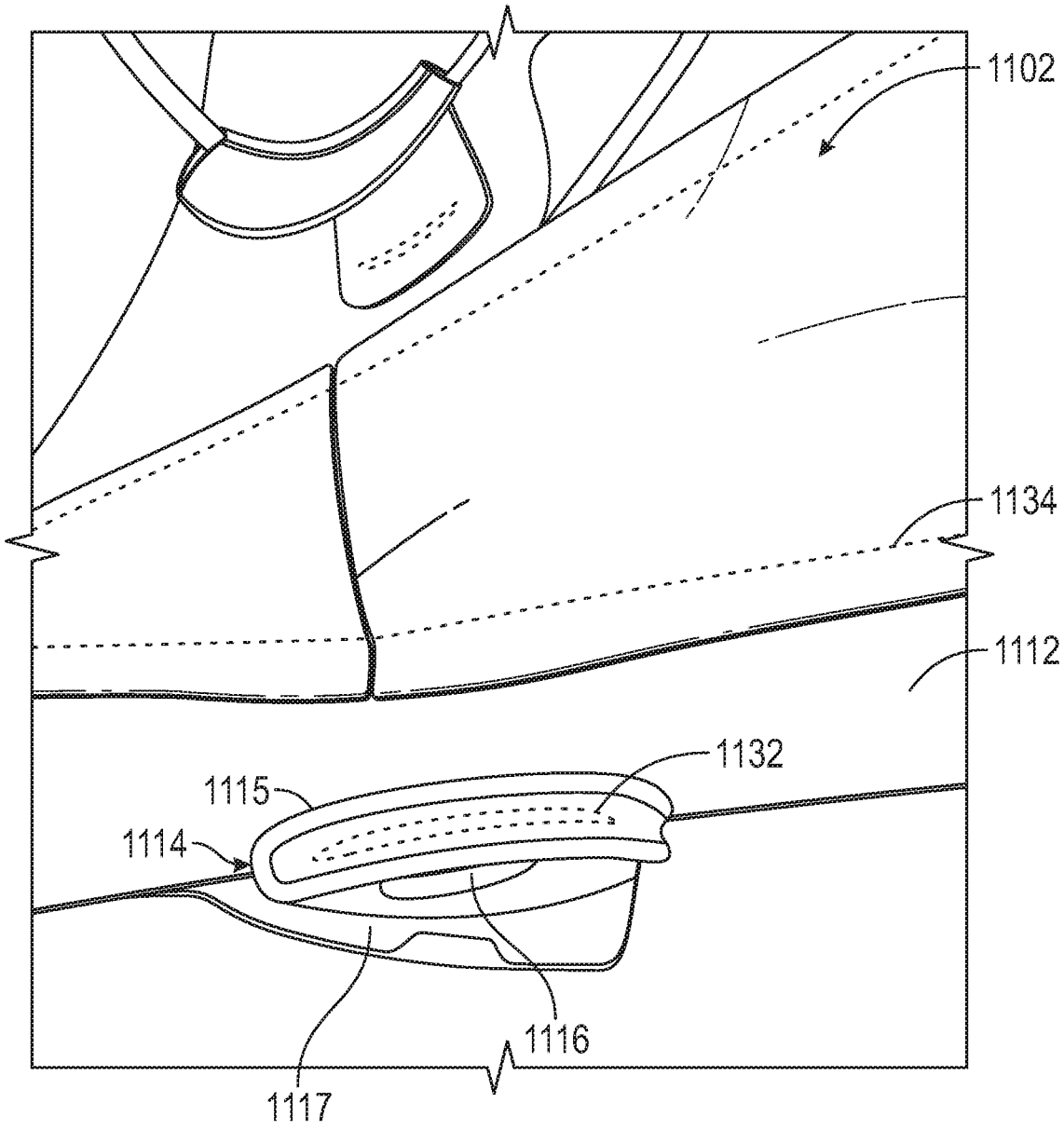
FIG. 14 is a diagram illustrating the footwear upper of FIG. 13 flexed to show the lace guide connected to the footwear upper separately from the elastic strip.

FIG. 13 is a diagram illustrating a lateral view of footwear upper 1100 of FIG. 11 partially cut-away to show lace guide 1114 connected to footwear upper 1100 alongside elastic strip 1102. FIG. 14 is a diagram illustrating footwear upper 1100 of FIG. 13 flexed to show lace guide 1114 connected to footwear upper 1100 separately from elastic strip 1102. FIGS. 13 and 14 are discussed concurrently.

Outer layer 1118 is partially cut-away to show lateral panel 1112 independently connected to elastic strip 1102 and lace guide 1114. Guide tab 1115 of lace guide 1114 can be connected to lateral panel 1112 by any suitable means. In the illustrated embodiment, guide tab 1115 is connected to lateral panel 1112 via stitching 1132. Guide tab 1115 is spaced from an upper edge of lateral panel 1112 over which elastic strip 1102 is positioned to form a gap between guide tab 1115 and elastic strip 1102.

Elastic strip 1102 can comprise a single strip or, as show in FIGS. 13 and 14, multiple strips aligned end-to-end. Elastic strip 1102 can be connected to lateral panel 1112 via any suitable means, such as adhesive or stitching. In the illustrated embodiment, elastic strip 1102 is connected to lateral panel 1112 via stitching 1134. Decoupling of lace guide 1114 from elastic strip 1102 can permit elastic strip 1102 to stretch evenly along the length of lateral panel 1112 and can allow elastic strip 1102 and can provide more uniform action to operation of lace guide 1114 on lace 1116.

Figure 15A:
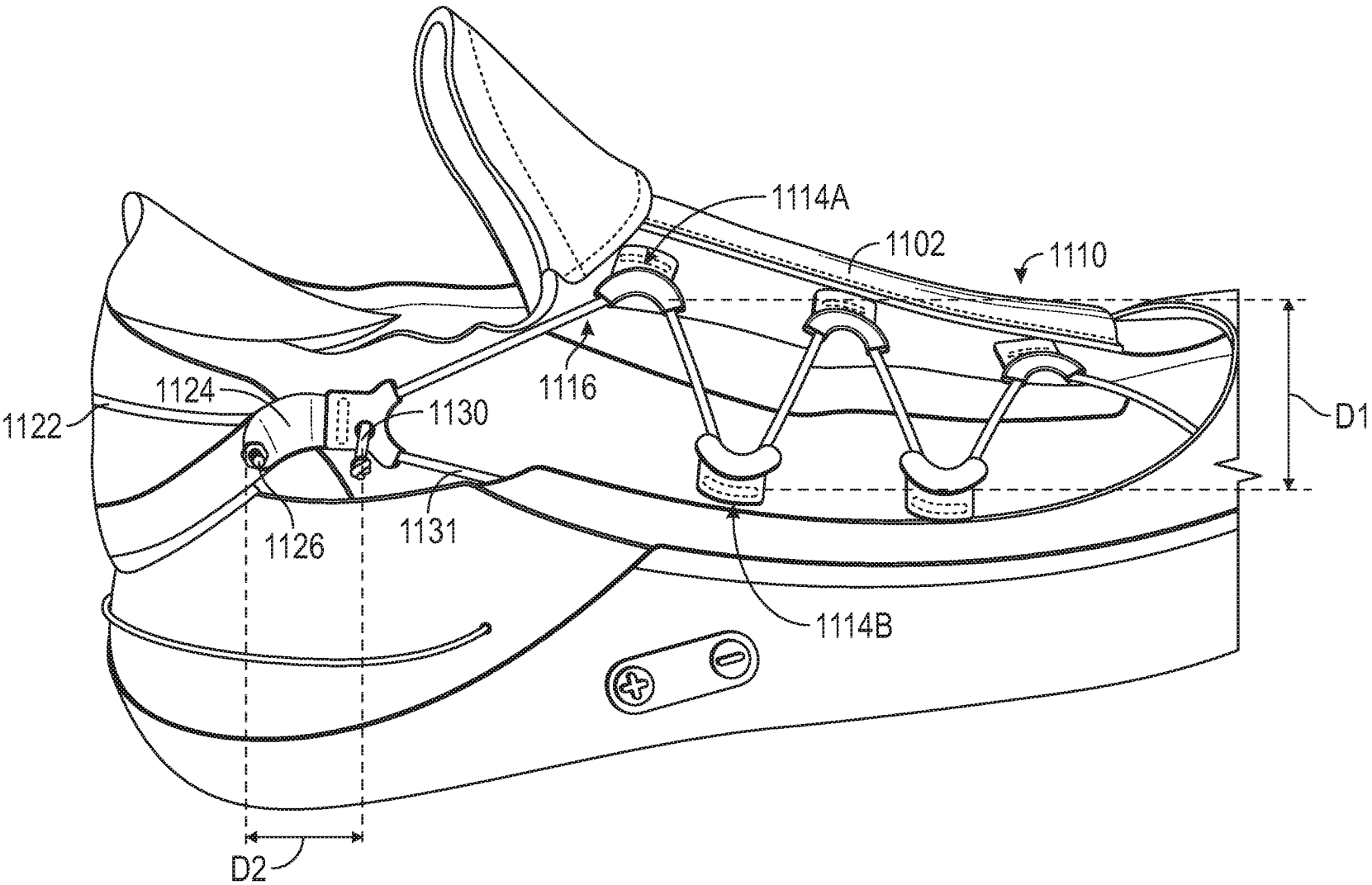
FIG. 15A is a diagram illustrating the footwear upper of FIG. 12 showing a loosened lacing cable being pulled out of a motorized lacing engine by a pre-tensioning strap of the heel strap assembly.

FIG. 15A is a diagram illustrating footwear upper 1100 of FIG. 12 showing a loosened lace 1116 being pulled out of a motorized lacing engine by pre-tensioning strap 1122. As shown, the distance D1 between lace guide 1114A and lace guide 1114B can be at a first open length. Likewise, the distance D2 between lace guide 1114A and anchor point 1126 can be at a first collapsed length. Distance D1 is large, compared to distance D3 of FIG. 15B, to permit a foot to enter footwear upper 1100 as lace 1116 is loosened. Tensioning strap 1122 is activated to pull lace 1116 toward heel portion 1128 at juncture 1130 to thereby pull proximal end portion 1131 of lace 1116 out of the lacing engine. Heel strap 1124 is buckled or folded between juncture 1130 and anchor point 1126 as the excess slack from proximal end portion 1131 permits tensioning strap to act to pull juncture 1130 towards anchor point 1126.

Figure 15B:
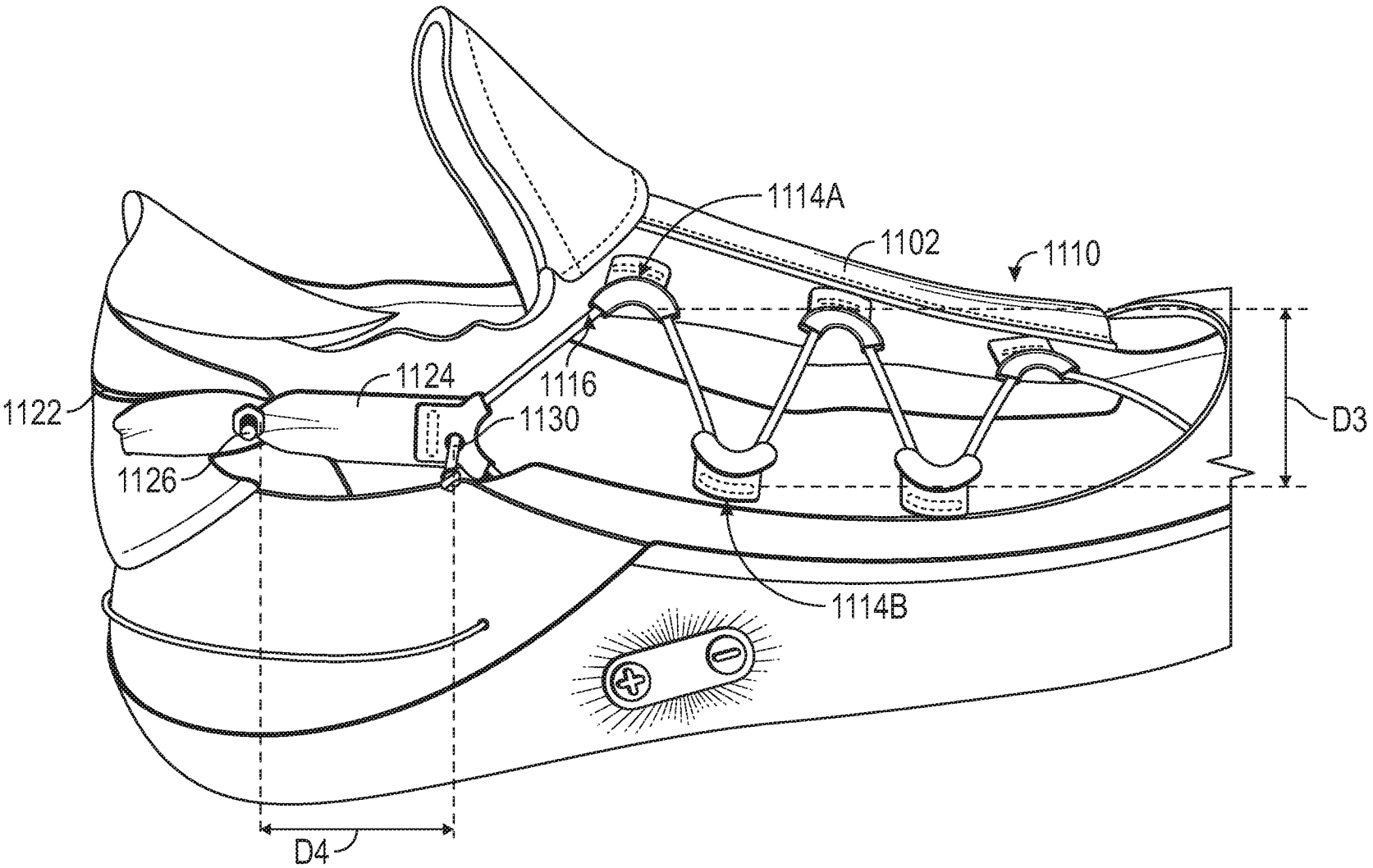
FIG. 15B is a diagram illustrating the footwear upper of FIG. 15A showing the lacing cable tightened into the motorized lacing engine and a heel strap of the heel strap assembly tightened around a heel portion of the footwear upper.

FIG. 15B is a diagram illustrating footwear upper 1100 of FIG. 15A showing lace 1116 tightened into the motorized lacing engine and a heel strap tightened around a heel of footwear upper 1100. As shown, the distance D3 between lace guide 1114A and lace guide 1114B can be at a second collapsed length. Likewise, the distance D4 between lace guide 1114A and anchor point 1126 can be at a second open length. Distance D3 is small compared to distance D1 as the lacing engine has been activated to draw proximal end portion 1131 of lace 1116 into the lacing engine. This additionally causes the previously retracted tensioning strap 1122 to be stretched out such that D4 is larger than D2, and causes heel strap 1124 to be flattened and then stretched. Stretching of heel strap 11124 causes heel portion 1128 of footwear upper 1100 to be drawn into the heel of a foot positioned in footwear upper 1100 as lace 1116 cinches down on footwear upper 1100 and the foot therein.

Figure 16:
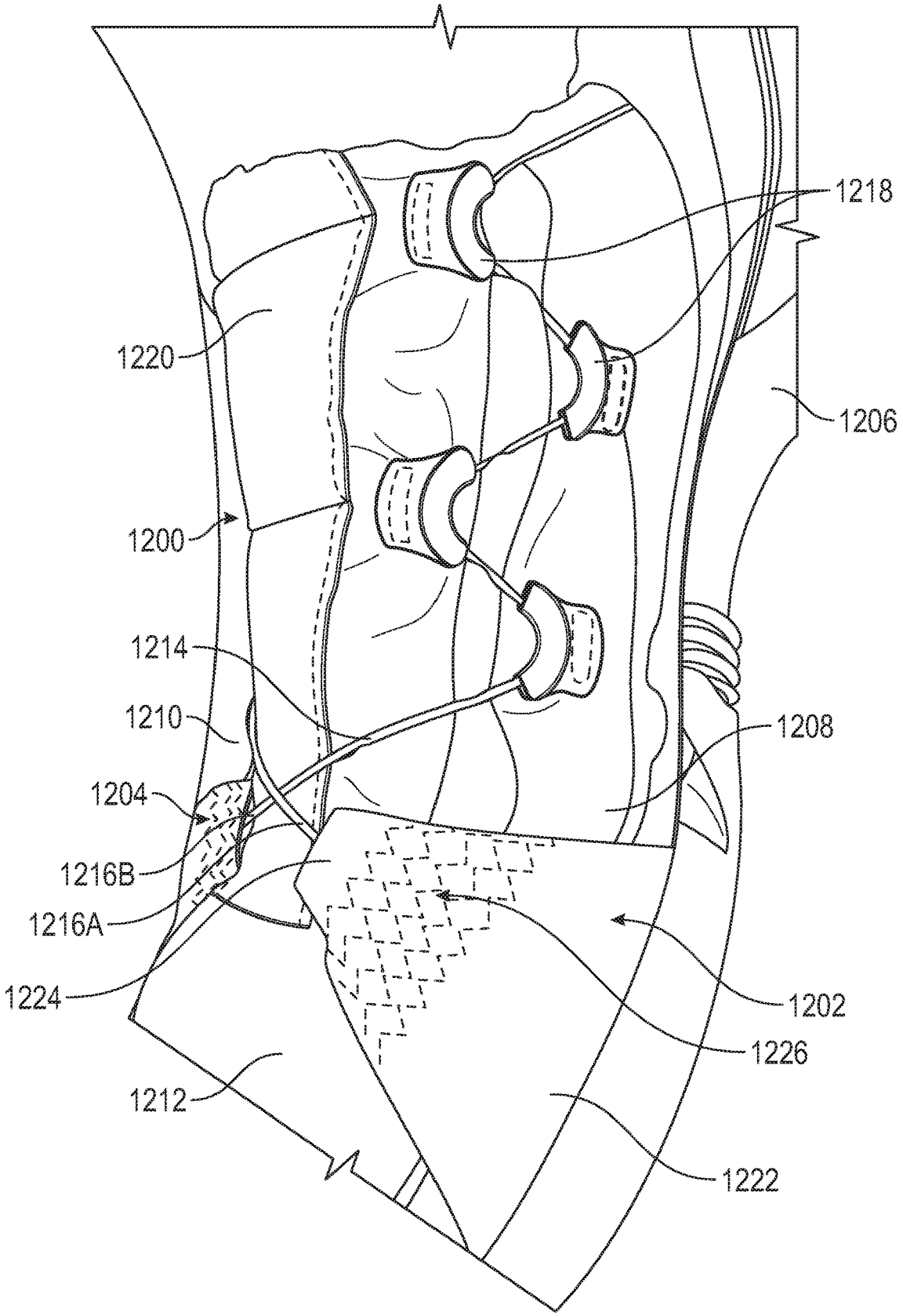
FIG. 16 is a diagram illustrating another embodiment of a footwear upper showing medial and lateral lacing cable tensioning straps.

FIG. 16 is a diagram illustrating another embodiment of footwear upper 1200 showing medial and lateral lacing cable tensioning straps 1202 and 1204, respectively. Footwear upper 1200 can be connected to sole structure 1206 in which a motorized lacing engine can be disposed. Footwear upper 1200 can include medial panel 1208, lateral panel 1210 and toe panel 1212, which are configured to at least partially surround the foot. Medial panel 1208 and lateral panel 1210 can include additional layers, such as lining or padding layers (not shown). Cable tensioning straps 1202 and 1204 can be connected to medial panel 1208 and lateral panel 1210 respectively at bottom edges, and can be connected to lace 1214 at distal end portions 1216A and 1216B, respectively. Footwear upper 1110 can also include lace guides 1218 and elastic panel 1220.

Elastic panel 1220 can function similarly to elastic strip 1102 of FIGS. 11-15B to provide footwear upper 1200 with a degree of stretchability. Lace guides 1218 can function similarly as other lace guides described herein and further description is not provided here for brevity. Lace 1214 can have distal ends that are connected to tensioning straps 1202 and 1204, while a middle portion of lace 1214 can be located in a lacing mechanism disposed in sole structure 1206. Thus, as the lacing mechanism winds lace 1214, lace 1214 is pulled through lace guides 1218 to cinch lace 1214 down against footwear upper 1200. Tensioning straps 1202 and 1204 provide anchors for end portions 1216A and 1216B of lace 1214 to facilitate the cinching action.

Tensioning straps 1202 and 1204 allow lace 1214 to be anchored to sole structure 1206 while also at least partially wrapping around panels 1208 and 1210 of footwear upper 1200. As can be seen, lace 1214 crosses over footwear upper 1200 once at medial panel 1208 and once at lateral panel 1210. This permits some of the force used in tensioning lace 1214 to also directly be used to apply inward pressure on footwear upper 1200 proximate toe panel 1212. Tensioning straps 1202 and 1204 provide a greater surface area over which the tension in lace 1214 is distributed to panels 1208 and 1210. That is, the surface area of straps 1202 and 1204 that contacts panels 1208 and 1210 is greater than the surface area of lace 1214 that contacts panels 1208 and 1210 at the same location if lace 1214 were anchored to footwear upper 1200 at sole structure 1206. In an embodiment, straps 1202 and 1204 are trapezoidal shaped. In other embodiments, straps 1202 and 1204 can be triangular or rectangular shaped. For example, strap 1202 can have bottom edge region 1222 that is wider than top edge region 1224. Bottom edge region 1222 can be attached to a bottom portion of medial panel 1208, such as by adhesive or stitching or by incorporation into sole structure 1206. Top edge region 1224 can be attached to lace 1214 by any suitable methods, such as by being attached to a length of strap 1202 by stitching 1226. Straps 1202 and 1204 can be attached to footwear upper 1200 only at sole structure 1206 so that they form flaps. In other embodiments, straps 1202 and 1204 can be attached to footwear upper 1200 along their entire length or along only a portion of their length. Straps 1202 and 1204 can be made of a rigid or inelastic material or a stretchable (resilient) or elastic material. The trapezoidal or triangular shaped of straps 1202 and 1204 can distribute the stress and force more evenly in the toe box of footwear upper 11200 and make for a fit that is comfortable and secure. Likewise, straps 1202 and 1204 can include other geometries that have various benefits such as distributing the stress and force evenly along footwear upper 1200.

FIG. 17 is a graph illustrating various force versus lace displacement curves 1300A, 1300B, 1300C, 1300D, 1300E and 1300F for shoe uppers including various elastic or tensioning members described herein, according to some example embodiments. The bottom X axis shows displacement in millimeters and the side Y axis shows Load in Newtons. Curves 1300A-1300F are each associated with a different loading on a lace. As shown, by adjusting the parameters of the various components described herein (lace cable 480, elastic members 440, an elastic heel member 350, an elastic central reinforcement 325, etc.) differing levels of comfort slope can be provided before the elastic zones lock out and the performance zones are initiated. Thus, the comfort slope and the performance slope of each curve can be engineered to provide different effects for different types of shoes or articles of footwear, or for different types of wearers.

Figure 18:
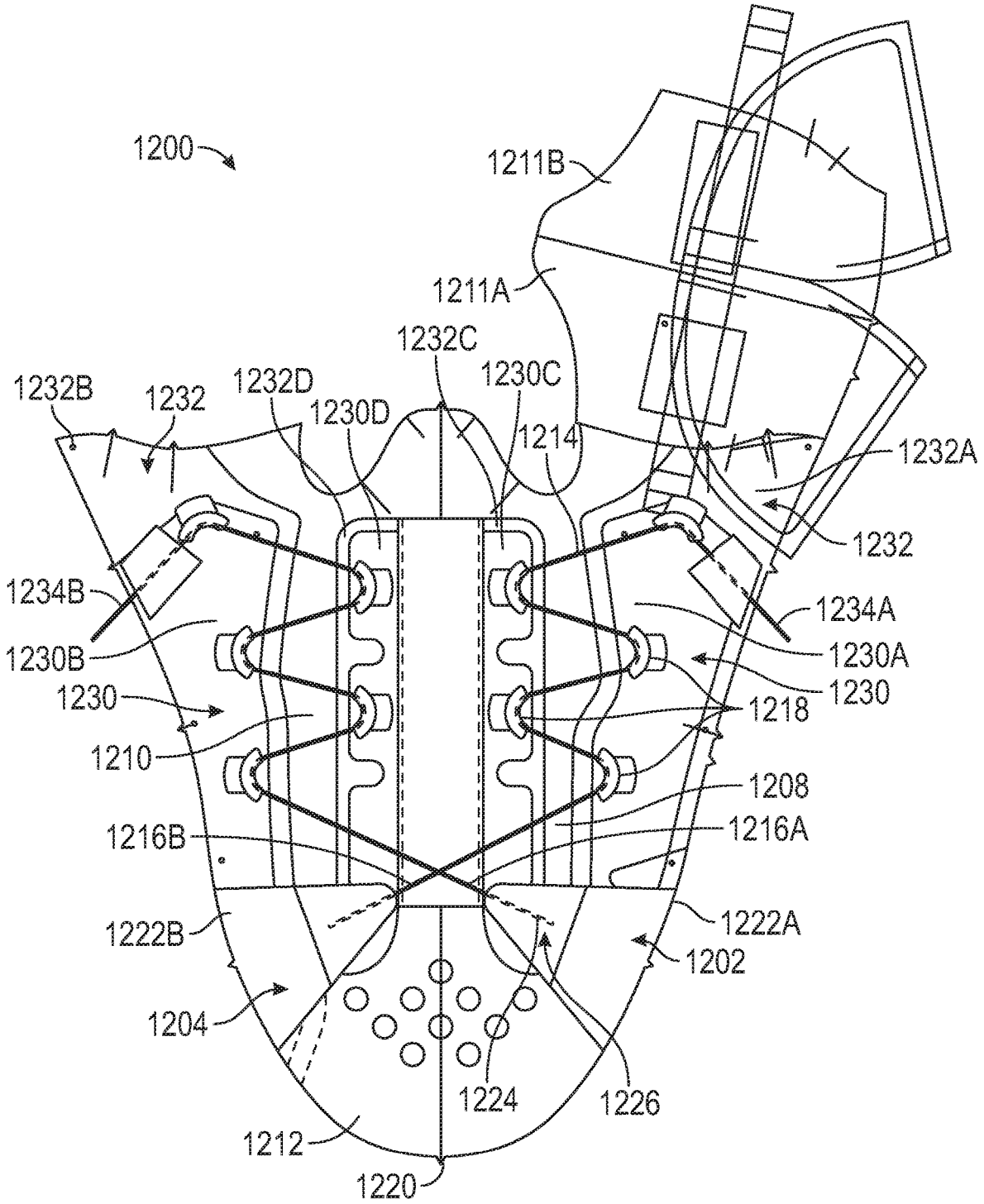
FIG. 18 is a diagram illustrating the footwear upper of FIG. 16 laid out flat to show a lacing architecture including tensioning straps connected to a lace in a cross-over configuration.

FIG. 18 is a diagram illustrating footwear upper 1200 of FIG. 16 laid out flat to show a lacing architecture including tensioning straps 1202 and 1204 connected to lace 1214 in a cross-over configuration.

Footwear upper 1200 can include medial panel 1208, lateral panel 1210, heel panels 1211A and 1211B, and toe panel 1212, which are configured to at least partially surround a foot when heel panel 1211B is attached to lateral panel 1210 and footwear upper 1200 is attached to a sole structure. Medial panel 1208 and lateral panel 1210 can include additional layers, such as a lining (not shown), outer layer 1230 (which can include sole portions 1230A and 1230B, and throat portions 1230C and 1230D), and overlay 1232 (which can include sole portions 1232A and 1232B, and throat portions 1232C and 1232D).

Outer layer 1230 can comprise a layer of material to strengthen medial panel 1208 and lateral panel 1210. In an example, outer layer 1230 can comprise a synthetic material such as nylon. Overlay 1232 can comprise a layer that supports lace guides 1218. Overlay 1232 can comprise a semi-rigid, yet pliable material that can distribute loading of lace guides 1218 to footwear upper 1200. In an example, overlay 1232 can comprise a synthetic material such as Poron® microcellular urethane.

Tensioning straps 1202 and 1204 can be connected to medial panel 1208 and lateral panel 1210, respectively, at bottom edges 1222A and 1222B, and can be connected to distal end portions 1216A and 1216B of lace 1214, respectively, at outer edges 1224A and 1224B. Footwear upper 1110 can also include lace guides 1218 and elastic panel 1220.

Proximal ends 1234A and 1234B of lace 1214 can be connected to a lacing engine (not shown). Proximal ends 1234A and 1234B can be connected to each other so as to form lace 1214. That is, lace 1214 can comprise a single-piece structure. Lace 1214 is threaded through lace guides 1218 so that distal end portions 1216A and 1216B extend to tensioning straps 1202 and 1204. Distal end portion 1216A is connected to tensioning strap 1202 at stitching 1226. Likewise, distal end portion 1216B can be connected to tensioning strap 1204. As shown, distal end portions 1216A and 1216B crossover a throat region of footwear upper 1200 formed between throat portions 1230C and 1230D of outer layer 1230, for example. In such a configuration, lacing guides 1218 on throat portions 1230C and 1230D can be omitted near toe panel 1212 to prevent interference with lace 1214.

Tensioning straps 1202 and 1204 can be configured to float on top of footwear upper 1200 to permit the various layers of footwear upper 1200 (e.g., outer layer 1230 and overlay 1232) to contract independently of the tension in lace 1214 when lace 1214 is drawn tight. For example, as throat portions 1230C and 1230D are drawn closer to sole portions 1230A and 1230B, respectively, when proximal ends 1234A and 1234B are drawn tight by a lacing engine, throat portions 1230C and 1230D can slide underneath tensioning straps 1202 and 1204. Thus, in an embodiment, only a portion of each of tensioning straps 1202 and 1204 can be attached to footwear upper 1200.

Figure 20:
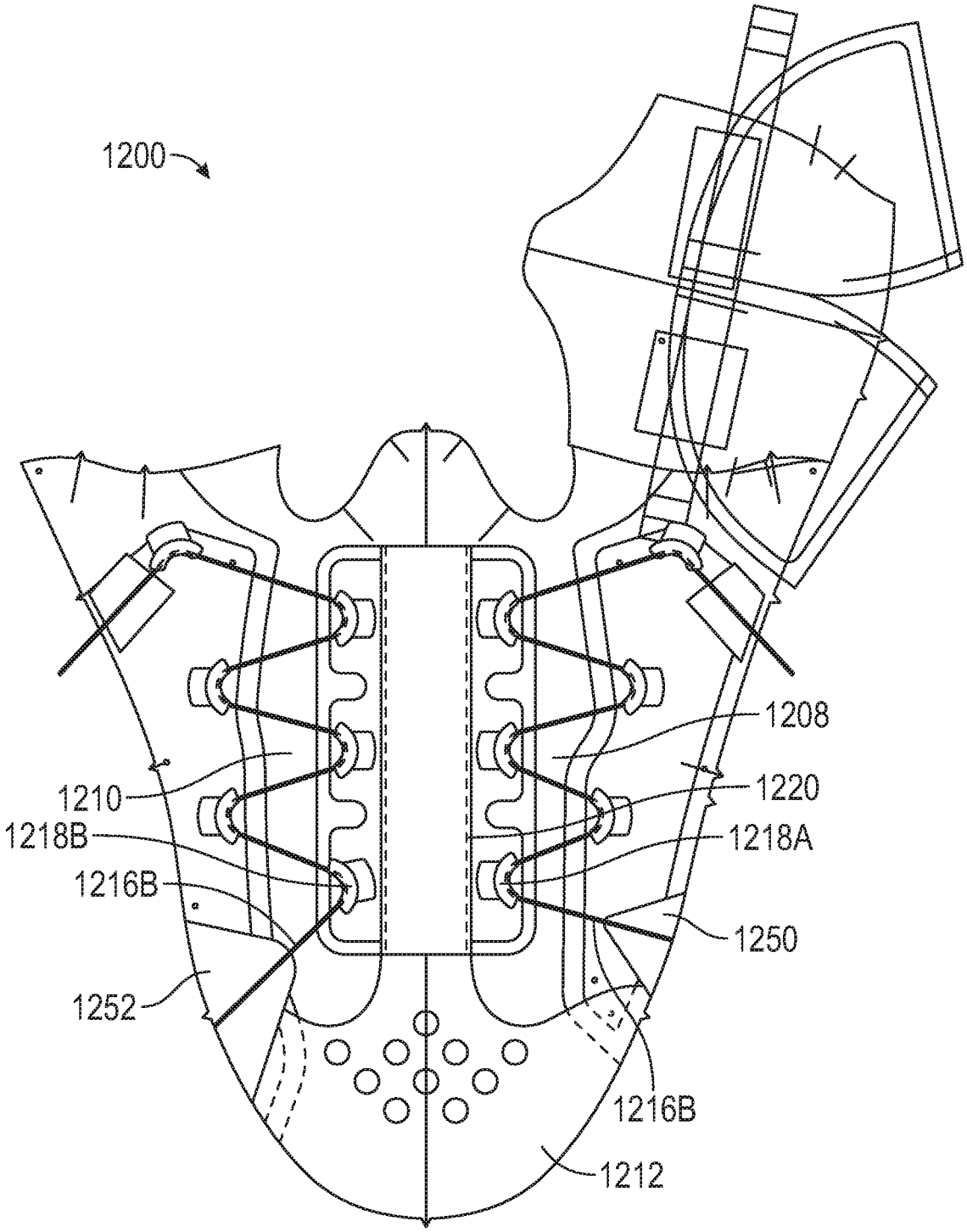
FIG. 20 is a diagram illustrating another embodiment of a footwear upper including a lacing architecture including tensioning straps connected to a lace in a non-cross-over configuration.

Tensioning straps 1202 and 1204 can have a variety of shapes to distribute the force of lace 1214 over medial panel 1208 and lateral panel 1210. Straps 1202 and 1204 can be triangular, quadrilateral, trapezoidal, rectilinear or any other shape. In an example, straps 1202 and 1204 are wider at the bottom near the sole structure and narrower at the top near lace 1214 in order to distribute forces from lace 1214 along a wide swath of footwear upper 1200 and the sole structure. Straps 1202 and 1204 can have the same shape or, as shown in FIG. 20, can have different shapes.

Figure 19:
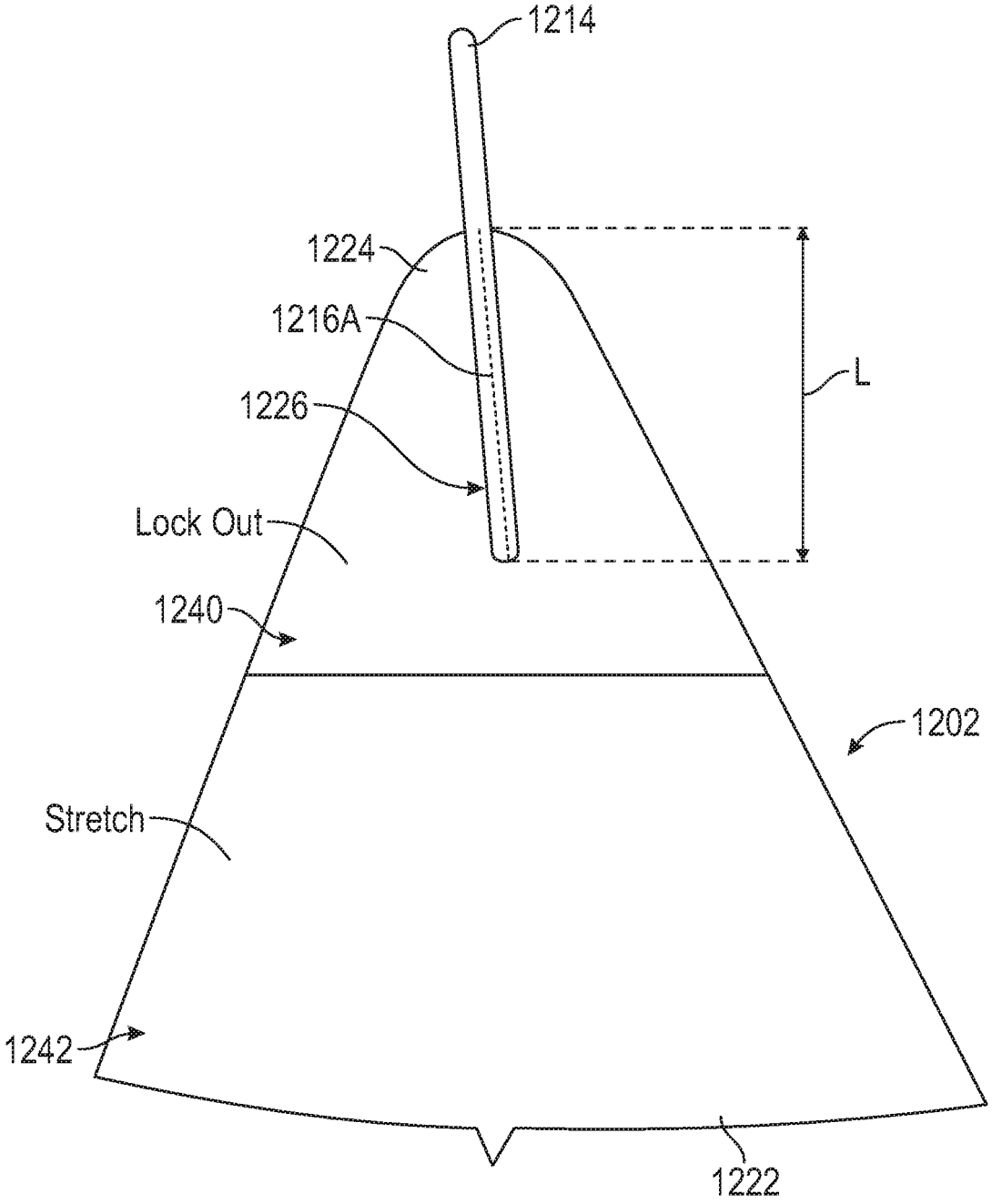
FIG. 19 is a diagram illustrating a tensioning strap of FIG. 18 indicating a lockout region and a stretch region.

FIG. 19 is a diagram illustrating tensioning strap 1202 of FIG. 18 indicating lockout region 1240 and stretch region 1242. Distal end portion 1216A of lace 1214 can be connected to lockout region 1240, such as by stitching 1226, along length L.

Bottom edge region 1222 of strap 1202 can be wider than top edge region 1224. Bottom edge region 1222 can be connected to footwear upper 1200 or a sole structure. In certain embodiments, only a portion of stretch region 1242, such as bottom edge region 1222, is connected to footwear upper 1200 or a sole structure in order to permit stretch region 1242 to stretch. In an embodiment, stretch region 1242 is comprised of elastic, a synthetic material, a polymer, a proprietary material having one or more of those properties, such as Lunar Fly Strap material, or the like. In other examples, a majority or an entirety of stretch region 1242 is connected to footwear upper 1200.

Lockout region 1240 can extend from stretch region 1242 to top edge region 1224. Lockout region 1240 can extend laterally across the entirety of the top-most portion of stretch region 1242. Lockout region 1240 can comprise a portion of tensioning strap 1202 that is less elastic or stretchable than stretch region 1242. In an example, lockout region 1240 can comprise a separate piece of material attached to the material of stretch region 1242. In another embodiment, lockout region 1240 is an extension of the material of stretch region 1242 that is treated so as to stiffen the material in lockout region 1240. For example, stitching 1226 along length L of lace 1214 can provide the stiffening treatment. In an example, length L can be approximately 15 millimeters. Additionally or alternatively, lockout region 1240 can be treated with hot melt material to secure distal end portion 1216A and stiffen lockout region 1240. In other embodiments, lockout region 1240 can be treated with a stretch-inhibiting coating, such as Terranina, to increase the lockout capabilities of tensioning strap 1202. Lockout capabilities can indicate an unwillingness to stretch in order to allow lace 1214 to be tightened. That is, a completely locked out lace will increase tightening on the foot proportionally to the amount the lace is cinched. In other words, the lace can no longer stretch. The lockout capabilities of lockout region 1240 and the stretching capabilities of stretch region 1242 can be varied in different combinations for different embodiments of tensioning strap 1202.

FIG. 20 is a diagram illustrating another embodiment of footwear upper 1200 including a lacing architecture including tensioning straps 1250 and 1252 connected to lace 1214 in a non-cross-over configuration. Footwear upper 1200 of FIG. 20 includes the same components as footwear upper 1200 of FIG. 18, except tensioning straps 1202 and 1204 are replaced with tensioning straps 1250 and 1252, and lacing guides 1218A and 1218B are added. As can be seen in FIG. 20 distal end portions 1216A and 1216B of lace 1214 can be configured to stay on the same side of footwear upper 1200 where they are connected to the lacing engine and their respective tensioning strap. That is, distal end portion 1216B can be connected to medial tensioning strap 1250 and can extend through lacing guide 1218A and other lacing guides 1218 across medial panel 1208 to connect to the lacing engine, while distal end portion 1216A can be connected to lateral tensioning strap 1252 and can extend through lacing guide 1218B and other lacing guides 1218 across lateral panel 1210 to connect to the lacing engine. Lacing guides 1218A and 1218B can be added to facilitate cinching of upper 1200 and stretching of elastic panel 1220 along a length of a throat region of upper 1200. As shown, the relative sizes of tensioning straps 1250 and 1252 can be varied to provide different performance characteristics on the medial and lateral sides of upper 1200. For example, tensioning straps 1250 and 1252 can be shorter than tensioning straps 1202 and 1204 in the non-crossover embodiment of FIG. 20 to, for example, bring distal end portions 1216A and 1216B closer to the sole structure. Also, medial tensioning strap 1250 can be shorter than lateral tensioning strap 1252, or vice versa, to change the force applied to the ball region, metatarsal region and the phalanges region of the foot.

Figure 21:
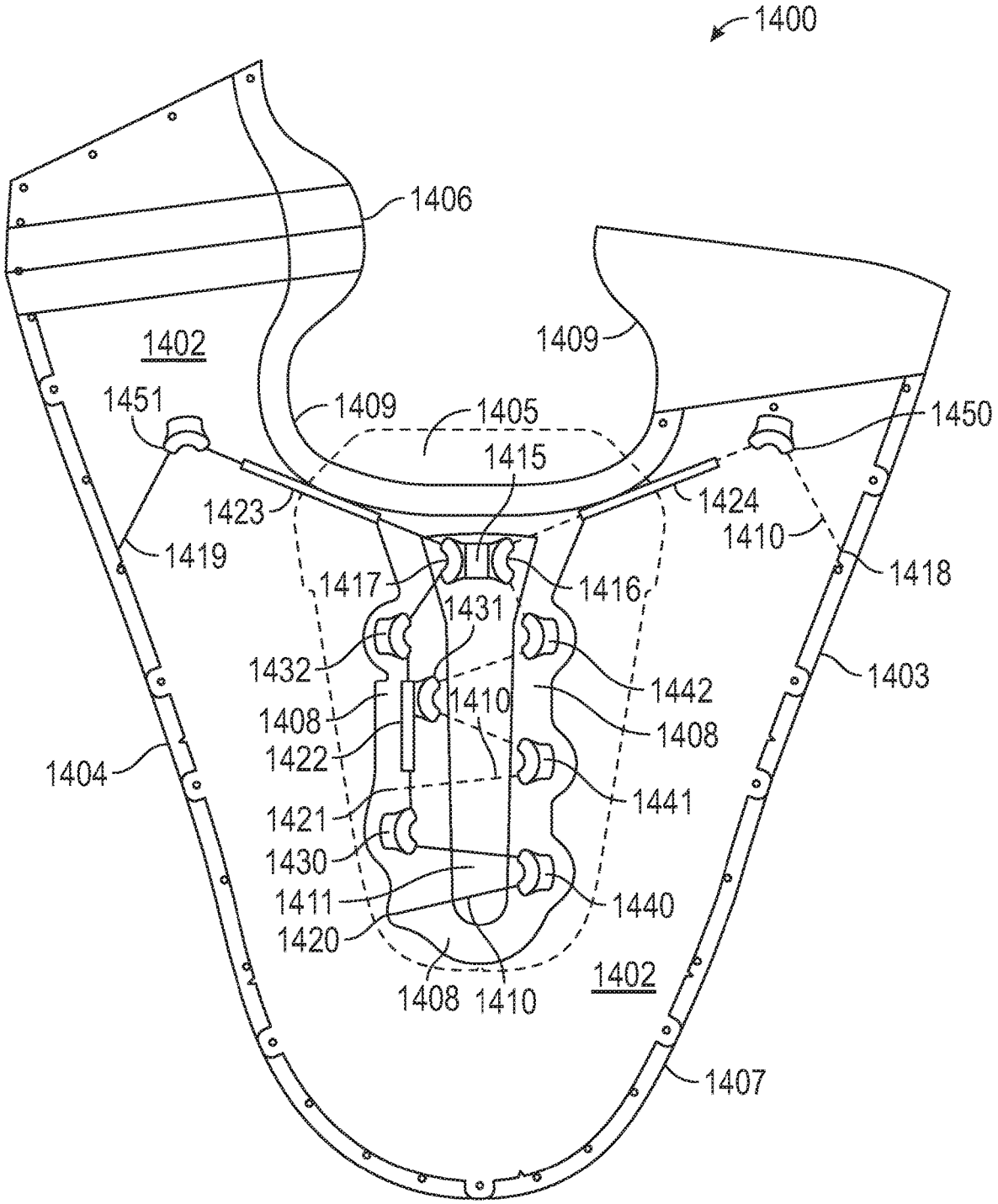
FIG. 21 is a top-view diagram illustrating a two-zone lacing architecture for use with footwear assemblies including a motorized or non-motorized lacing engine, according to some example embodiments.
Figure 22:
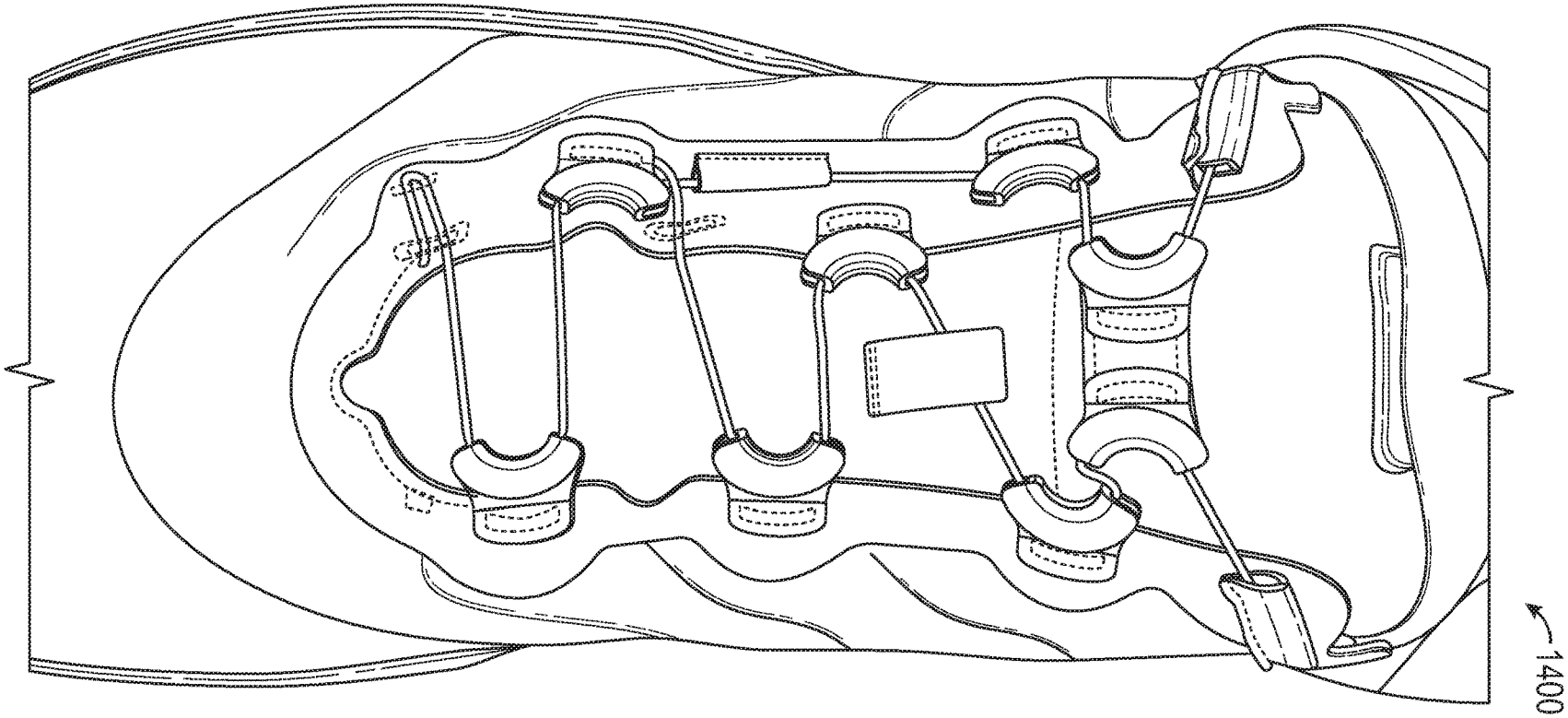
FIG. 22 is top-view perspective view of an article of footwear incorporating the upper and two-zone lacing architecture of FIG. 21, according to some example embodiments.

FIG. 21 is a top-view diagram illustrating a flattened footwear upper 1400 with a lacing architecture for use with a lacing engine, according to some example embodiments. FIG. 22 is a picture of an example footwear assembly utilizing the two-zone lacing architecture discussed in reference to FIG. 21. In this example, the footwear upper 1400 has a medial side 1403 and a lateral side 1404, as well as a distal (toe) end and a proximal (heel) end. The distal end includes a toe box section 1407 and the proximal end includes a heel portion 1406. The footwear upper 1400 can also include a floating textile layer (optional, not illustrated), an outer layer 1402, and a floating tongue 1405. The floating tongue 1405 extends out of the foot opening 1409 of the outer layer 1402 proximate a throat portion 1411 (also referred to as a throat section) formed from a U-shaped cut-out in at least the outer layer 1402. In some examples, the throat portion 1411 varies in configuration, including various cut-out shapes or alternative material sections. All throat portions allow for portions of the lateral and medial sides of the footwear assembly to move in reference to each other. In other examples, the throat portion 1411 can be integrated into a covered layer of the outer layer 1402, so the throat portion 1411 and the lacing architecture is concealed from external view. In some examples, the throat portion 1411 is also cut-out of the floating textile layer. The footwear upper 1400 can include some or all of the structures discussed in reference to footwear upper 300, but is illustrated in a more simplistic fashion to emphasize the two-zone lacing architecture.

In this example, the lacing architecture is split into two different zones. The first zone interacts with the toe or forefoot area of the footwear upper 1400. The second zone interacts with the mid-foot area of the footwear upper 1400. The first lacing zone lace cable is illustrated as a solid dark grey line, and the second lacing zone lace cable illustrated as a dotted black line. These differences are merely for illustrative purposes to assist in distinguishing the different lace cable paths, the lace cable in these details is a single cable running from termination 1420 to termination 1421 (terminations also referred to as anchor locations or anchor points). Alternatively, even in designs were the first lacing zone and the second lacing zone utilize different lace cables, the material used will typically be common between the different zones. The first lacing zone can include lace guides guiding the lace cable 1410 from a first lace termination 1420. In this example, the first lace termination 1420 is located on a distal-lateral portion of eyestay 1408. The lace cable 1410 is routed from the first lace termination 1420 across a distal end of throat portion 1411 and through a first medial lace guide 1440. From the first medial lace guide 1440 the lace cable 1410 is routed back over the throat portion 1411 and through a first lateral lace guide 1430. From the first lateral lace guide 1430, the lace cable 1410 is routed pass a second lateral lace guide 1431 and though a third lateral lace guide 1432. The lace guides are labeled first, second, third, etc. to signify an order running proximally from the distal end of the throat portion 411 towards the foot opening 1409. Optionally, the lace cable 1410 can route through a material guide 1422 en route from the first lateral lace guide 1430 to the third lateral lace guide 1432. From the third lateral lace guide 1432, the lace cable 1410 is routed through a lateral facing tongue lace guide 1417 and down to a lateral heel lace guide 1451 through an optional material guide 1422. The lateral heel lace guide 1451 routes the lace cable 1410 into a mid-sole plate via lateral lace exit 1419.

The second lacing zone includes a set of lace guides routing the lace cable 1410 from the second termination 1421 to the medial lace exit 1418. In this example, the lace cable 1410 is routed from the second termination 1421 on the lateral side of eyestay 1408 over the throat portion 1411 to the second medial lace guide 1441. From the second medial lace guide 1441 the lace cable 1410 is routed back over the throat portion 1411 to the second lateral lace guide 1431. The lace cable 1410 then routes through the second lateral lace guide 1431 back over the throat portion 411 for a third time and through the third medial lace guide 1442. The third medial lace guide 1442 routes the lace cable 1410 on to the medial facing tongue lace guide 1416, which routes the lace cable on towards the medial heel lace guide 1450. En route to the medial heel lace guide 1450 the lace cable can optionally be routed through a material lace guide 1424. From the medial heel lace guide 1450 the lace cable 1410 is routed into the mid-sole plate via the medial lace exit 1418.

The two-zone lacing architecture enables an uneven distribution of the lace cable tension between the distal end of the throat portion 1411 and the proximal end. The first lacing zone applies the same lace cable tension across fewer lace guides, resulting the tension being distributed across a smaller area. The second lacing zone distributes the lace cable tension over a larger area with more lace guides The user experiences a tighter, higher performance fit in the toe (forefoot) area of the footwear with the two-zone lacing architecture. Other multi-zone lacing architectures can be utilized to vary the distribution of lace cable tension as desired for a particular footwear application.

In this example, the lacing architecture includes a tongue lace guide assembly 1415 (or simply a tongue lace guide 1415). The tongue lace guide 1415 can include a medial facing lace guide 1416 and a lateral facing lace guide 1417. The medial facing lace guide 1416 and the lateral facing lace guide 1417 can be molded or formed from a single piece of material or be separate structures coupled together in some manner. In certain examples, the medial facing lace guide and the lateral facing lace guide can be coupled together with an elastic member, such as elastic member 440, that allows for some separation between the lace guides upon application of tension on the lace cable 1418. In certain examples, the medial facing lace guide 1416 and the lateral facing lace guide 1417 can be adhered to a tongue lace guide reinforcement. In yet other examples, the medial facing lace guide and the lateral facing lace guide are disposed on, wrapped in, or otherwise connected via a webbing material. The tongue lace guide reinforcement can be a no-stretch or limited-stretch material, a rigid material, or an elastic material. The tongue lace guide reinforcement can be adhered, stitched, or similarly affixed to the floating tongue 1405. In some examples, the tongue lace guide reinforcement can be padded or similarly constructed to distribute forces applied to the tongue lace guide across a wider area to avoid hot-spots for a user. In other examples, medial facing lace guide 1416 and lateral facing lace guide 1417 can be connected by an elastic element or webbing and can be floating relative to floating tongue 1405.

Embodiments of the present disclosure can be directed at adjusting the effective spring stiffness of a shoe when it is tightened on a foot. Deliberate elastic regions in the lace system of the footwear upper can allow for different tightening rates. For example, very stiff lacing systems can become very tight very quickly, potentially causing discomfort to the wearer. Elastic regions strategically added to the lacing system and/or the footwear upper can manipulate the lock out stiffness, travel, modulus or other parameters of the shoe to tune the fit of the footwear upper to the foot. As such, elastic zones can be added to the top and rear (or heel) areas of the foot to permit the footwear upper to pull down on the foot in a desirable manner. For example, the elastic zones can facilitate placement or pre-tensioning of an untightened material of the footwear upper, which can be thought of as a parachute of material that is cinched down on the foot by the lacing architecture. A user can adjust the lacing mechanism to adjust the article of footwear to have different comfort or performance characteristics, depending on desire, preference or use of the article of footwear.

EXAMPLES

Example 1 can include or use subject matter such as a footwear assembly comprising: a footwear upper including a toe box portion, a medial side, a lateral side, and a heel portion, the medial side and the lateral side each extending proximally from the toe box portion to the heel portion; a lace cable with a first end anchored along a distal outside portion of the medial side and a second end anchored along a distal outside portion of the lateral side; a plurality of lace guides distributed along the medial side and the lateral side, each lace guide of the plurality of lace guides adapted to receive a length of the lace cable, wherein the lace cable extends through each of the plurality of lace guides to form a pattern along each of the medial side and lateral side of the footwear upper; a medial proximal lace guide routing the lace cable from the pattern formed by a medial portion of the plurality of lace guides into a position allowing the lace cable to engage a lacing engine disposed within a mid-sole portion; a lateral proximal lace guide to route the lace cable out of the position allowing the lace cable to engage the lacing engine into the pattern formed by a lateral portion of the plurality of lace guides; and a first elastic member extending between first and second lace guides of the plurality of lace guides.

Example 2 can include, or can optionally be combined with the subject matter of Example 1 to optionally include, a first elastic member that can connect the first and second lace guides across a centerline portion of the footwear upper.

Example 3 can include, or can optionally be combined with the subject matter of one or any combination of Examples 1 or 2 to optionally include, a first elastic member that can connect the first and second lace guides across the heel portion of the footwear upper.

Example 4 can include, or can optionally be combined with the subject matter of one or any combination of Examples 1 through 3 to optionally include, a second elastic member that can extend between third and fourth lace guides of the plurality of lace guides.

Example 5 can include, or can optionally be combined with the subject matter of one or any combination of Examples 1 through 4 to optionally include, a first elastic member that can be interchangeable with different elastic members providing varying modulus of elasticity to change fit characteristics of the footwear upper.

Example 6 can include, or can optionally be combined with the subject matter of one or any combination of Examples 1 through 5 to optionally include, a first elastic member that can function to smooth out a torque versus lace displacement curve during tightening of the lace cable.

Example 7 can include or use subject matter such as a footwear lacing apparatus that can comprise: a housing structure that can comprise: a footwear assembly comprising: a footwear upper including a toe box portion, a medial side, a lateral side, and a heel portion, the medial side and the lateral side each extending proximally from the toe box portion to the heel portion; a lace cable with a first end anchored along a distal outside portion of the medial side and a second end anchored along a distal outside portion of the lateral side; a plurality of lace guides distributed along the medial side and the lateral side, each lace guide of the plurality of lace guides adapted to receive a length of the lace cable, wherein the lace cable extends through each of the plurality of lace guides to form a pattern along each of the medial side and lateral side of the footwear upper; a medial proximal lace guide routing the lace cable from the pattern formed by a medial portion of the plurality of lace guides into a position allowing the lace cable to engage a lacing engine disposed within a mid-sole portion; a lateral proximal lace guide to route the lace cable out of the position allowing the lace cable to engage the lacing engine into the pattern formed by a lateral portion of the plurality of lace guides; and a first elastic member extending between first and second portions of the footwear upper.

Example 8 can include, or can optionally be combined with the subject matter of Example 7 to optionally include, a first elastic member that can comprise an elastic centerline portion extending from at least the toe box portion proximally to a foot opening, and the first and second portions of the footwear upper can comprise the medial and lateral sides, respectively.

Example 9 can include, or can optionally be combined with the subject matter of one or any combination of Examples 7 or 8 to optionally include, a first elastic member that can comprise an elastic heel portion extending proximate to a foot opening, and the first and second portions of the footwear upper can comprise medial and lateral sides of the heel portion, respectively.

Example 10 can include, or can optionally be combined with the subject matter of one or any combination of Examples 1 through 9 to optionally include, a first elastic member that can function to smooth out a torque versus lace displacement curve during tightening of the lace cable.

Example 11 can include, or can optionally be combined with the subject matter of one or any combination of Examples 7 through 19 to optionally include, a first elastic member that can be opened or expanded to permit access to an interior space within the footwear upper.

Example 12 can include or use subject matter such as a footwear lacing apparatus that can comprise: a footwear assembly comprising: a footwear upper including a toe box portion, a medial side, a lateral side, and a heel portion, the medial side and the lateral side each extending proximally from the toe box portion to the heel portion; a lace cable with a first end anchored along a distal outside portion of the medial side and a second end anchored along a distal outside portion of the lateral side; a plurality of lace guides distributed along the medial side and the lateral side, each lace guide of the plurality of lace guides adapted to receive a length of the lace cable, wherein the lace cable extends through each of the plurality of lace guides to form a pattern along each of the medial side and lateral side of the footwear upper; a medial proximal lace guide routing the lace cable from the pattern formed by a medial portion of the plurality of lace guides into a position allowing the lace cable to engage a lacing engine disposed within a mid-sole portion; a lateral proximal lace guide to route the lace cable out of the position allowing the lace cable to engage the lacing engine into the pattern formed by a lateral portion of the plurality of lace guides; and a first elastic member extending between a first portion of the footwear upper and a first lace guide of the plurality of lace guides.

Example 13 can include, or can optionally be combined with the subject matter of Example 12 to optionally include, a first portion of the footwear upper that can comprise the heel portion and the first lace guide is located proximate the heel portion.

Example 14 can include, or can optionally be combined with the subject matter of one or any combination of Examples 12 or 13 to optionally include, a first portion of the footwear upper that can comprise either one of the medial side or the lateral side of the footwear upper and the first lace guide is located proximate a throat of the upper.

Example 15 can include, or can optionally be combined with the subject matter of one or any combination of Examples 12 through 14 to optionally include, a second elastic member that can extend between a second portion of the footwear upper and a second lace guide of the plurality of lace guides.

Example 16 can include, or can optionally be combined with the subject matter of one or any combination of Examples 12 through 15 to optionally include, a first elastic member that can be interchangeable with different elastic members providing varying modulus of elasticity to change fit characteristics of the footwear upper.

Example 17 can include, or can optionally be combined with the subject matter of one or any combination of Examples 12 through 16 to optionally include, a first elastic member that can function to smooth out a torque versus lace displacement curve during tightening of the lace cable.

Example 18 can include or use subject matter such as a footwear lacing apparatus that can comprise: a footwear assembly comprising: a sole structure; a footwear upper defining a toe box portion, a medial side, a lateral side, and a heel portion, the footwear upper connected to the sole structure to form an interior space for receiving a foot, the footwear upper forming a collar to permit access to the interior space; a lacing engine disposed in the sole structure; a lacing system comprising: a lace cable having medial and lateral ends anchored to the footwear upper and a middle portion passing through the lacing engine; and a plurality of lace guides for routing the lace cable along the footwear upper between the medial and lateral ends and the lacing engine; and a heel channel connected to the heel portion and configured to facilitate access to the interior space.

Example 19 can include, or can optionally be combined with the subject matter of Example 18 to optionally include, a heel channel that can comprise an elastic member coupling medial and lateral portions of the heel portion.

Example 20 can include, or can optionally be combined with the subject matter of one or any combination of Examples 18 or 19 to optionally include, an elastic member that can be coupled to the footwear assembly and functions to smooth out a torque versus lace displacement curve during tightening of the lace cable.

Example 21 can include, or can optionally be combined with the subject matter of one or any combination of Examples 18 through 20 to optionally include, a heel channel that can comprise a zipper.

Example 22 can include, or can optionally be combined with the subject matter of one or any combination of Examples 18 through 21 to optionally include, a heel channel that can comprise strips of hook and loop fastener material located on medial and lateral portions of the heel portion, respectively.

Example 23 can include or use subject matter such as a footwear lacing apparatus that can comprise: a footwear assembly comprising: a sole structure; a footwear upper defining a toe box portion, a medial side, a lateral side, and a heel portion, the footwear upper connected to the sole structure to form an interior space for receiving a foot, the footwear upper forming a collar to permit access to the interior space; a lacing engine disposed in the sole structure; a lacing system comprising: a lace cable having medial and lateral ends anchored to the footwear upper and a middle portion passing through the lacing engine, and a plurality of lace guides for routing the lace cable along the footwear upper between the medial and lateral ends and the lacing engine; and an elastic member coupled to the footwear assembly that functions to smooth out a torque versus lace displacement curve during tightening of the lace cable.

Example 24 can include, or can optionally be combined with the subject matter of Example 23 to optionally include, an elastic member that can be configured to stretch after the lacing engine has tightened the lace cable.

Example 25 can include, or can optionally be combined with the subject matter of one or any combination of Examples 23 or 24 to optionally include, an elastic member that can have a modulus of elasticity lower than that of the footwear upper.

Example 26 can include, or can optionally be combined with the subject matter of one or any combination of Examples 23 through 25 to optionally include, an elastic member that can be configured to widen the collar.

Example 27 can include, or can optionally be combined with the subject matter of one or any combination of Examples 23 through 26 to optionally include, an elastic member that can connect first and second lace guides of the plurality of lace guides.

Example 28 can include, or can optionally be combined with the subject matter of one or any combination of Examples 23 through 27 to optionally include, first and second lace guides that can be located on medial and lateral portions of the heel portion, respectively.

Example 29 can include, or can optionally be combined with the subject matter of one or any combination of Examples 23 through 28 to optionally include, first and second lace guides that can be located on the medial side and the lateral side of the footwear upper, respectively.

Example 30 can include, or can optionally be combined with the subject matter of one or any combination of Examples 23 through 29 to optionally include, first and second lace guides that can be floating relative to the footwear upper.

Example 31 can include, or can optionally be combined with the subject matter of one or any combination of Examples 23 through 30 to optionally include, an elastic member that can connect a first lace guide of the plurality of lace guides to a first portion of the shoe upper.

Example 32 can include, or can optionally be combined with the subject matter of one or any combination of Examples 23 through 31 to optionally include, a first lace guide that can be located on either the medial or lateral side of the footwear upper and a first portion of the shoe upper that can be located on the heel portion.

Example 33 can include, or can optionally be combined with the subject matter of one or any combination of Examples 23 through 32 to optionally include, a first lace guide and a first portion of the shoe upper that can be located on either the medial or lateral side of the footwear upper, and the first portion of the shoe upper can be located at the throat.

Example 34 can include, or can optionally be combined with the subject matter of one or any combination of Examples 23 through 33 to optionally include, first and second lace guides that can be floating relative to the footwear upper.

Example 35 can include, or can optionally be combined with the subject matter of one or any combination of Examples 23 through 35 to optionally include, an elastic member that can connect first and second portions of the shoe upper.

Example 36 can include, or can optionally be combined with the subject matter of one or any combination of Examples 23 through 35 to optionally include, a first portion of the shoe upper that can comprise a lateral side and a second portion of the shoe upper that can comprise a medial side, wherein the elastic member spans the heel portion.

Example 37 can include, or can optionally be combined with the subject matter of one or any combination of Examples 23 through 36 to optionally include, a first portion of the shoe upper that can comprise the lateral side and a second portion of the shoe upper that can comprise the medial side, wherein the elastic member can span a throat portion of the footwear upper.

Example 38 can include, or can optionally be combined with the subject matter of one or any combination of Examples 23 through 37 to optionally include, a plurality of elastic members that can be incorporated into the lacing system.

Example 39 can include or use subject matter such as a footwear lacing apparatus that can comprise: a footwear assembly comprising: a footwear upper including a toe box portion, a medial side, a lateral side, and a heel portion, the medial side and the lateral side each extending proximally from the toe box portion to the heel portion; a medial tensioning member secured to the medial side of the upper proximate the toe box; a lateral tensioning member secured to the lateral side of the upper proximate the toe box; a lace cable with a first end attached to the medial tensioning member and a second end attached to the lateral tensioning member; and a plurality of lace guides distributed along the medial side and the lateral side, each lace guide of the plurality of lace guides adapted to receive a length of the lace cable, wherein the lace cable extends through each of the plurality of lace guides to form a pattern along each of the medial side and lateral side of the footwear upper.

Example 40 can include, or can optionally be combined with the subject matter of Example 39 to optionally include, a footwear upper that can further comprise an elastic member connecting the medial and lateral sides of the footwear upper along a throat region of the footwear upper.

Example 41 can include, or can optionally be combined with the subject matter of one or any combination of Examples 39 or 40 to optionally include, medial and lateral tensioning members that can each be at least partially floating with respect to the medial and lateral sides of the footwear upper, respectively.

Example 42 can include, or can optionally be combined with the subject matter of one or any combination of Examples 39 through 41 to optionally include, medial and lateral tensioning members that can each comprise: a lockout zone; and a stretch zone.

Example 43 can include, or can optionally be combined with the subject matter of one or any combination of Examples 39 through 42 to optionally include, a lockout zone that can be connected to the lace cable and a stretch zone that can be connected to the footwear upper.

Example 44 can include, or can optionally be combined with the subject matter of one or any combination of Examples 39 through 43 to optionally include, a bottom edge of the stretch zone that can be connected to the footwear upper.

Example 45 can include, or can optionally be combined with the subject matter of one or any combination of Examples 39 through 44 to optionally include, a lockout zone that can be completely floating relative to the footwear upper.

Example 46 can include, or can optionally be combined with the subject matter of one or any combination of Examples 39 through 45 to optionally include, a lockout zone that can include a stretch-inhibiting coating.

Example 47 can include, or can optionally be combined with the subject matter of one or any combination of Examples 39 through 46 to optionally include, a lockout zone and a stretch zone that can be comprised of a contiguous sheet of material.

Example 48 can include, or can optionally be combined with the subject matter of one or any combination of Examples 39 through 47 to optionally include, first and second ends of the lace cable that can be stitched to the medial and lateral tensioning members, respectively, in the lockout zone.

Example 49 can include, or can optionally be combined with the subject matter of one or any combination of Examples 39 through 48 to optionally include, a lace cable that can further comprise: a first proximal portion connected to the medial side of the footwear upper and the first end of the lace cable; and a second proximal portion connected to the lateral side of the footwear upper and the second end of the lace cable; wherein the first end of the lace cable can be connected to the medial tensioning member and the second end of the lace cable is connected to the lateral tensioning member.

Example 50 can include, or can optionally be combined with the subject matter of one or any combination of Examples 39 through 49 to optionally include, a first end and a second end of the lace cable that can crossover a throat region of the footwear upper.

Example 51 can include, or can optionally be combined with the subject matter of one or any combination of Examples 39 through 50 to optionally include, a lace cable that can further comprise: a first proximal portion connected to the medial side of the footwear upper and the first end of the lace cable; and a second proximal portion connected to the lateral side of the footwear upper and the second end of the lace cable; wherein the first end of the lace cable can be connected to the lateral tensioning member and the second end of the lace cable can be connected to the medial tensioning member.

Example 52 can include, or can optionally be combined with the subject matter of one or any combination of Examples 39 through 51 to optionally include, a medial proximal lace guide that can route the lace cable from the pattern formed by a medial portion of the plurality of lace guides into a position allowing the lace cable to engage a lacing engine disposed within a mid-sole portion; and a lateral proximal lace guide to route the lace cable out of the position allowing the lace cable to engage the lacing engine into the pattern formed by a lateral portion of the plurality of lace guides.

Example 53 can include or use subject matter such as a footwear lacing apparatus that can comprise: a footwear assembly comprising: a sole structure; a footwear upper defining a toe box portion, a medial side, a lateral side, and a heel portion, the footwear upper connected to the sole structure to form an interior space for receiving a foot, the footwear upper forming a collar to permit access to the interior space; a lacing engine disposed in the sole structure; a medial floating overlay attached to the medial side of the footwear upper proximate the toe box portion; a lateral floating overlay attached to the lateral side of the footwear upper proximate the toe box portion; and a lacing system comprising: a lace cable having medial and lateral ends anchored to the medial and lateral floating overlays and a middle portion passing through the lacing engine; and a plurality of lace guides for routing the lace cable along the footwear upper between the medial and lateral ends and the lacing engine.

Example 54 can include, or can optionally be combined with the subject matter of Examples 53 to optionally include, a medial end of the lace cable that can be connected to the medial floating overlay and a lateral end of the lace cable that can be connected to the lateral floating overlay.

Example 55 can include, or can optionally be combined with the subject matter of one or any combination of Examples 53 and 54 to optionally include, medial and lateral ends of the lace cable that can crossover a throat region of the footwear upper between the medial and lateral sides.

Example 56 can include, or can optionally be combined with the subject matter of one or any combination of Examples 53 through 55 to optionally include, a medial end of the lace cable that can be connected to the lateral floating overlay and a lateral end of the lace cable that can be connected to the medial floating overlay.

Example 57 can include, or can optionally be combined with the subject matter of one or any combination of Examples 53 through 56 to optionally include, an elastic member that can connect the medial and lateral sides of the footwear upper.

Example 58 can include, or can optionally be combined with the subject matter of one or any combination of Examples 53 through 57 to optionally include, medial and lateral tensioning members that can each comprise: a lockout zone; and a stretch zone.

Example 59 can include, or can optionally be combined with the subject matter of one or any combination of Examples 53 through 58 to optionally include, a lockout zone that can be connected to the lace cable and a stretch zone that can be connected to the footwear upper.

Example 60 can include, or can optionally be combined with the subject matter of one or any combination of Examples 53 through 59 to optionally include, a bottom edge of a stretch zone that can be connected to the footwear upper.

Example 61 can include, or can optionally be combined with the subject matter of one or any combination of Examples 53 through 60 to optionally include, a lockout zone that can be completely floating relative to the footwear upper.

Example 62 can include, or can optionally be combined with the subject matter of one or any combination of Examples 53 through 61 to optionally include, a lockout zone that can include a stretch-inhibiting coating.

Example 63 can include, or can optionally be combined with the subject matter of one or any combination of Examples 53 through 62 to optionally include, a lockout zone and a stretch zone that can be comprised of a contiguous sheet of material.

Example 64 can include, or can optionally be combined with the subject matter of one or any combination of Examples 53 through 63 to optionally include, medial and lateral ends of the lace cable that can be stitched to the medial and lateral tensioning members, respectively, in a lockout zone.

Example 63 can include or use subject matter such as a footwear lacing apparatus that can comprise: a footwear assembly comprising: a footwear upper including a toe box portion, a medial side, a lateral side, and a heel portion, the medial side and the lateral side each extending proximally from the toe box portion to the heel portion and forming a throat region of the footwear upper; a medial tensioning member secured to the medial side of the upper proximate the toe box; a lateral tensioning member secured to the lateral side of the upper proximate the toe box; a lace cable with a first end attached to the medial tensioning member and a second end attached to the lateral tensioning member; and a plurality of lace guides distributed along the medial side and the lateral side; wherein the lace cable extends from the first end at the medial tensioning member, across the throat region, and through one or more lace guides along the lateral side; and wherein the lace cable extends from the second end at the lateral tensioning member, across the throat region, and through one or more lace guides along the medial side.

Example 65 can include, or can optionally be combined with the subject matter of Examples 64 to optionally include, a footwear upper that can further comprise an elastic member connecting the medial and lateral sides of the footwear upper along the throat region of the footwear upper.

Example 66 can include, or can optionally be combined with the subject matter of one or any combination of Examples 64 and 65 to optionally include, medial and lateral tensioning members that can each be at least partially floating with respect to the medial and lateral sides of the footwear upper, respectively.

Example 67 can include, or can optionally be combined with the subject matter of one or any combination of Examples 64 through 65 to optionally include, medial and lateral tensioning members that can each comprise: a stiff lockout zone; and an elastic stretch zone.

Example 68 can include, or can optionally be combined with the subject matter of one or any combination of Examples 64 through 67 to optionally include, a lockout zone that can be connected to the lace cable and a stretch zone that can be connected to the footwear upper.

Example 69 can include, or can optionally be combined with the subject matter of one or any combination of Examples 64 through 67 to optionally include, a lockout zone and a stretch zone that can be comprised of a contiguous sheet of material.

ADDITIONAL NOTES

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

Although an overview of the inventive subject matter has been described with reference to specific example embodiments, various modifications and changes may be made to these embodiments without departing from the broader scope of embodiments of the present disclosure. Such embodiments of the inventive subject matter may be referred to herein, individually or collectively, by the term "invention" merely for convenience and without intending to voluntarily limit the scope of this application to any single disclosure or inventive concept if more than one is, in fact, disclosed.

The embodiments illustrated herein are described in sufficient detail to enable those skilled in the art to practice the teachings disclosed. Other embodiments may be used and derived therefrom, such that structural and logical substitutions and changes may be made without departing from the scope of this disclosure. The disclosure, therefore, is not to be taken in a limiting sense, and the scope of various embodiments includes the full range of equivalents to which the disclosed subject matter is entitled.

As used herein, the term "or" may be construed in either an inclusive or exclusive sense. Moreover, plural instances may be provided for resources, operations, or structures described herein as a single instance. Additionally, boundaries between various resources, operations, modules, engines, and data stores are somewhat arbitrary, and particular operations are illustrated in a context of specific illustrative configurations. Other allocations of functionality are envisioned and may fall within a scope of various embodiments of the present disclosure. In general, structures and functionality presented as separate resources in the example configurations may be implemented as a combined structure or resource. Similarly, structures and functionality presented as a single resource may be implemented as separate resources. These and other variations, modifications, additions, and improvements fall within a scope of embodiments of the present disclosure as represented by the appended claims. The specification and drawings are, accordingly, to be regarded in an illustrative rather than a restrictive sense.

Each of these non-limiting examples can stand on its own, or can be combined in various permutations or combinations with one or more of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of"at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method (process) examples described herein, such as the footwear assembly examples, can include machine or robotic implementations at least in part.

The above description is intended to be illustrative, and not restrictive. For example, the above-described examples (or one or more aspects thereof) may be used in combination with each other. Other embodiments can be used, such as by one of ordinary skill in the art upon reviewing the above description. An Abstract, if provided, is included to comply with 37 C.F.R. § 1.72(b), to allow the reader to quickly ascertain the nature of the technical disclosure. It is submitted with the understanding that it will not be used to interpret or limit the scope or meaning of the claims. Also, in the above Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The invention claimed is:

1. A footwear assembly comprising:

a footwear upper including a toe box portion, a medial side, a lateral side, and a heel portion, the medial side and the lateral side each extending proximally from the toe box portion to the heel portion;

a lace cable with a first end anchored along a distal outside portion of the medial side and a second end anchored along a distal outside portion of the lateral side;

a plurality of lace guides distributed along the medial side and the lateral side, each lace guide of the plurality of lace guides adapted to receive a length of the lace cable, wherein the lace cable extends through each of the plurality of lace guides to form a pattern along each of the medial side and lateral side of the footwear upper;

a medial proximal lace guide routing the lace cable from the pattern formed by a medial portion of the plurality of lace guides into a position allowing the lace cable to engage a lacing engine disposed within a mid-sole portion;

a lateral proximal lace guide to route the lace cable out of the position allowing the lace cable to engage the lacing engine into the pattern formed by a lateral portion of the plurality of lace guides;

wherein the medial proximal lace guide and the lateral proximal lace guide are floating relative to the footwear upper; and a first elastic member extending between the medial proximal lace guide and the lateral proximal lace guide;

wherein the first elastic member connects the medial proximal and lateral proximal lace guides across the heel portion of the footwear upper.

2. The footwear assembly of claim 1, further comprising a second elastic member that connects first and second lace guides of the plurality of lace guides across a centerline portion of the footwear upper.

3. The footwear assembly of claim 2, further comprising a third elastic member extending between third and fourth lace guides of the plurality of lace guides.

4. The footwear assembly of claim 1, wherein the first elastic member is interchangeable with different elastic members providing varying modulus of elasticity to change fit characteristics of the footwear upper.

5. The footwear assembly of claim 1, wherein the first elastic member functions to smooth out a torque versus lace displacement curve during tightening of the lace cable.

6. The footwear assembly of claim 1, wherein the first elastic member is slidable relative to the footwear upper.

7. The footwear assembly of claim 1, wherein the medial proximal lace guide is connected to the footwear assembly via the lace cable and a first end of the first elastic member and the lateral proximal lace guide is connected to the footwear upper via the lace cable and a second end of the first elastic member.

8. The footwear assembly of claim 7, wherein the first elastic member further comprises a heel strap extending from the lateral proximal lace guide to an anchor point fixed to the footwear upper.

9. The footwear assembly of claim 8, wherein:

the first elastic member is configured to bias the lateral proximal lace guide toward the heel portion of the footwear upper; and the heel strap limits movement of the lateral proximal lace guide toward the toe box portion.

10. A footwear assembly comprising:

a footwear upper including a toe box portion, a medial side, a lateral side, and a heel portion, the medial side and the lateral side each extending proximally from the toe box portion to the heel portion;

a lace cable with a first end anchored along a distal outside portion of the medial side and a second end anchored along a distal outside portion of the lateral side;

a plurality of lace guides distributed along the medial side and the lateral side, each lace guide of the plurality of lace guides adapted to receive a length of the lace cable, wherein the lace cable extends through each of the plurality of lace guides to form a pattern along each of the medial side and lateral side of the footwear upper;

a medial proximal lace guide routing the lace cable from the pattern formed by a medial portion of the plurality of lace guides into a position allowing the lace cable to engage a lacing engine disposed within a mid-sole portion;

a lateral proximal lace guide to route the lace cable out of the position allowing the lace cable to engage the lacing engine into the pattern formed by a lateral portion of the plurality of lace guides; and a first elastic member extending between first and second portions of the footwear upper;

wherein the first elastic member comprises an elastic heel portion extending proximate to a foot opening, and the first and second portions of the footwear upper comprise medial and lateral sides of the heel portion, respectively; and wherein the first elastic member is configured to pre-tension medial and lateral portions of the lace cable.

11. The footwear assembly of claim 10, further comprising a second elastic member that comprises an elastic centerline portion extending from at least the toe box portion proximally to a foot opening, and the first and second portions of the footwear upper comprise the medial and lateral sides, respectively.

12. The footwear assembly of claim 10, wherein the first elastic member functions to smooth out a torque versus lace displacement curve during tightening of the lace cable.

13. The footwear assembly of claim 10, wherein the first elastic member can be opened or expanded to permit access to an interior space within the footwear upper.

14. The footwear assembly of claim 10, wherein the first elastic member is slidable relative to the footwear upper.

15. The footwear assembly of claim 10, wherein the first elastic member comprises:

a tensioning strap connecting a medial side of the lace cable and a lateral side of the lace cable across the heel portion of the footwear upper.

16. The footwear assembly of claim 15, wherein the tensioning strap further comprises:

a length of material comprising a first end portion and a second end portion;

a first juncture joining the first end portion to the lateral proximal lace guide; and a second juncture joining the second end portion to the medial proximal lace guide.

17. The footwear assembly of claim 16, wherein the first elastic member further comprises a heel strap extending from the lateral proximal lace guide to an anchor point fixed to the footwear upper.

18. A footwear assembly comprising:

a sole structure;

a footwear upper defining a toe box portion, a medial side, a lateral side, and a heel portion, the footwear upper connected to the sole structure to form an interior space for receiving a foot, the footwear upper forming a collar to permit access to the interior space;

a lacing engine disposed in the sole structure;

a lacing system comprising:

a lace cable having medial and lateral ends anchored to the footwear upper and a middle portion passing through the lacing engine; and a plurality of lace guides for routing the lace cable along the footwear upper between the medial and lateral ends and the lacing engine; and an elastic member coupled to the footwear assembly that functions to smooth out a torque versus lace displacement curve during tightening of the lace cable;

wherein the elastic member connects first and second lace guides of the plurality of lace guides;

wherein the first and second lace guides are located on medial and lateral portions of the heel portion, respectively; and wherein the elastic member is configured to pre-tension the first and second lace guides toward the heel portion of the footwear upper.

19. The footwear assembly of claim 18, wherein the elastic member is configured to stretch after the lacing engine has tightened the lace cable.

20. The footwear assembly of claim 18, wherein the elastic member had a modulus of elasticity lower than that of the footwear upper.

21. The footwear assembly of claim 18, wherein the first and second lace guides are floating relative to the footwear upper.

22. The footwear assembly of claim 18, further comprising a second elastic member that connects a third lace guide of the plurality of lace guides to a first portion of the shoe upper.

23. The footwear assembly of claim 22, wherein the third lace guide is located on either the medial or lateral side of the footwear upper and the first portion of the shoe upper is located on a throat portion of the footwear upper.

24. The footwear assembly of claim 23, wherein the third lace guide is floating relative to the footwear upper.

25. The footwear assembly of claim 18, further comprising a second elastic member that connects first and second portions of the shoe upper.

26. The footwear assembly of claim 25, wherein the first portion of the shoe upper comprises the lateral side and the second portion of the shoe upper comprises the medial side, wherein the elastic member spans the heel portion.

27. The footwear assembly of claim 25, wherein the first portion of the shoe upper comprises the lateral side and the second portion of the shoe upper comprises the medial side, wherein the second elastic member spans a throat portion of the footwear upper.

28. The footwear assembly of claim 18, further comprising a plurality of elastic members incorporated into the lacing system.

* * * * *